United States Patent [19]

Watanabe et al.

[11] Patent Number: 5,075,208

[45] Date of Patent: Dec. 24, 1991

[54] SILVER HALIDE PHOTOGRAPHIC MATERIAL

[75] Inventors: Hiroyuki Watanabe; Keizo Koya; Yasuhiro Yoshioka; Koki Nakamura, all of Kanagawa, Japan

[73] Assignee: Fuji Photo Film Co., Ltd., Kanagawa, Japan

[21] Appl. No.: 581,252

[22] Filed: Sep. 11, 1990

Related U.S. Application Data

[63] Continuation of Ser. No. 285,990, Dec. 19, 1988, abandoned.

[30] Foreign Application Priority Data

Dec. 18, 1987 [JP] Japan ..... 62-320771

[51] Int. Cl.[5] ..... G03C 1/06

[52] U.S. Cl. ..... 430/559; 430/223; 430/564; 430/955; 430/957; 430/958; 430/959

[58] Field of Search ..... 430/223, 564, 955, 956, 430/957, 958, 959

[56] References Cited

U.S. PATENT DOCUMENTS 4,420,554 12/1983 Ohashi et al. ..... 430/446
4,783,396 11/1988 Nakamura et al. .

FOREIGN PATENT DOCUMENTS 0220746 5/1987 European Pat. Off. ..... 430/957

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide photographic material containing a compound having a structure represented by formula (I)

(I)

wherein EAG represents a group capable of accepting an electron from a reducing material; E represents an electron-attracting group; $R^3$ represents an atomic group necessary for forming a 5-membered to 8-membered single ring or condensed ring by combining with the carbon atom carrying EAG and E; ETG represents an electron-transmitting group; n represents 0 or 1; $R^1$ and $R^2$, which may be the same or different, each represents a hydrogen atom, a hydrocarbon group, a heterocyclic group, or a single bond for forming a ring with EAG; Time represents a group releasing PUG upon cleavage of the bond between the carbon atom carrying $R^1$ and $R^2$ and Time; t represents 0 or 1; and PUG represents a photographically useful group.

8 Claims, No Drawings

SILVER HALIDE PHOTOGRAPHIC MATERIAL

This is a continuation of application No. 07/285,990 filed Dec. 19, 1988, now abandoned.

FIELD OF THE INVENTION

This invention relates to a silver halide photographic material, and more particularly to a silver halide photographic material containing a novel compound which releases a photographically useful group upon undergoing reduction.

BACKGROUND OF THE INVENTION

A compound reverse-imagewise releasing a photographically useful group, that is, a positive working compound is known to have various functions which are not obtainable by conventional precursors in silver halide photographic materials. Thus such compounds have been energetically investigated.

Suitable positive working compounds include the immobile compounds disclosed in U.S. Pat. Nos. 3,980,479 and 4,199,354, which were first proposed.

These compounds can release a photographic reagent upon an intramolecular nucleophilic reaction in the presence of an alkali in a reduced state thereof. On the other hand, these compounds can also reduce the releasing rate of the photographic reagent when the compound is oxidized by a redox reaction in a photographic light-sensitive material. By utilizing this property of the compound, a photographically useful group can be imagewise released. However, when using such a compound, there are many problems such as the excessive formation of fog and the reduction of discrimination caused by the discrepancy of timings of, for example, oxidation and alkaline hydrolysis since they are in a competing relation with each other.

For solving the aforesaid disadvantages of positive-working photographic reagent-releasing compounds, it was considered that the positive-working compound itself is converted into a form of the oxidized product and the photographically useful group is released therefrom upon a redox reaction with a reducing agent.

Very many positive-working compounds have been developed. For example, there are positive-working compounds releasing a photographic reagent by an intramolecular nucleophilic substitution reaction after being reduced as disclosed in U.S. Pat. Nos. 4,139,389, 4,139,379 and 4,564,577, JP-A Nos. 59-185333 and 57-84453 (the term "JP-A" as used herein means an "unexamined published Japanese patent application"), and positive-working compounds releasing a photographic reagent by an intramolecular electron transfer reaction after being reduced as disclosed in U.S. Pat. No. 4,232,107, JP-A Nos. 59-101649 and 61-88257, and *Research Disclosure*, No. 24025, IV, (April, 1984).

Furthermore, positive-working compounds releasing a photographic reagent by utilizing a bond which is cleaved by reduction have been investigated. Examples of such compounds are the compounds utilizing the reduction cleavage of a nitrogen-sulfur bond disclosed in German Patent No. 3,008,588 and the compounds utilizing a nitrogen-nitrogen bond disclosed in U.S. Pat. No. 4,619,884. Furthermore, there are the u-nitro compounds releasing a photographic reagent by cleaving the carbon-hetero atom single bond after receiving an electron disclosed in German Patent No. 3,207,583 and compounds utilizing a reduction cleavage of a carbon-hetero atom bond, such as geminal dinitro compounds of $\beta$-releasing a photographic reagent after causing the reduction cleavage of a nitrogen-nitrogen (nitro group) bond described in U.S. Pat. No. 4,609,610. Moreover, compounds utilizing the reduction cleavage of a carbon-hetero atom single bond include the nitrobenzyl compounds disclosed in U.S. Pat. No. 4,343,893.

Also, as a positive working compound further increasing the choice of the design and tolerance on production and the method of use of photographic light-sensitive materials by improving both the stability and the processing activity, the compounds described in European Patent No. 220,746A2 and *Kokai Giho*, No. 87-6199 have been proposed.

Each of the compounds having the functions described above has many particular advantages, but it is more preferred to increase the choice of the designing and tolerance on the production and method of use of photographic materials by improving the properties thereof and the range of suitable positive-working compounds for incorporation therein. Also, it is further desirable to provide a positive-working compound having more excellent stability in a photographic material before and after photographic processing. Moreover, it is also desirable to provide a better means for controlling the release of a photographically useful component.

SUMMARY OF THE INVENTION

An object of this invention is, therefore, to provide a silver halide photographic material containing a novel compound which is stable to condition of acid, alkali, and heat but which releases a photographically useful group by the co-use thereof with a reducing material ordinarily used in the photographic field.

The present inventors have made investigations on compounds which are stable to conditions of acid, alkali, and heat and which release a photographically useful group by the reduction thereof by selecting allyl-substituted compounds. As a result thereof, the inventors have discovered that it is necessary for reducing the carbon-carbon double bond of the allyl group of the allyl-substituted compound by the action of a reducing agent to bond an electron-accepting group to the allyl-substituted compound.

Furthermore, it has been discovered that a photographically useful group can be released by bonding an electron-attracting group to the double bonding carbon (by causing the polarization of the carbon-carbon double bond) from the site of not bonding a electron-accepting group.

Moreover, it has been discovered that by forming a ring structure containing a carbon-carbon double bond and an electron-attracting group, the synthesis of the compound becomes easy, which results in increasing the choice of substituents capable of synthesizing the compound and facilitating the control of its reactivity.

Thus, the inventors have discovered that the aforesaid and other objects and advantages can be attained by the present invention.

The invention provides a silver halide photographic material containing a novel compound represented by formula (I)

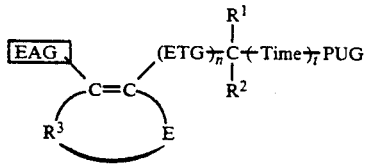

(I)

wherein EAG represents a group capable of accepting an electron from a reducing material; E represents an electron-attracting group, $R^3$ represents an atomic group necessary for forming a 5 membered to 8-membered single or condensed ring by combining with the carbon atom carrying EAG and E; ETG represents a group capable of transmitting an electron; n represents 0 or 1; $R^1$ and $R^2$, which may be the same or different, each represents a hydrogen atom, a hydrocarbon group, a heterocyclic group, or a single bond for forming a ring with EAG; Time represents a group releasing PUG upon cleavage of the bond between the carbon atom carying $R^1$ and $R^2$ and Time; t represents 0 or 1; and PUG represents a photographically useful group.

DETAILED DESCRIPTION OF THE INVENTION

The detailed mechanism of the reaction by which the compound shown by formula (I) releases a photographically useful group upon reaction with a reducing material has not yet been clarified at present, but the inventors postulate following mechanism.

The compound of this invention accepts one electron from a reducing material at the electron-accepting moiety (EAG) thereof and becomes an anion radical. Then, a large polarization occurs at the carbon-carbon double bond conjugated with the electron-accepting moiety to localize the electron at the carbon atom carrying E and to form a carboanion-like state.

By the aforesaid electron transfer, PUG is irreversibly released.

The compound shown by formula (I) is explained in detail below. First, EAG is described.

EAG represents an aromatic group capable of accepting an electron from a reducing material and is bonded to a carbon atom as shown in formula (I).

EAG is preferably a group represented by formula (A).

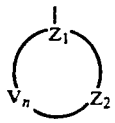

(A)

wherein $Z_1$ represents

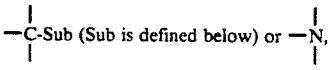

and V represents an atomic group forming a 3- to 8-membered aromatic ring with $Z_1$ and $Z_2$.

Specifically, V represents $-Z_3-$, $Z_3-Z_4-$, $-Z_3-Z_4-Z_5-Z_3-Z_4-Z_5-Z_6-$, $-Z_3-Z_4\ Z_5-Z_6-Z_7-$, or $-Z_3-Z_4-Z_5-Z_6\ Z_7-Z_8$.

$Z_2$ to $Z_8$ each represents

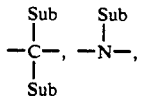

—O—, —S—, or $-SO_2-$ and Sub represents a single bond (n bond), a hydrogen atom, or a substituent as described hereinbelow. When plural Subs are present, they may be the same or different or may combine with each other to form a 3- to 8-membered saturated or unsaturated carbon ring or heterocyclic ring.

In formula (A), Sub is selected so that the sum of the Hammett's substituent constant op becomes at least +0.50, preferably at least +0.70, and most preferably at least +0.85.

When Sub represents a substituent, examples of the substituent, preferably having from 0 to 40 carbon atoms, include a nitro group, a nitroso group, a cyano group, a carboxy group, a sulfo group, a sulfino group, a sulfeno group, a mercapto group, an isocyano group, a thiocyano group, a hydroxy group, a halogen atom (e.g., fluorine, chlorine, bromine, iodine, etc.), an iodosyl group, an iodyl group, a diazo group, an azido group, an alkyl and aralkyl group (or substituted alkyl and aralkyl group, e.g., methyl, trifluoromethyl, benzyl, chloromethyl, dimethylaminomethyl, ethoxycarbonylmethyl, aminomethyl, acetylaminomethyl, ethyl, 2-(4-dodecanoylaminophenyl)ethyl, carboxyethyl, allyl, 3,3,3-trichloropropyl, n-propyl, iso-propyl, n-butyl, iso-butyl, sec-butyl, t-butyl, n-benzyl, sec-pentyl, t-pentyl, cyclopentyl, n-hexyl, sec-hexyl, t-hexyl, cyclohexyl, n-octyl, sec-octyl, t-octyl, n-decyl, n-undecyl, n-dodecyl, n-tetradecyl, n-pentadecyl, n-hexadecyl, sec-hexadecyl, t-hexadecyl, n-octadecyl, and t-octadecyl), an alkenyl group (and a substituted alkenyl group, e.g., vinyl, 2-chlorovinyl, 1-methylvinyl, 2-cyanovinyl, and cyclohexen-1-yl), an alkinyl group (and a substituted alkinyl group, e.g., ethynyl, 1-propynyl, and 2-ethoxycarbonylethynyl), an aryl group (and a substituted aryl group, e.g., phenyl, naphthyl, 3-hydroxyphenyl, 3-chlorophenyl, 4-acetylaminophenyl, 4-hexadecanesulfonylaminophenyl, 2 methanesulfonyl-4-nitrophenyl, 3-nitrophenyl, 4-methoxyphenyl, 4-acetylaminophenyl, 4-methanesulfonylphenyl, 2,4-dimethylphenyl, and 4-tetradecyloxyphenyl), a heterocyclic group (and a substituted heterocyclic group, e.g., 1-imidazolyl, 2-furyl, 2-pyridyl, 5-nitro-2-pyridyl, 3-pyridyl, 3,5-dicyano- 2-pyridyl, 5-tetrazolyl, 5-phenyl-1-tetrazolyl, 2-benzthiazolyl, 2-benzimidazolyl, 2-benzoxazolyl, 2-oxazolin-2-yl, and morpholino), an acyl group (and a substituted acyl group, e.g., acetyl, propionyl, butyroyl, iso-butyroyl, 2,2-dimethyl-propionyl, benzoyl, 3,4-dichlorobenzoyl, 3-acetylamino-4-methoxybenzoyl, 4-methylbenzoyl, and 4-methoxy-3-sulfobenzoyl), a sulfonyl group (and a substituted sulfonyl group, e.g., methanesulfonyl, ethanesulfonyl, chloromethane-sulfonyl, propanesulfonyl, butanesulfonyl, n-octanesulfonyl, n-dodecanesulfonyl, n-hexadecanesulfonyl, benzenesulfonyl, 4-toluenesulfonyl, and 4-n-dodecyloxybenzenesulfonyl), an amino group (and a substituted amino group, e.g., amino, methylamino, dimethylamino, ethylamino, ethyl-3-carboxy-propylamino, ethyl-2-sulfoethylamino, phenylamino, methyl-phenylamino, methyloctylamino, and methylhexadecylamino), an alkoxy group (and a substituted alkoxy group, e.g., methoxy, ethoxy, n-propyloxy, iso-propyloxy, and cyclohexyl methoxy), an aryloxy group or heterocyclic oxy group (including those having a substituent, e.g., phenoxy, naphthyl-oxy, 4 acetylaminophenoxy, pyrimidin-2-yloxy, and 2-pyridyloxy), an alkylthio group (and a substituted alkylthio group, e.g., methylthio, ethylthio, n-butylthio, n-octylthio, t-octylthio, n-dodecylthio, n-hecadecylthio, ethoxycarbonylmethylthio, benzylthio, and 2-hydroxyethylthio), an arylthio group or a heterocyclic thio group (including those having a substituent, e.g., phenylthio, nitrophenylthio, 2-nitrophenylthio, 4-acetylaminophenylthio, 1-phenyl-5-tetrazolylthio, 5-methanesulfonylbenzo thiazole-2-ylthio, etc.), an ammonio group (and a substituted ammonio group, e.g., ammonio, trimethylammonio, butylammonio), a carbamoyl group (and a substituted carbamoyl group, e.g., carbamoyl, methylcarbamoyl, dimethylcarbamoyl, bis-(2-methoxyethyl)-carbamoyl, diethylcarbamoyl, cyclohexylcarbamoyl, di-n-octylcarbamoyl, 3-dodecylpentylphenoxy)propylcarbamoyl, 3-octanesulfonylaminophenylcarbamoyl, and di-n-octadecylcarbamoyl), a sulfamoyl group (and a substituted sulfamoyl group, e.g., sulfamoyl, methylsulfamoyl, dimethylsulfamoyl, diethylsulfamoyl, bis(2-methoxyethyl)sulfamoyl, di-n-butylsulfamoyl, methyl-n-octylsulfamoyl, n-hexadecylmethylsulfamoyl, 3-ethoxypropylmethylsulfamoyl, N-phenyl-N-methylsulfamoyl, 4-decyloxyphenylsulfamoyl, and methyloctadecylsulfamoyl), an acylamino group (and a substituted acylamino group, e.g., acetylamino, 2-carboxybenzoylamino, 3-nitro-benzoylamino, 3-diethylaminopropanoylamino, and acryloyl amino), an acyloxy group (and a substituted acyloxy group, e.g., acetoxy, benzoyloxy, 3-butenoyloxy, 2-methylpropanoyloxy, and 3-(chloro 4 tetradecyloxybenzoyloxy)), a sulfonylamino group (and a substituted sulfonylamino group, e.g., methanesulfonylamino, benzenesulfonylamino, 2-methoxy-5-n-methylbenzenesulfonylamino, and 2 chloro-5-dodecanoylaminobenzene-sulfonylamino), an alkoxycarbonylamino group (and a substituted alkoxycarbonylamino group, e.g., methoxycarbonylamino, ethoxycarbonylamino, 2-methoxyethoxycarbonylamino, isobutoxycarbonylamino, benzyloxycarbonylamino, t-butoxycarbonylamino, and 2-cyanoethoxycarbonylamino), an aryloxycarbonylamino group (and a substituted aryloxycarbonylamino group, e.g., phenoxycarbonylamino, 2,4-dimethylphenoxycarbonylamino, 4-nitrophenoxycarbonylamino, and 4-t-butoxyphenoxycarbonylamino), an alkoxycarbonyloxy group (and a substituted alkoxycarbonyloxy group, e.g., methoxycarbonyloxy, t-butoxycarbonyloxy, 2-benzenesulfonylethoxy-carbonyloxy, n-decyloxycarbonyloxy, and benzyloxycarbonyloxy), an aryloxycarbonyloxy group (and a substituted aryloxycarbonyloxy group, e.g., phenoxycarbonyloxy, 3-cyanophenoxycarbonyloxy, 4-acetoxyphenoxycarbonyloxy, 4-t-butoxycarbonylaminophenoxycarbonyloxy, and 4-hydroxy-3-benzenesulfonylaminophenoxycarbonyloxy), an aminocarbonylamino group (and a substituted aminocarbonylamino group, e.g., methylaminocarbonylamino, morpholinocarbonylamino, diethylaminocarbonylamino, N-ethyl-N-phenylaminocarbonylamino, 4-cyanophenylaminocarbonylamino, and 4-methanesulfonylphenylaminocarbonylamino), an aminocarbonyloxy group (and a substituted aminocarbonyloxy group, e.g., dimethylaminocarbonyloxy, pyrrolidinocarbonyloxy, and 4-dipropylaminophenylaminocarbonyloxy), and an aminosulfonylamino group (and a substituted aminosulfonylamino group, e.g., diethylaminosulfonylamino, di-n-butylaminosulfonylamino, and phenylaminosulfonylamino).

In formula (I) described above, EAG is preferably an aryl group or heterocyclic group substituted by at least one electron-attracting group. The substituent bonded to the aryl group or heterocyclic group can be utilized for controlling the properties of the compound. For example, the substituent can be utilized for controlling the water solubility, the oil solubility, the diffusibility, the sublimability, the melting point, the dispersibility for a binder such as gelatin, the reactivity to a nucleophilic group, and the reactivity to an electrophilic group.

Specific examples of EAG are illustrated below.

Examples of the aryl group substituted by at least one electron-attracting group are 4-nitrophenyl, 2-nitrophenyl, 2-nitro-4-N-methyl-N-n butylsulfamoylphenyl, 2-nitro-4-N-methyl-N-n-octylsulfamoylphenyl, 2-nitro-4-N-methyl-N-n-dodecylsulfamoylphenyl, 2-nitro-4-N methyl-N-n-hexadecyl-sulfamoylphenyl, 2-nitro-4-N-methyl-N-n octadecylsulfamoylphenyl, 2-nitro-4-N-methyl-N-(3-carboxypropyl)sulfamoyl phenyl, 2-nitro-4-N-ethyl-N-(2-sulfoethyl)sulfamoylphenyl, 2-nitro-4-N-n-hexadecyl-N-(3-sulfopropyl)sulfamoylphenyl, 2-nitro-4-N-(2-cyanoethyl)-N-[(2-hydroxyethoxy)ethyl]-sulfamoylphenyl, 2-nitro-4-diethylsulfamoylphenyl, 2-nitro-4-di-n-butylsulfamoylphenyl, 2-nitro-4-di-n-octyl-sulfamoyl-phenyl, 2-nitro-4-di-n-octadecylsulfamoyl-phenyl, 2-nitro-4-methylsulfamoylphenyl, 2-nitro-4-n-hexadecylsulfamoylphenyl, 2-nitro-4-N-methyl-N-(4-dodecylsulfonylphenyl)sulfamoylphenyl, 2-nitro-4-(3-methylsulfamoylphenyl)sulfamoylphenyl, 4-nitro-2-N-methyl-N-n butylsulfamoylphenyl group, 4-nitro-2-N-methyl-N-n-octylsulfamoylphenyl, 4-nitro-2-N-methyl-N-n-dodecylsulfamoylphenyl, 4-nitro-2-N-methyl-N-n-hexadecylsulfamoylphenyl, 4-nitro-2-N-methyl-N-n-octadecylsulfamoylphenyl, 4-nitro-2-N-methyl-N-(3-carboxypropyl)sulfamoylphenyl, 4-nitro-2-N-ethyl N-(2-sulfoethyl)sulfamoylphenyl, 4-nitro-2-N-n-hexadecyl-N-(3-sulfopropyl)sulfamoylphenyl, 4-nitro-2-N-(2-cyanoethyl)-N-[(2-hydroxyethoxy)ethyl]sulfamoylphenyl, 4-nitro-2-diethylsulfamoylphenyl, 4-nitro-2-di-n-butyl-sulfamoylphenyl, 4-nitro-2-di-n-octylsulfamoyl-phenyl, 4-nitro-2-di-n-octadecylsulfamoylphenyl, 4-nitro-2-methylsulfamoylphenyl, 4-nitro- 2-n-hexadecyl-sulfamoylphenyl, 4-nitro-2-N-methyl-N-(4-dodecylsulfonylphenyl)sulfamoylphenyl, 4-nitro-2-(3-methylsulfamoylphenyl)sulfamoylphenyl, 4-nitro-2-chlorophenyl, 2-nitro-4-chlorophenyl, 2-nitro-4-N-methyl-N-n-butylcarbamoylphenyl, 2-nitro-4-N-methyl-N-n-octyl-carbamoylphenyl, 2-nitro-4-N-methyl-N-n-dodecyl-carbamoylphenyl, 2-nitro-4-N-methyl-N-n-hexadecyl-carbamoylphenyl, 2-nitro-4-N-methyl-N-n-octadecyl-carbamoylphenyl, 2-nitro-4-N-methyl-N-(3-carboxy-propyl)carbamoylphenyl, 2-nitro-4-N-ethyl-N-(2-sulfo-ethyl)carbamoylphenyl, 2-nitro-4-N-n-hexadecyl-N-(3-sulfopropyl)carbamoylphenyl, 2-nitro-4-N-(2-cyanoethyl)-N-[(2-hydroxyethoxyethyl]carbamoylphenyl, 2 nitro-4-diethylcarbamoylphenyl, 2-nitro-4-di-n-butyl-carbamoylphenyl, 2-nitro-4-di-n-octylcarbamoylphenyl, 2-nitro-4-di-n-octadecylcarbamoylphenyl, 2-nitro-4-methylcarbamoylphenyl, 2-nitro-4-di-n-octylcarbamoylphenyl, 2-nitro-4-N-methyl-N-(4-dodecylsulfonylphenyl)carbamoylphenyl, 2-nitro-4-(3-methylsulfamoylphenyl)carbamoylphenyl, 4-nitro-2-N-methyl-N-n-butylcarbamoylphenyl, 4-nitro-2-N-methyl-N-n-octylcarbamoylphenyl, 4-nitro-2-N-methyl-N-n-dodecylcarbamoylphenyl, 4-nitro-2-N-methyl-N-n-hexadecylcarbamoylphenyl, 4-nitro-2-N-methyl-N-n-octadecylcarbamoylphenyl, 4-nitro-2-N-methyl-N (3-carboxypropyl)carbamoylphenyl, 4-nitro-2-N-ethyl-N-(2-sulfoethyl)carbamoylphenyl, 4-nitro-2-N-n-hexadecyl-N-(3-sulfopropyl)carbamoylphenyl, 4-nitro-2-N-(2-cyanoethyl)-N-[(2-hydroxyethoxy)ethyl]carbamoylphenyl, 4-nitro-2-diethylcarbamoylphenyl, 4 nitro-2-di-n-butylcarbamoylphenyl, 4-nitro-2 di n-octylcarbamoylphenyl, 4-nitro-2-di-n-octadecylcarbamoylphenyl, 4-nitro-2-methyl-carbamoylphenyl, 4-nitro-2-n-hexadecylcarbamoylphenyl, 4-nitro 2-N-methyl-N-(4-dodecylsulfonylphenyl)carbamoylphenyl, 4-nitro-2-(3-methylsulfamoylphenyl)carbamoylphenyl, 2,4-dimethanesulfonylphenyl, 2-methane-sulfonyl-4-benzenesulfonylphenyl, 2-n-octanesulfonyl-4-methanesulfonylphenyl, 2-n-tetradecanesulfonyl-4-methanesulfonylphenyl, 2-n-hexadecanesulfonyl-4-methanesulfonylphenyl, 2,4-di-n-dodecanesulfonylphenyl, 2,4 didodecanesulfonyl-5-trifluoromethylphenyl, 2-n-decanesulfonyl-4-cyano-5-trifluoromethylphenyl, 2-cyano-4-methanesulfonylphenyl, 2,4,6-tricyanophenyl, 2,4-dicyanophenyl, 2-nitro-4-methanesulfonylphenyl, 2-nitro-4-n-dodecanesulfonylphenyl, 2-nitro-4 (2-sulfoethylsulfonyl)phenyl, 2-nitro-4-carboxymethylsulfonylphenyl, 2-nitro-4-carboxyphenyl, 2-nitro-4-ethoxycarbonyl-5 n-butoxyphenyl, 2-nitro 4-ethoxycarbonyl-5 n-hexadecyloxyphenyl, 2-nitro-4-diethylcarbamoyl-5-n-hexadecyloxyphenyl, 2-nitro-4-cyano-5-n dodecylphenyl, 2,4 dinitrophenyl, 2-nitro-4-n-decylthiophenyl, 3,5-dinitrophenyl, 2-nitro-3,5-dimethyl-4-n-hexadecanesulfonylphenyl, 4-methanesulfonyl-2-benzenesulfonylphenyl, 4-n-octanesulfonyl- 2-methanesulfonylphenyl, 4-n-tetradecanesulfonyl-2-methanesulfonylphenyl, 4-n-hexadecanesulfonyl-2-methanesulfonylphenyl, 2,5-didodecanesulfonyl-4-trifluoromethylphenyl, 4-n-decanesulfonyl-2-cyano-5-trifluoromethylphenyl, 4-cyano-2-methanesulfonylphenyl, 4-nitro-2-methanesulfonylphenyl, 4-nitro-2-n-dodecanesulfonylphenyl, 4-nitro-2-(2-sulfoethylsulfonyl)phenyl, 4-nitro-2-carboxymethylsulfonylphenyl, 4-nitro-2-carboxyphenyl, 4-nitro-2-ethoxycarbonyl-5-n-butoxyphenyl, 4-nitro-2-ethoxycarbonyl-5-n-hexadecyloxy-phenyl, 4-nitro-2-diethylcarbamoyl-5-n-hexadecyloxyphenyl, 4-nitro-2-cyano-5-n-dodecylphenyl, 4-nitro-2-n-decylthiophenyl, 4-nitro-3,5-dimethyl-2-n-hexadecanesulfonylphenyl, 4-nitronaphthyl, 2,4-dinitronaphthyl, 4-nitro-2-n octadecyl-carbamoylnaphthyl, 4-nitro-2-dioctylcarbamoyl-5-(3-sulfobenzenesulfonylamino)-naphthyl, 2,3,4,5,6-pentafluorophenyl, 2-nitro-4-benzoylphenyl, 2,4-diacetylphenyl, 2-nitro-4-trifluoromethylphenyl, 4-nitro-2-trifluoromethylphenyl, 4 nitro-3-trifluoromethylphenyl, 2,4,5-tricyanophenyl, 3,4-dicyanophenyl, 2-chloro-4,5-dicyanophenyl, 2-bromo-4,5-dicyanophenyl, 4-methanesulfonylphenyl, 4-n-hexadecane-sulfonylphenyl, 2-decanesulfonyl-5 trifluoromethylphenyl, 2-nitro-5-methylphenyl, 2-nitro-5-n-octadecyloxyphenyl, and 2-nitro-4-N-(vinylsulfonylethyl)-N-methylsulfamoylphenyl.

Also, examples of the heterocyclic group for EAG are 2-pyridyl, 3-pyridyl, 4-pyridyl, 5-nitro-2-pyridyl, 5-nitro-N-hexadecylcarbamoyl-2-pyridyl, 3,5-dicyano-2-pyridyl, 5-dodecanesulfonyl-2-pyridyl, 5-cyano-2-pyradyl, 4-nitrothiophen-2-yl, 5-nitro-1,2-dimethylimidazol-4-yl, 3,5-diacetyl-2-pyridyl, 1-dodecyl-5-carbamoylpyridinium-2-yl, 5-nitro-2-furyl, 5-nitrobenzo-thiazol-2-yl, and 2-methyl-6-nitrobenzoxazol-5-yl.

In formula (I), E represents an electron-attracting group as described above and is particularly preferably

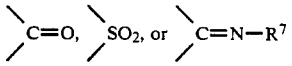

(wherein $R^7$ represents a hydrogen atom or a substitutable group such as alkyl, aryl, and heterocyclic.

In formula (I), $R^1$ and $R^2$, which may be the same or different, each represents a hydrogen atom or a hydrocarbon group. The hydrocarbon group may have a substituent. Examples of the hydrocarbon group include an alkyl group, an aralkyl group, an alkenyl group, an alkinyl group, and an aryl group.

Preferred examples of $R^1$ and $R^2$ are a hydrogen atom, a substituted or unsubstituted alkyl group (e.g., methyl, ethyl, hydroxymethyl, and nitromethyl), a substituted or unsubstituted aryl group (e.g., phenyl, 4-chlorophenyl, and 2-methylphenyl), a substituted or unsubstituted heterocyclic group (e.g., 4-pyridyl), or a single bond forming a ring with EAG.

ETG is described hereinafter.

ETG represents a group capable of transmitting an electron and is bonded to the olefin carbon atom carrying E and the carbon atom carrying $R^1$ and $R^2$.

The group capable of transmitting an electron is practically a group which has a bond having electron showing large freedom of electron transfer and which can conjugate with the carbon-carbon double bond shown in formula (I).

Accordingly, many conjugated systems can be used for ETG but specific examples of the preferred electron transmitting group are the groups shown by formulae (E-1) to (E-4);

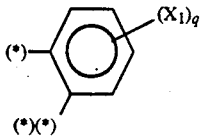

(E-1)

wherein (*) and (*)(*) each represents a moiety bonding to the olefin carbon atom carrying E and the carbon atom carrying $R^1$ and $R^2$, respectively, in formula (I); $X_1$ represents a hydrogen atom, a substituted or unsubstituted aliphatic group, a substituted or unsubstituted aromatic group, a substituted or unsubstituted heterocyclic group,

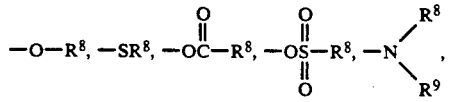

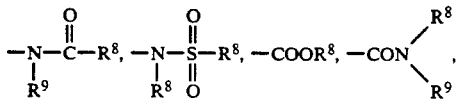

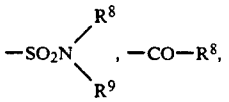

—$SO_2$—$R^8$ (wherein $R^8$ and $R^9$, which may be the same or different, each represents a hydrogen atom, a substituted or unsubstituted aliphatic group, a substituted or unsubstituted aromatic group, or a substituted or unsubstituted heterocyclic group), a cyano group, a halogen atom (e.g., fluorine, chlorine, bromine, and iodine), or a nitro group; and q represents an integer of from 1 to 4; when q is 2 or more, plural $X_1$s may be the same or different and when q is 2 or more, $X_1$s may combine with each other to form a ring.

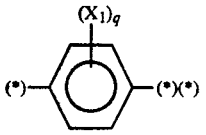

(E-2)

wherein (*), (*)(*), $X_1$ and q have the same meaning as defined above in formula (E-1).

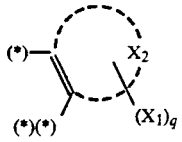

(E-3)

wherein $X_2$ represents an atomic group which contains at least one of carbon, nitrogen, oxygen, and sulfur and is necessary for forming a 5-membered to 7-membered heterocyclic ring. The aforesaid heterocyclic ring may be further condensed with a benzene ring or a 5-membered to 7-membered heterocyclic ring. Examples of the preferred heterocyclic ring are pyrrole, pyrazole, imidazole, triazole, furan, oxazole, thiophene, thiazole, pyridine, pyridazine, pyrimidine, pyrazine, azepine, oxepine, indole, benzofuran, and quinoline.

(*), (*)(*), Xl and q in formula (E-3) have the same meaning as defined above in formula (E-1).

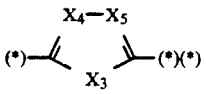

(E-4)

wherein (*) and (*)(*) have the same meaning as defined above in formula (E-1), $X_3$ represents an atomic group which contains at least one of carbon, nitrogen, oxygen, and sulfur and is necessary for forming a 5-membered to 7-membered heterocyclic ring and $X_4$ and $X_5$ each represents

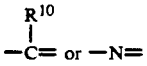

(wherein $R^{10}$ represents a hydrogen atom, a substituted or unsubstituted aliphatic group, or a substituted or unsubstituted aromatic group). The aforesaid heterocyclic ring may be further condensed with a benzene ring or a 5-membered to 7-membered heterocyclic ring.

Examples of the preferred heterocyclic ring are pyrrole, imidazole, triazole, furan, oxazole, oxadiazole, thiophene, thiazole, thiadiazole, pyridine, pyridazine, pyrimidine, pyrazine, azepine, oxepine, and isoquinoline.

In formula (I) described above, $R^3$ represents an atomic group bonded to the carbon atom carrying EAG and bonded to E and comprises the remainder of the 5-membered to 8-membered single or condensed ring with E. Examples of such atomic groups for R3 forming a 5-membered to 8-membered rings are shown below.

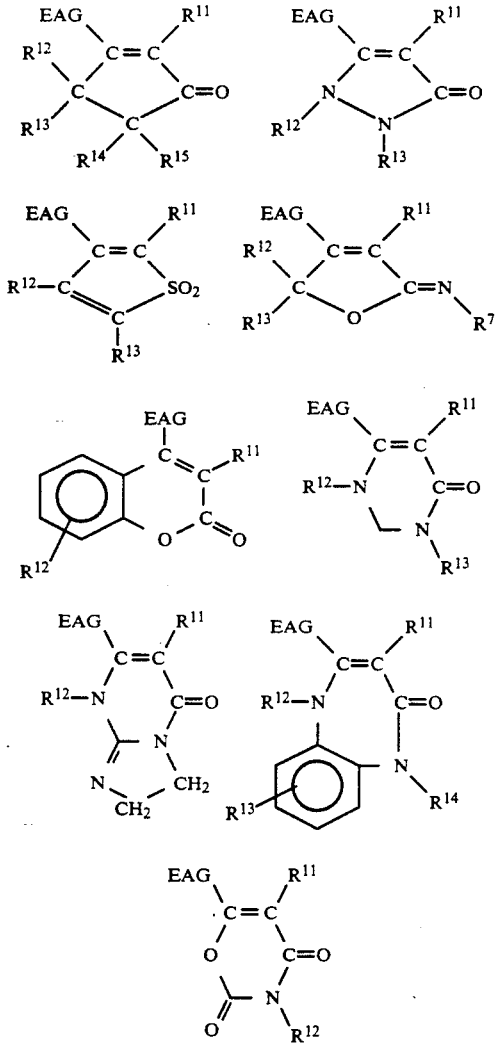

wherein $R^{11}$ represents $\left(ETG\right)_n C(R^1)(R^2)\text{—}\left(Time\right)_t PUG$, $R^7$ is the same as defined above in E, and $R^{12}$, $R^{13}$, $R^{14}$, and $R^{15}$ each represents a hydrogen atom or a substitutable group such as alkyl, aryl and heterocyclic.

For increasing the tolerance and choice of desired characteristics and the synthetic design of the positive-working compound, the compound shown by formula (I) is preferably the compound shown by formula (II)

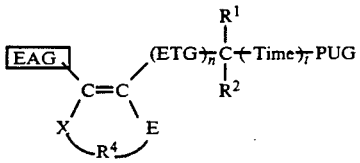

(II)

wherein X represents an atom having an isolated electron pair; $R^4$ represents an atomic group being bonded to X and E and necessary for forming a 5-membered to 8-membered single or condensed ring by connecting X and E; and other symbols are the same as defined above in formula (I).

Preferred examples of X are —O—, —S—, and —N—

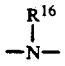

(wherein $R^{16}$ represents a hydrogen atom or a substitutable group such as alkyl, aryl and heterocyclic).

$R^4$ in formula (II) represents an atomic group being bonded to X and E and necessary for forming a 5-membered to 8-membered single or condensed ring including X and E and examples of the ring including the atomic group $R^4$ are as follows.

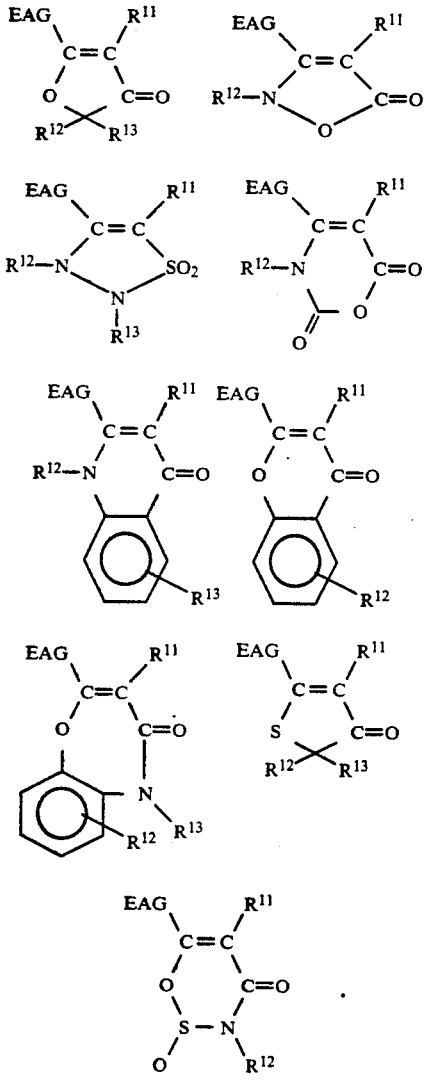

wherein EAG, $R^{11}$, $R^{12}$, and $R^{13}$ are the same as defined above in formula (I).

Among the compounds shown by formula (II), compounds exhibiting better characteristics as the positive working compound include the compound shown by formula (III)

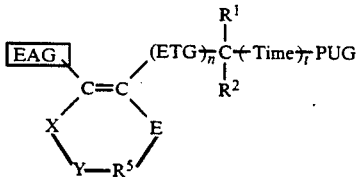

(III)

wherein Y represents an atom having an isolated electron pair; $R^5$ represents an atomic group being bonded to Y and E and necessary for forming a 5-membered to 8-membered single or condensed ring by connecting Y and E; and EAG, E, X, ETG, n, $R^1$, $R^2$, Time, t, and PUG are the same as defined above in formulae (I) and (II).

Preferred examples of Y are —O—, —S—, and —N—

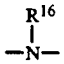

(wherein $R^{16}$ is the same as defined above).

The compound shown by formula (III) is preferred as a positive-working compound because it quickly releases a photographically useful group (PUG). The precise reason for this phenomenon has not yet been clarified but is considered to be that the X-Y bond is irreversibly cleaved when the electron-accepting moiety (EAG) accepts an electron from an electron-donating material, which accelerates the release of the photographically useful group.

$R^5$ represents an atomic group being bonded to Y and E and necessary for forming a 5-membered to 8-membered single or condensed ring, similar in this respect to $R^3$ and $R^4$ described above. $R^5$ need not be present in the case where y and E are directly bonded to each other to form a 5-membered ring seen in the compound shown by formula (IV)

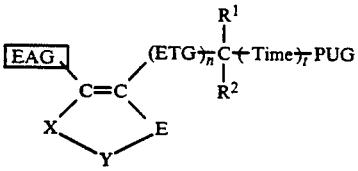

(IV)

wherein the symbols are all as defined above.

Preferred combinations of X-Y in the aforesaid formula include

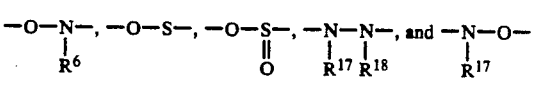

wherein $R^6$ represents a hydrogen atom, a hydrocarbon group, or a substituted hydrocarbon group having substituent(s) of which the total sum of the Hammett's substituent constant op values is less than +0.09; and $R^{17}$ and $R^{18}$ each represents a hydrogen atom or a substitutable group such as alkyl, aryl and heterrocyclic.

Among the compounds shown by formula (IV) described above, compounds exhibiting still better characteristics as positive working compounds include the compound shown by formula (V)

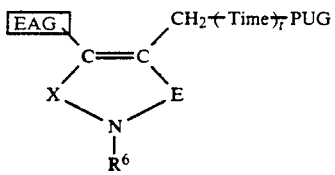

(V)

wherein EAG, Time, t, PUG, and E are as defined above and $R^6$ represents a hydrogen atom, a hydrocarbon group, or a substituted hydrocarbon group having substituent(s) of which the total sum of the Hammett's substituent constant op value is less than +0.09.

Examples of the hydrocarbon group and the substituted hydrocarbon group shown by $R^6$ are a substituted or unsubstituted alkyl group (e.g., methyl, ethyl, n-propyl, benzyl, allyl, n-dodecyl, n-pentadecyl, n-hexadecyl, n-octadecyl, sec-butyl, t-octyl, cyclohexyl, 2-hydroxyethyl, aminomethyl, and 2-(N,N-dimethylamino)ethyl), a substituted or unsubstituted aryl group (e.g., phenyl, naphthyl, 4 methylphenyl, 4-N,N-dimethylaminophenyl, 2,4-dimethylphenyl, and 4-hexadecanesulfonylaminophenyl), an alkenyl group (e.g., vinyl, 1-methylvinyl, and cyclohexen-1-yl), an alkynyl group (e.g., ethynyl and 1-propynyl), and a heterocyclic group (e.g., 2-furyl and morpholino).

—Time—PUG, present in each of the positive-working compounds of formula (I) above and the preferred compounds of formulae (II)-(V), is described below.

Time includes various timing groups as described, for example, in JP-A No. 61-147244, pages 5–6, JP-A No. 61-236549, pages 8–14, JP-A No. 62-215270, pages 25–45, and EP No. 220746A2, pages 10–22 and the groups described in aforesaid JP-A No. 62-215270 are preferred as Time in this invention.

In formulae (I) to (V) described above, PUG represents a releasable photographically useful group.

Examples of the photographically useful group are development inhibitors, development accelerators, nucleating agents, couplers, diffusible or non-diffusible dyes, desilvering accelerators, desilvering inhibitors, halides, silver halide solvents, redox competing compounds, developing agents, auxiliary developing agents, fix accelerators, fix inhibitors, silver image stabilizers, toning agents, processing reliance improving agents, dot improving agents, color image stabilizers, photographic dyes, surface active agents, hardening agents, desensitizers, contrast increasing agents, chelating agents, optical whitening agents, ultraviolet absorbents, nucleation accelerators, film thickness improving agents, and the precursors thereof.

These photographically useful groups are frequently overlapped with each other in their conventional descriptions, and typical examples thereof are explained below.

Examples of the development inhibitor as PUG in this invention are a halogen (bromine, iodine, etc.) compounds having a mercapto group bonded to a heterocyclic ring, such as substituted or unsubstituted mercaptoazoles (e.g., 1-phenyl-5-mercaptotetrazole, 1-(4-carboxyphenyl)-5-mercaptotetrazole, 1-(3-hydroxyphenyl)-5-mercaptotetrazole, 1-(4-sulfophenyl)-5-mercaptotetrazole, 1-(3-sulfophenyl)-5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxy-ethylthio)-5-mercapto-1,3,4-thiadiazole, 3-methyl-4-phenyl-5-mercapto-1,2,4-triazole, 2-(2-dimethylaminoethylthio)-5-mercapto-1,3,4-thiadiazole, 1-(4-n-hexylcarbamoyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-[3-(3-methylureido)-phenyl]5-mercapto-tetrazole, 1 (4-nitrophenyl)-5-mercaptotetrazol e, a nd 5- (2-ethylhexanoylamino)-2-mercaptoimidazole), substituted or unsubstituted mercaptoazaindenes (e.g., 6-methyl-4-mercapto- 1,3,3a,7-tetraazaindene, 6-methyl-2-benzyl-4-mercapto-1,3,3a,7-tetraazaindene, 6-phenyl-4-mercaptotetraazaindene, and 4,6-dimethyl 2 mercapto-1,3,3a,7-tetraazaindene), and substituted or unsubstituted mercaptopyrimidines (e.g., 2-mercaptopyrimidine, 2-mercapto-4 methyl-6-hydroxypyrimidine, and 2-mercapto-4-propylpyrimidine).

Examples of the imino silver formable heterocyclic compounds for use as PUG in this invention are substituted or unsubstituted benzotriazoles (e.g., benzotriazole, 5-nitrobenzotriazole, 5-methylbenzotriazole, 5,6-dichlorobenzotriazole, 5-bromobenzotriazole, 5-methoxy-benzotriazole, 5-acetylaminobenzotriazole, 5-n-butylbenzo-triazole, 5-nitro-6-chlorobenzotriazole, 5,6-dimethylbenzotriazole, and 4,5,6,7-tetrachlorobenzotriazole), substituted or unsubstituted indazoles (e.g., indazole, 5-nitroindazole, 3-nitroindazole, 5-chloro-5-nitroindazole, 3-cyanoindazole, 3-n-butylcarbamoylindazole, and 5-nitro-3-methanesulfonylindazole), and substituted or unsubstituted benzimidazoles (e.g., 5-nitrobenzimidazole, 4-nitrobenzimidazole, 5,6-dichlorobenzimidazole, 5-cyano-6-chlorobenzimidazole, and 5-trifluoromethyl-6-chlorobenzimidazole).

The development inhibitor as PUG may be a compound which becomes a compound having a development inhibiting property after being released from the oxidation-reduction mother nucleus of formula (I) (i.e.,

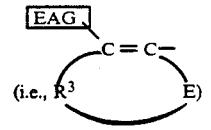

) upon a reaction subsequent to the oxidation reduction during photographic processing, and further, may be converted into a compound having substantially no development inhibiting property or having greatly reduced development inhibiting property.

When PUG is a diffusible or non diffusible dye, examples of the dye are azo dyes, azomethine dyes, azopyrazolone dyes, indoaniline dyes, indophenol dyes, anthraquinone dyes, triarylmethane dyes, alizarin dyes, nitro dyes, quinoline dyes, indigo dyes, and phthalocyanine dyes. Also, leuco compounds of the aforesaid dyes, dyes the absorption wavelength of which is temporarily shifted, and dye precursors such as tetrazolium salts are useful as PUG. Furthermore, the dyes may form chelate dyes with a proper metal.

Among the dyes shown by PUG, cyan dyes, magenta dyes, and yellow dyes are particularly important.

Specific examples of suitable yellow dyes are described in U.S. Pat. Nos. 3,597,200, 3,309,199, 4,013,633, 4,245,028, 4,156,609, 4,139,383, 4,195,992, 4,148,641, 4,148,643, and 4,336,322, JP-A Nos. 51-114930 and 56-71072, *Research Disclosure*, No. 17630 (December, 1978) and ibid., No. 16475 (December, 1977).

Specific examples of suitable magenta dyes are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, 4,287,292, JP-A Nos. 52-06727, 53-23628, 55-36804, 56-6-71060, and 55-134.

Specific examples of suitable cyan dyes are described in U.S. Pat. Nos. 3,482,972, 3,929,760, 4,013,635, 4,268,625, 4,171,220, 4,242,435, 4,142,891, 4,195,994, 4,147,544, 4,148,642, British Patent No. 1,551,138, JP-A Nos. 54-99431, 52-8827, 53-47823, 53-143323, 54-99431, and 56-71061, European Patents (EPC) Nos. 3,037 and 53,040, *Research Disclosure*, No. 17640 (December, 1978), and ibid., No. 16475 (December, 1977).

Also, specific examples of a dye precursor, i.e., a dye the light-absorption wavelength of which is temporarily shifted in a photographic light-sensitive material are described in U.S. Pat. Nos. 4,310,612, 3,336,287, 3,579,334, and 3,982,946, British Patent No. 1,467,317, and JP-A No. 57-158638.

Examples of suitable silver halide solvents shown by PUG are mesoion compounds described in JP-A-60-163042, U.S. Pat. Nos. 4,003,910 and 4,378,424 and mercaptoazoles or azolethions having an amino group as a substituent described in JP-A No. 57-202531. More specific examples thereof are described in JP-A No. 61-230135.

Examples of suitable nucleating agents shown by PUG are the releasable moiety being released from a coupler described in JP-A No. 59-170840.

Other examples of suitable photographically useful groups shown by PUG are described in JP-A Nos. 61-230135 and 62-215272 and U.S. Pat. No. 4,248,962.

Specific examples of the compound of formula (I) for use in this invention are illustrated below, but the invention is not limited to these compounds.

1.

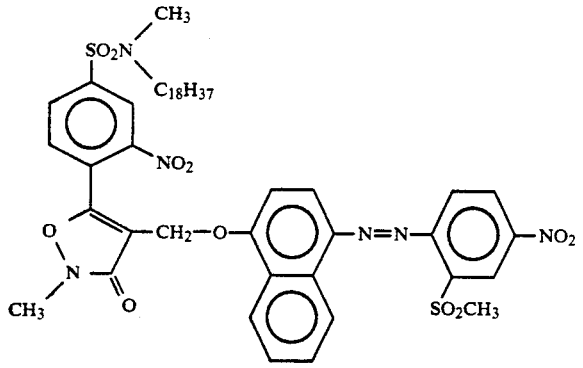

2.

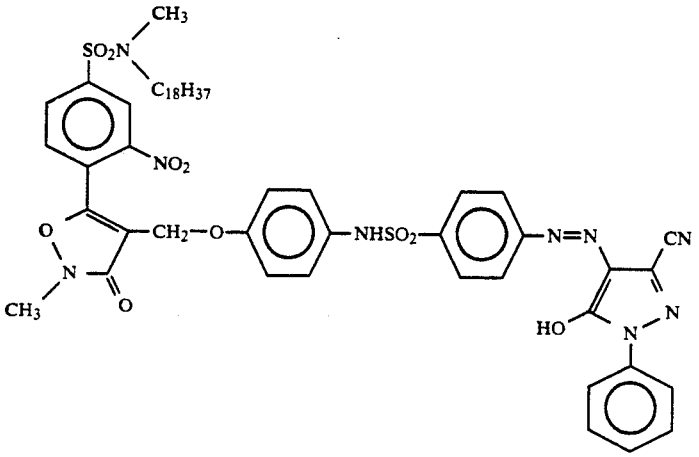

-continued
3.
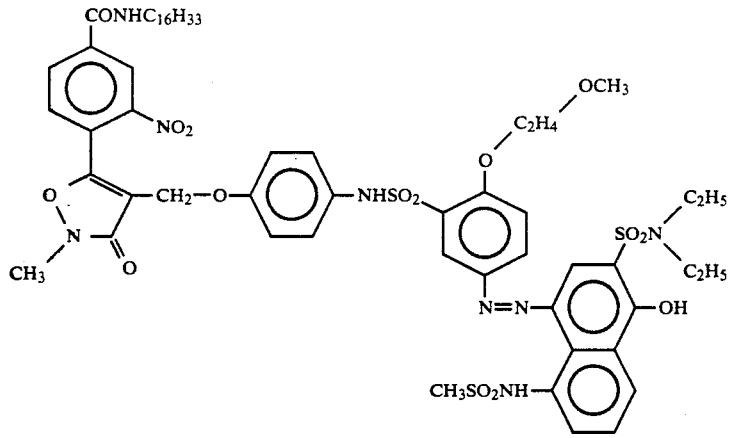
4.
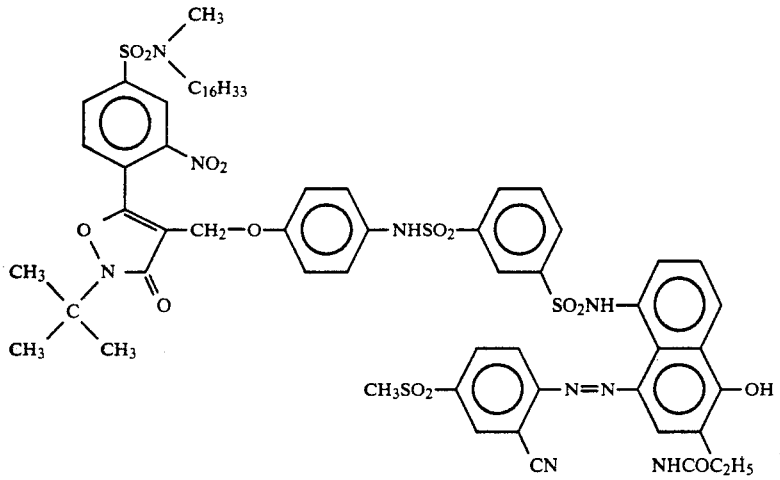
5.
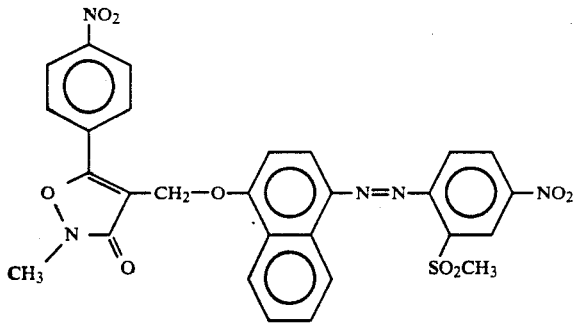
6.
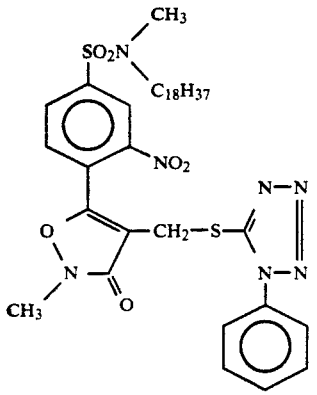

-continued
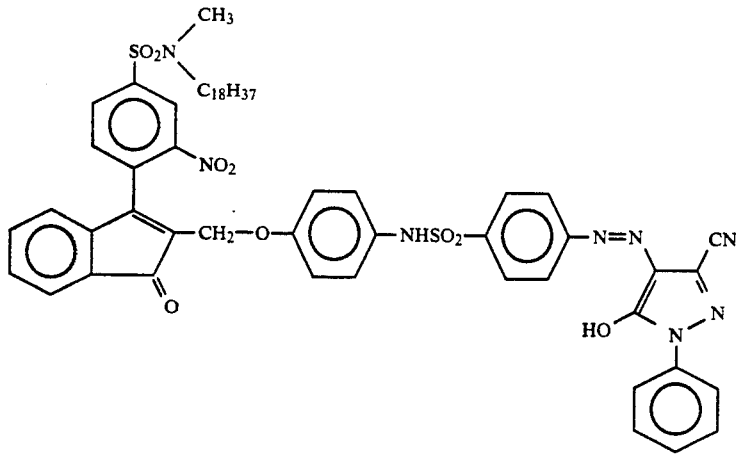
7.
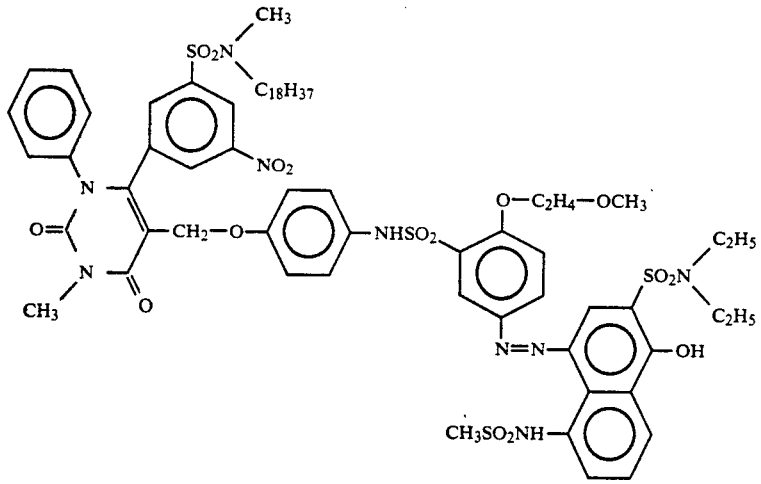
8.
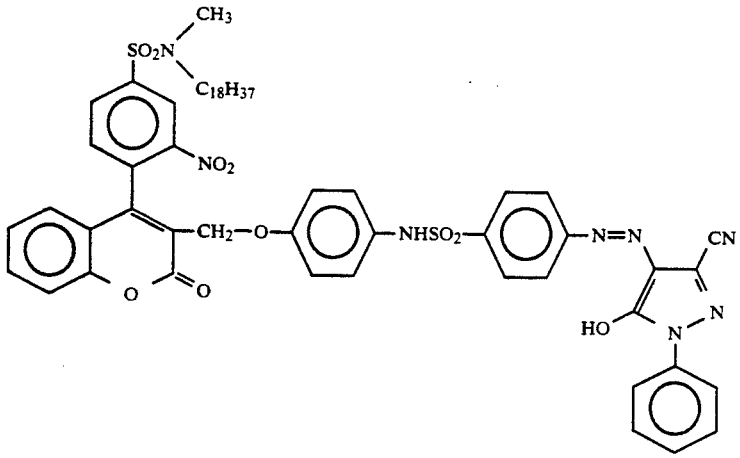
9.

-continued
10.
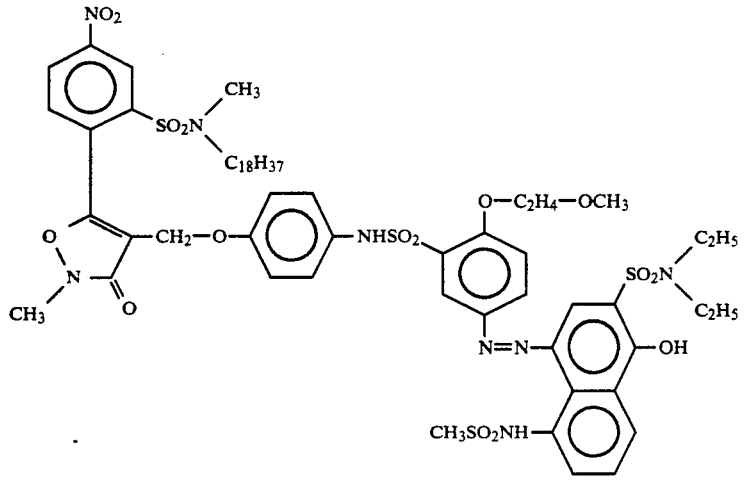
11.
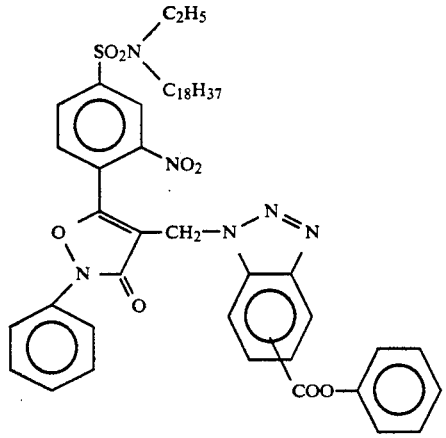
12.
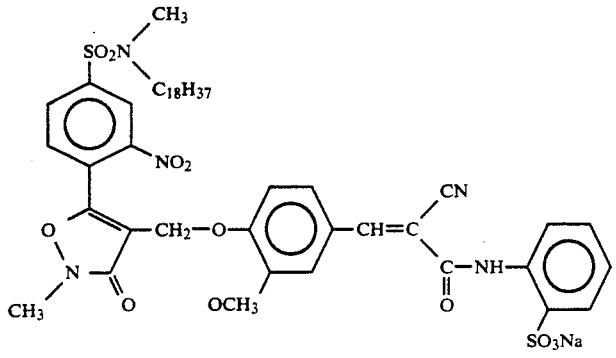

-continued
13.
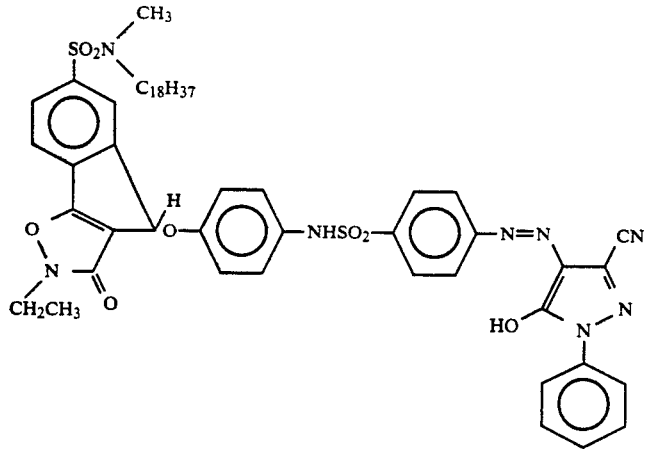
14.
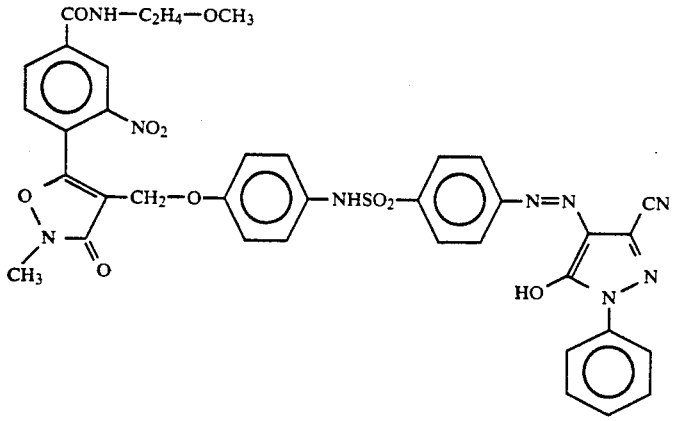
15.
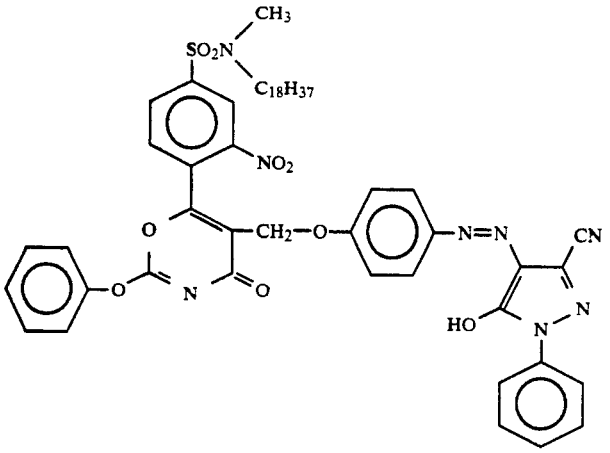

-continued
16.
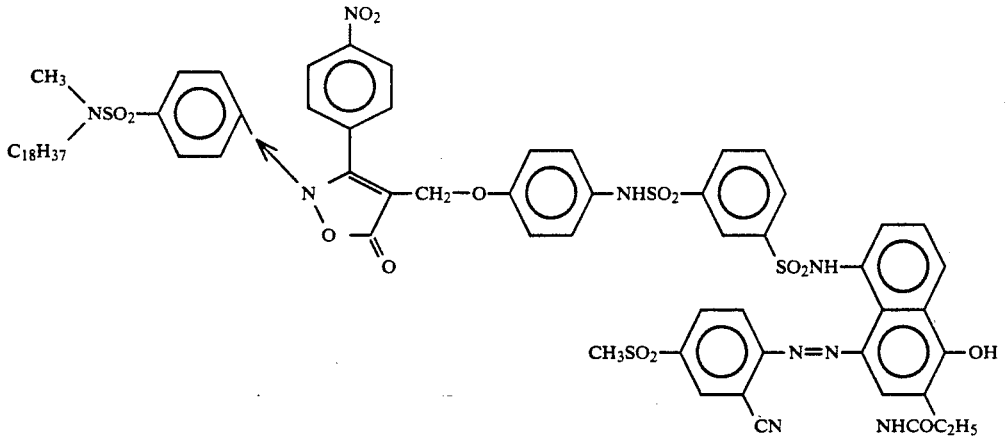
17.
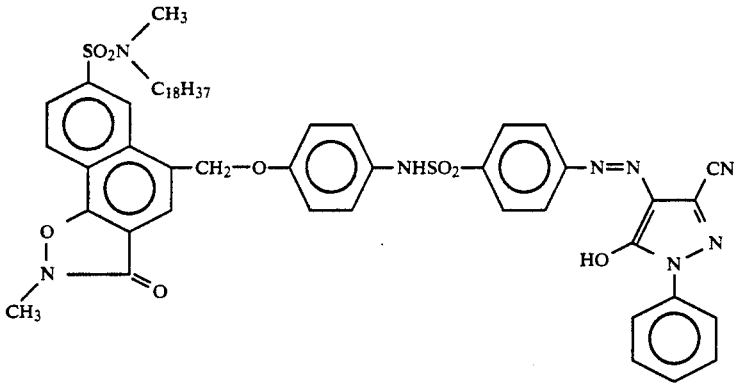
18.
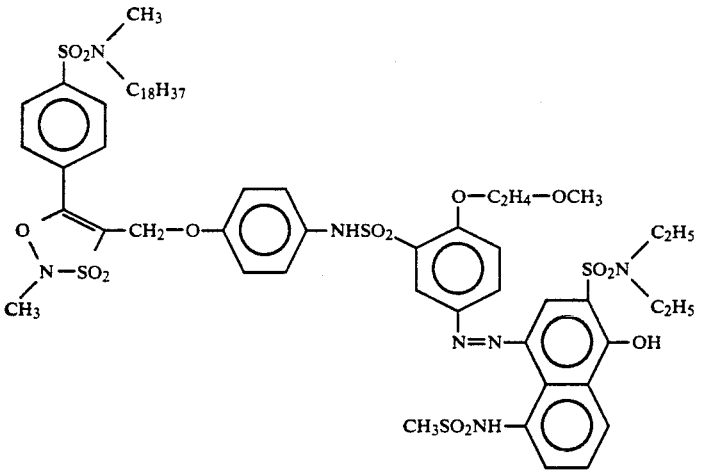
19.
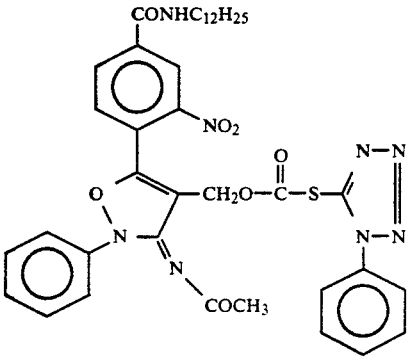

-continued
20.
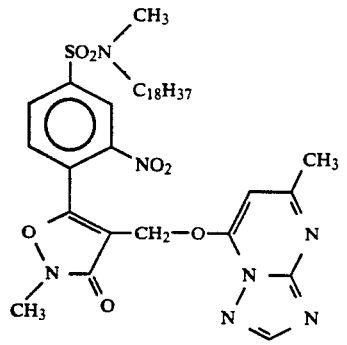
21.
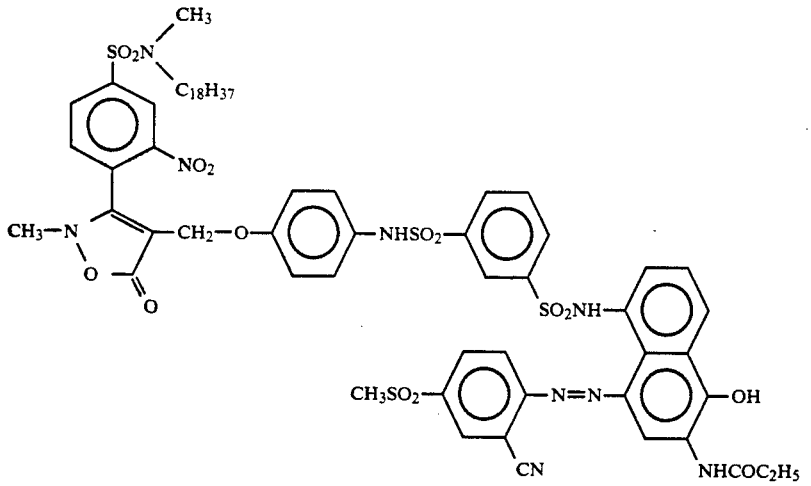
22.
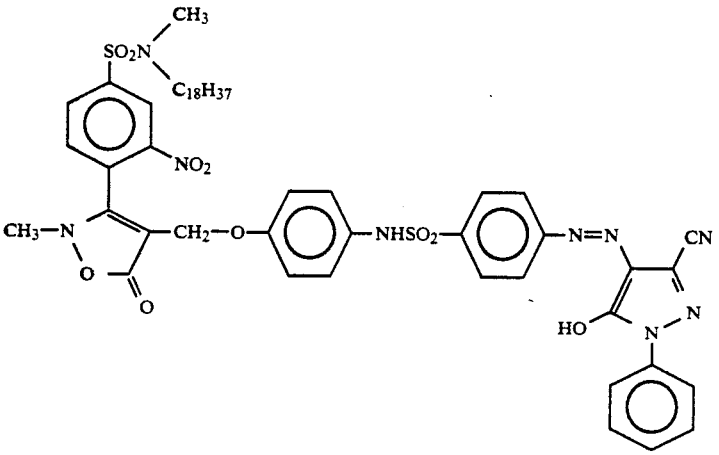

-continued
23.
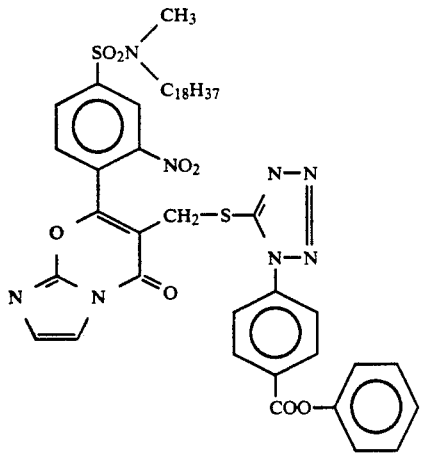
24.
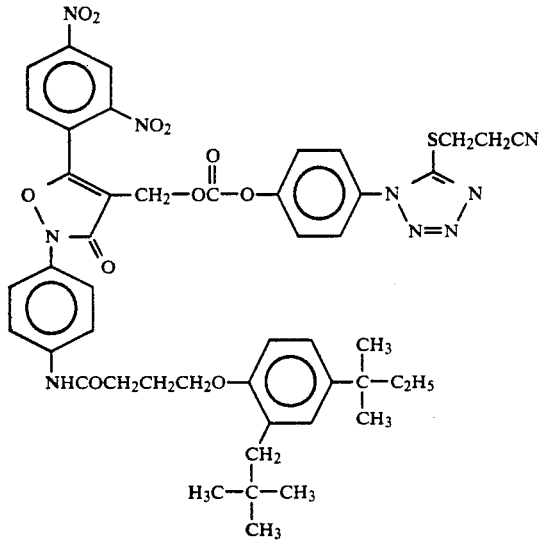
25.
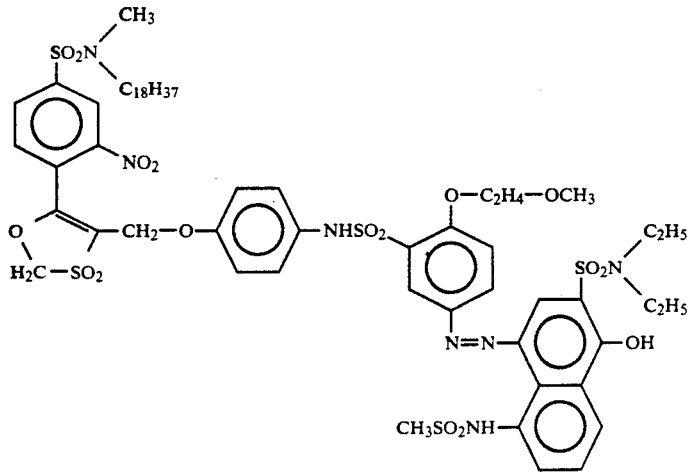

-continued
26.
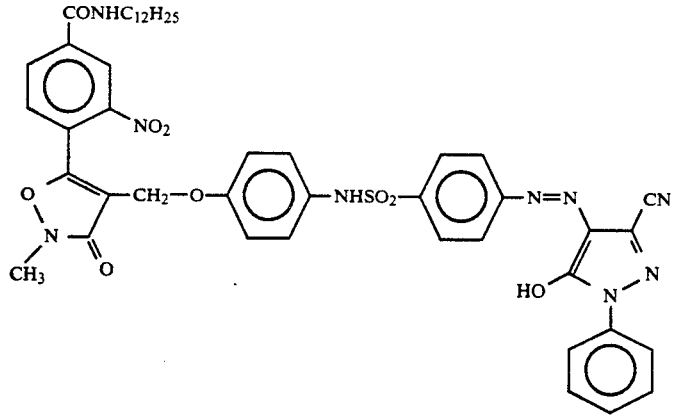
27.
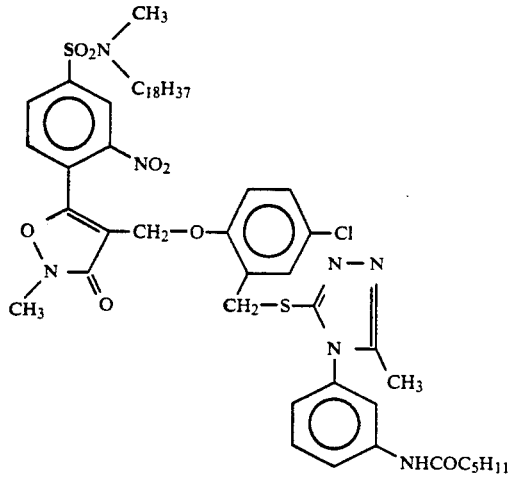
28.
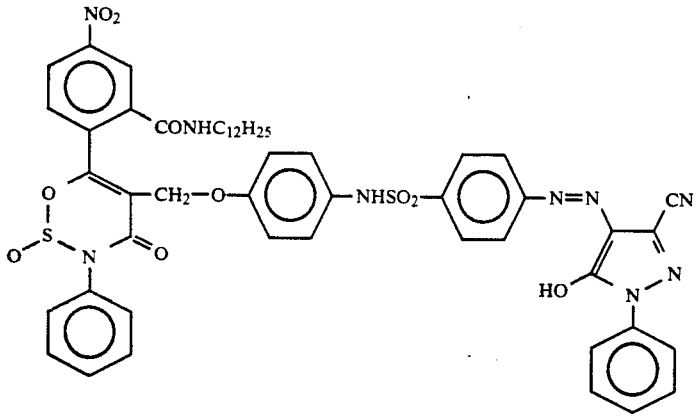
29.
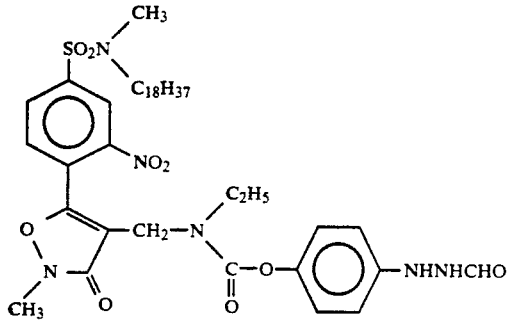

-continued
30.
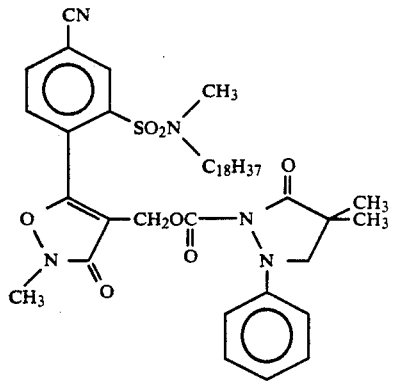
31.
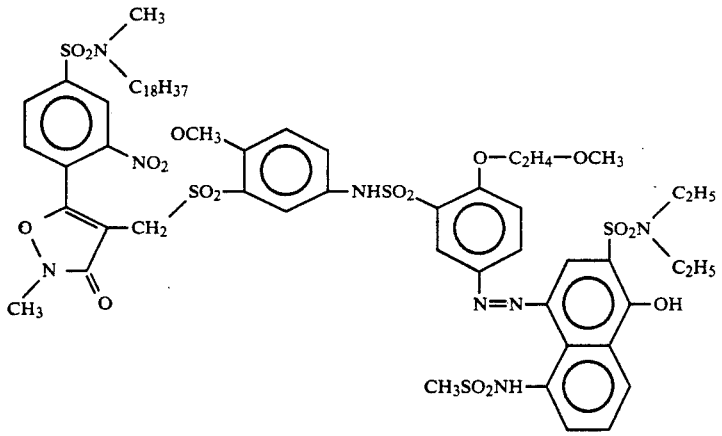
32.
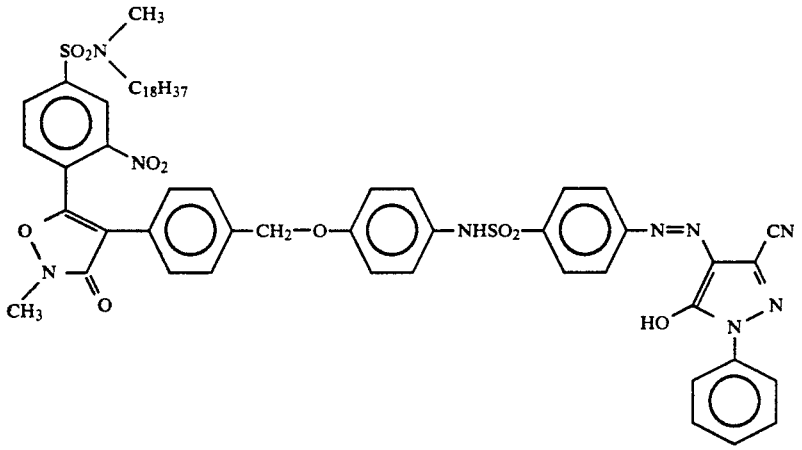

-continued
33.
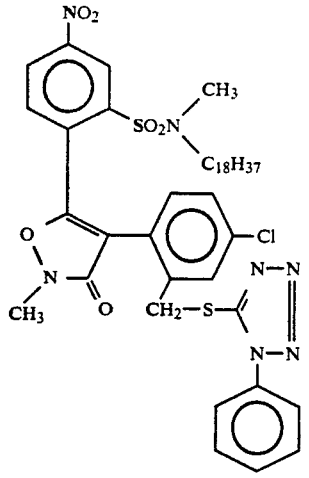
34.
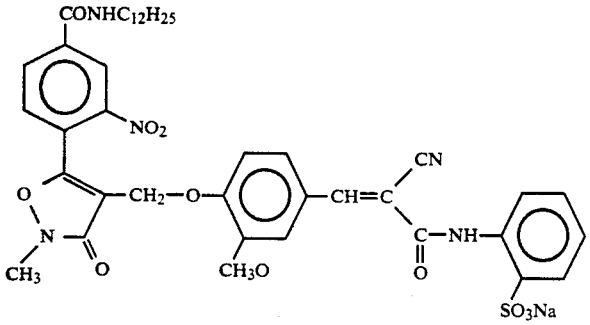
35.
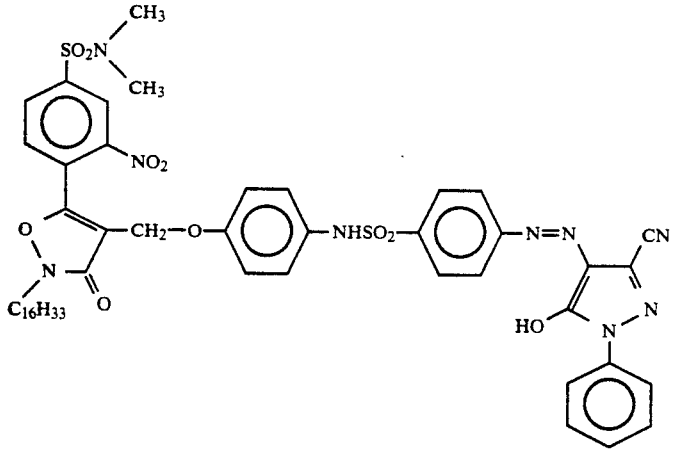
36.
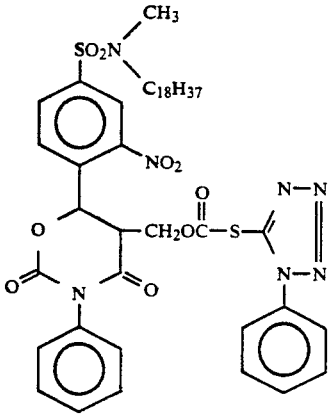

-continued
37.
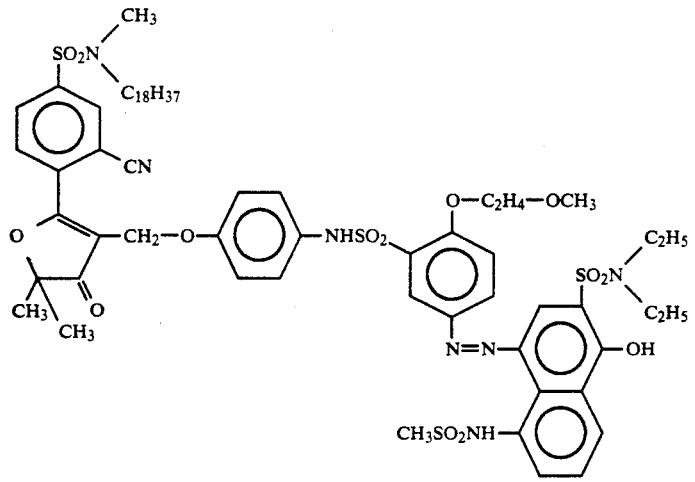
38.
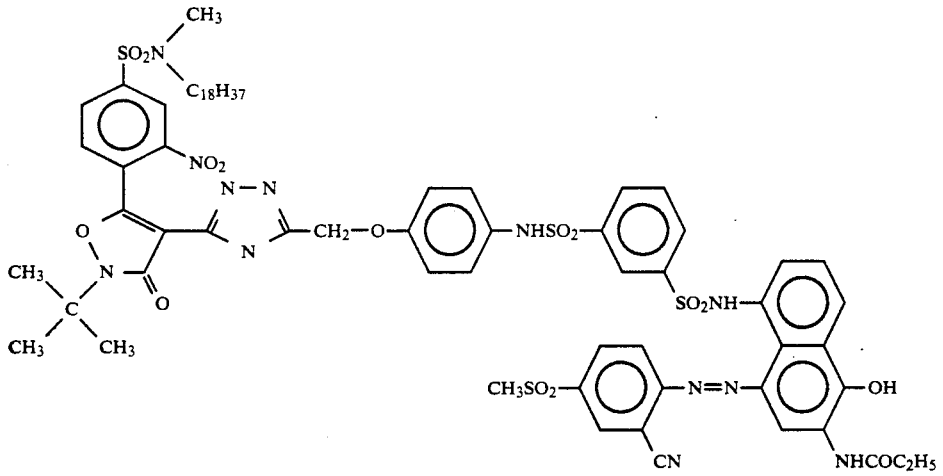
39.
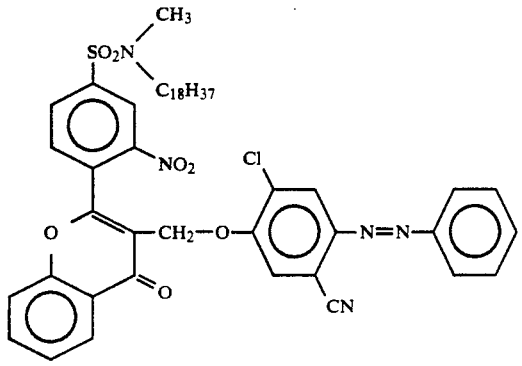

-continued
40.
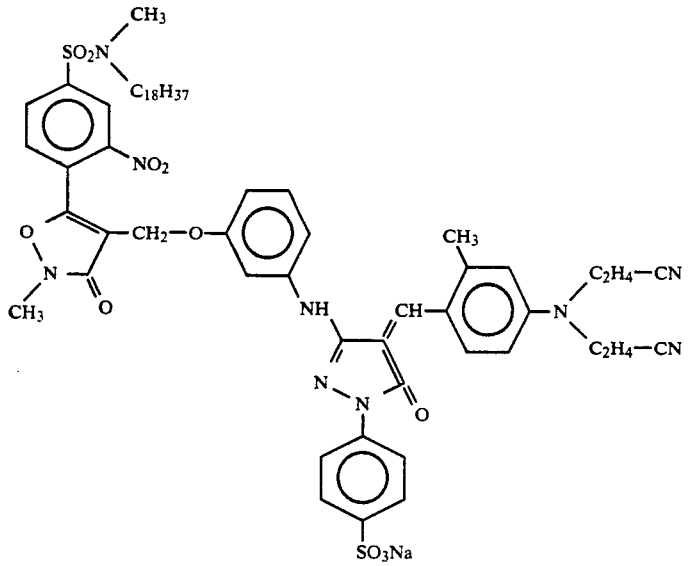
41.
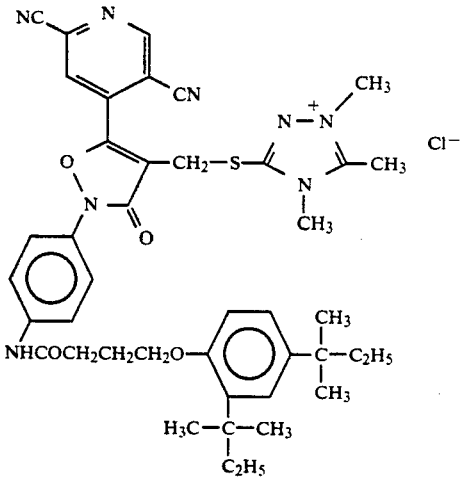
42.
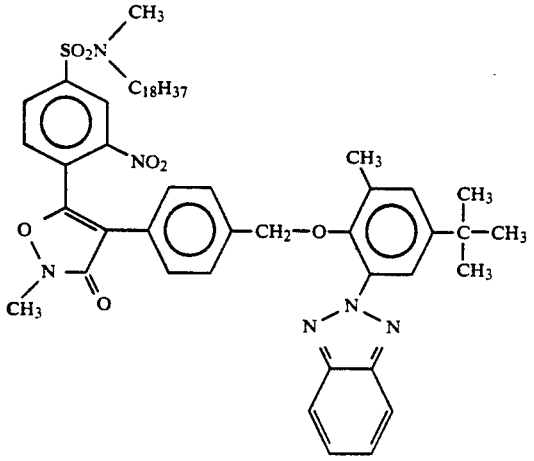

-continued
43.
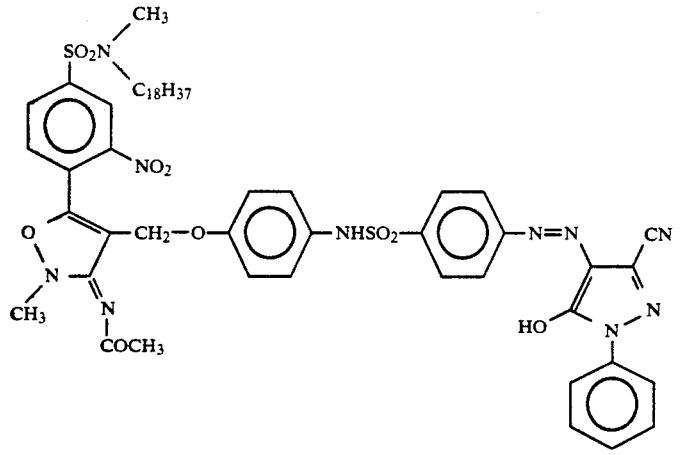
44.
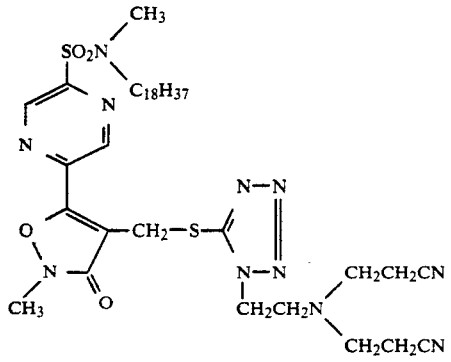
45.
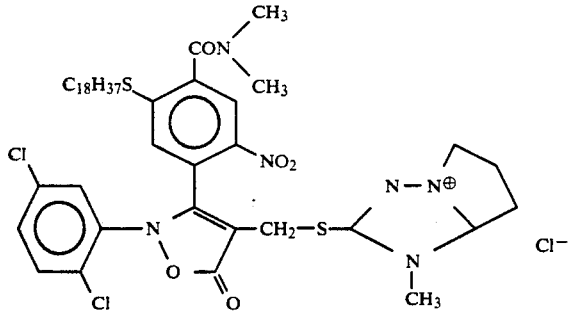
46.
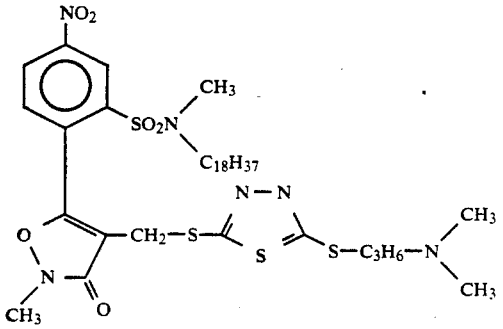

-continued
47.
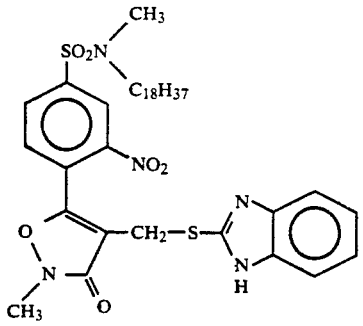
48.
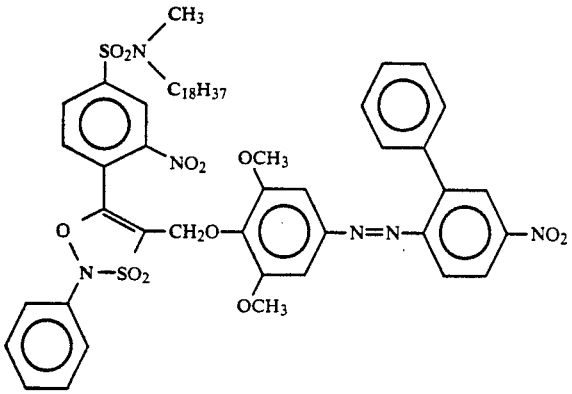
49.
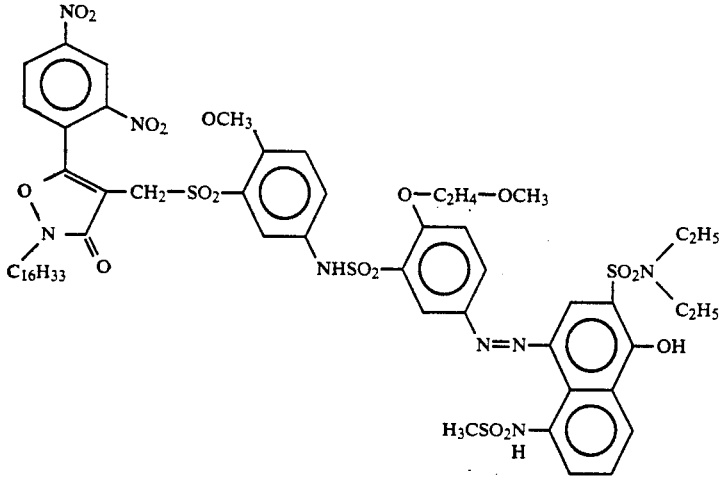
50.
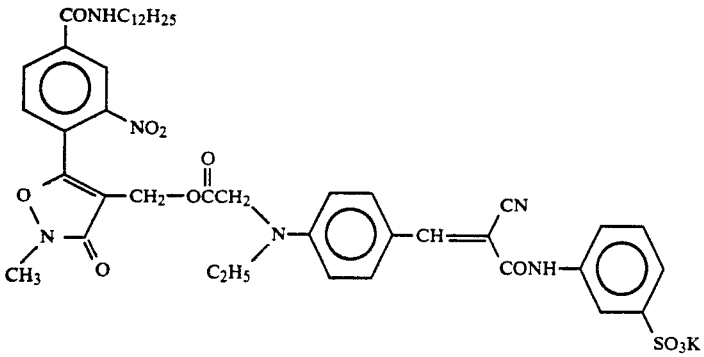

-continued
51.
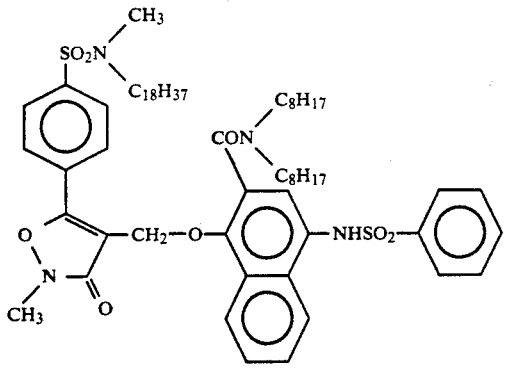
52.
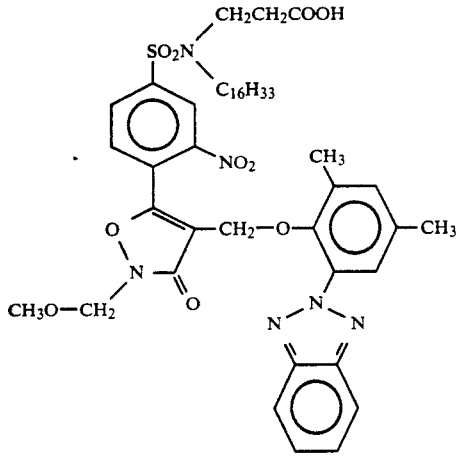
53.
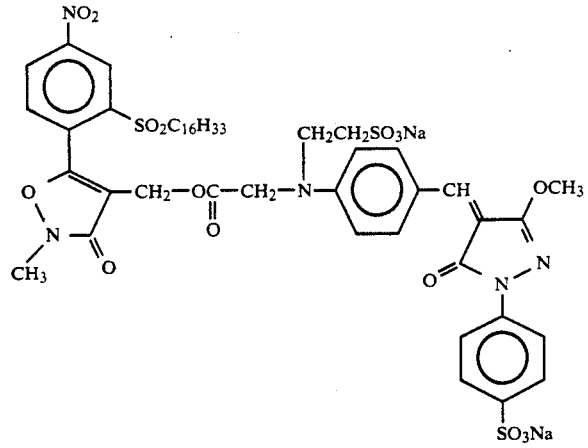
54.
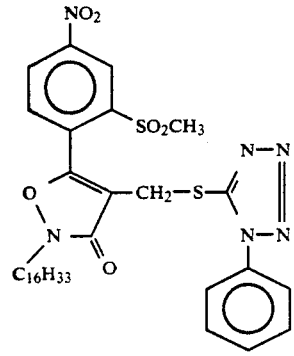

-continued
55.
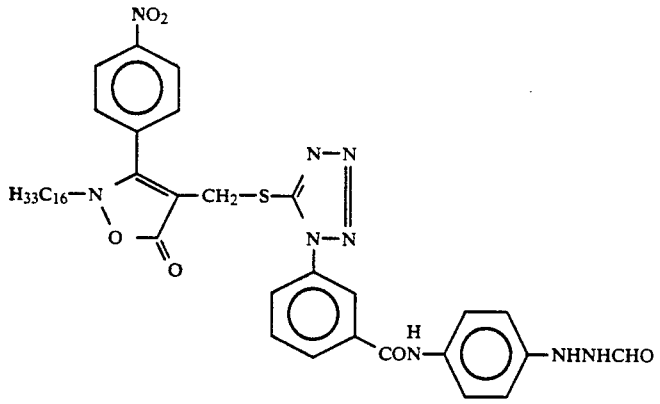
56.
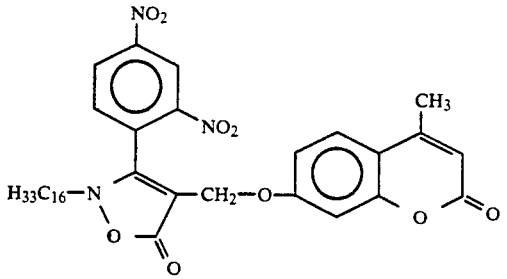
57.
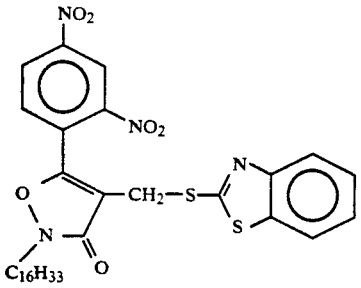
58.
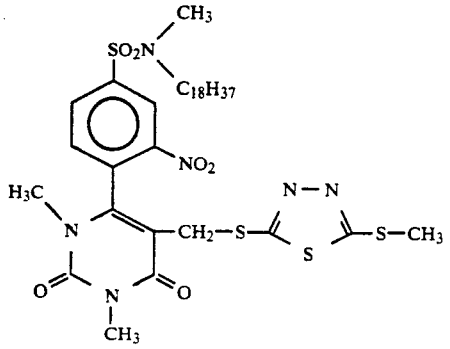

-continued
59.
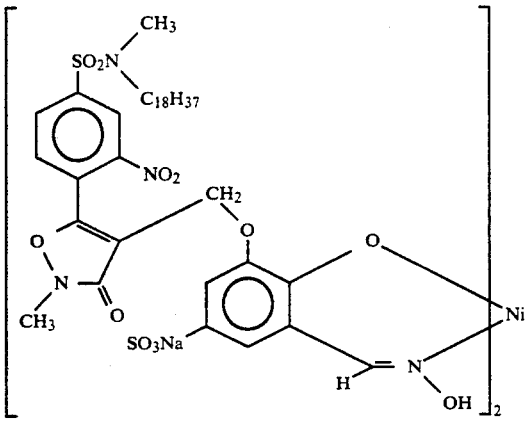
60.
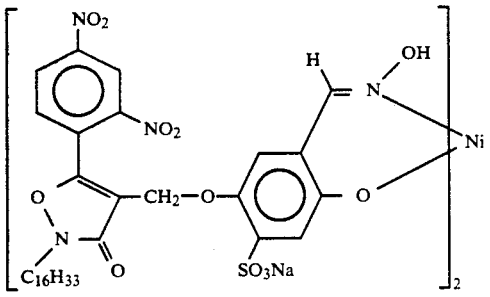
61.
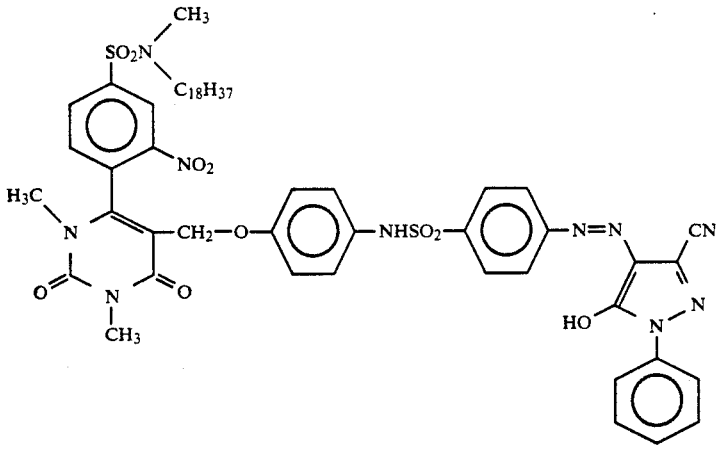
62.
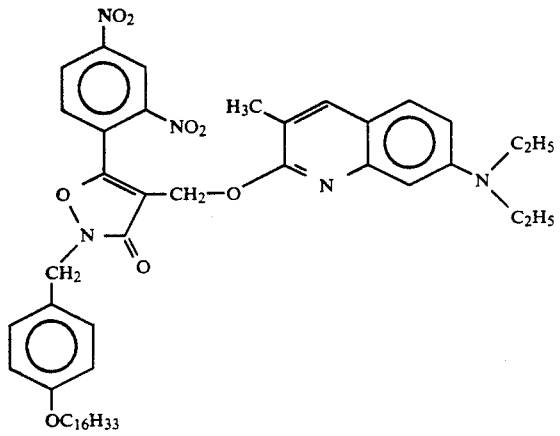

-continued
63.
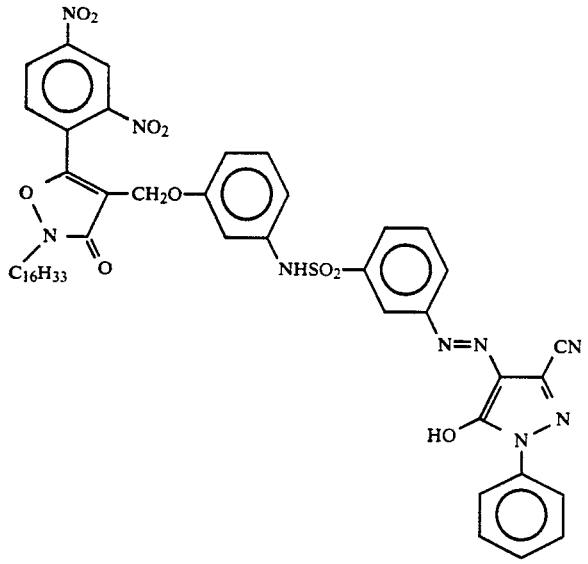
64.
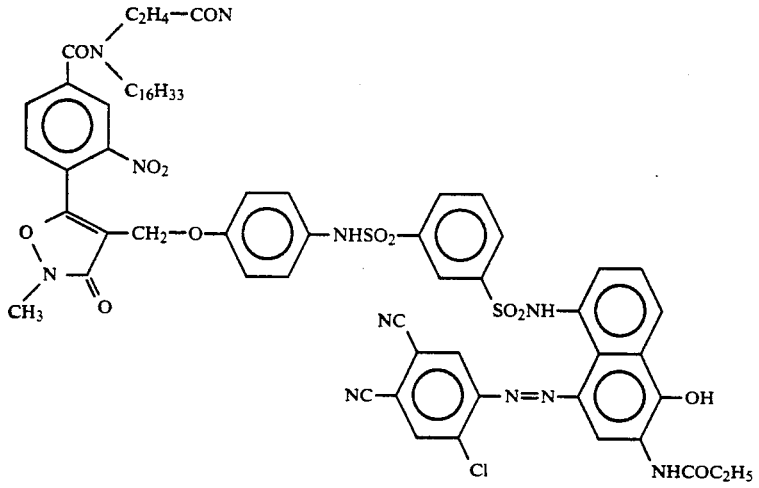
65.
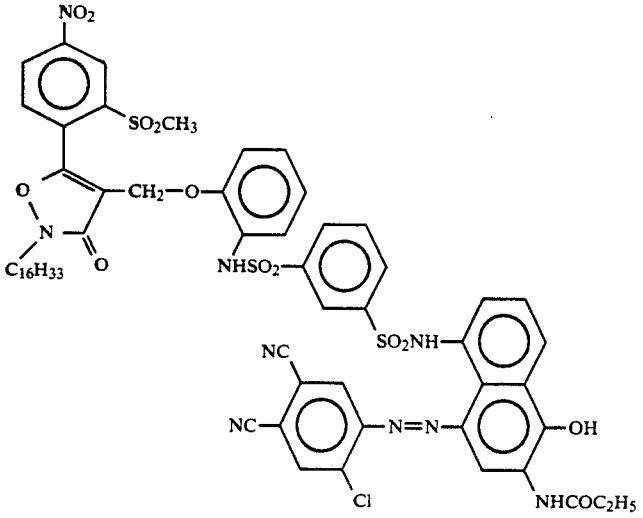

-continued
66.
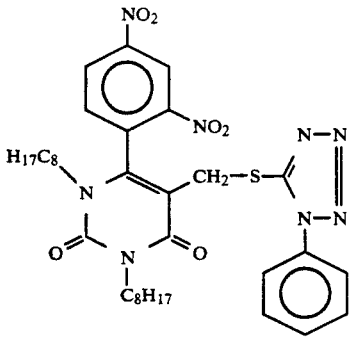
67.
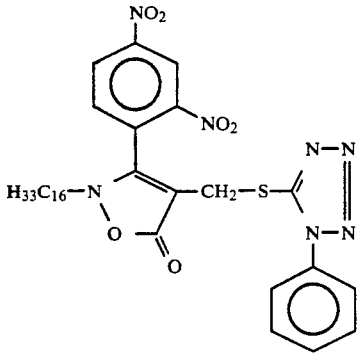
68.
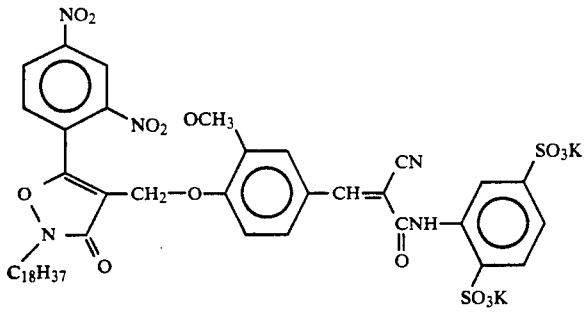
69.
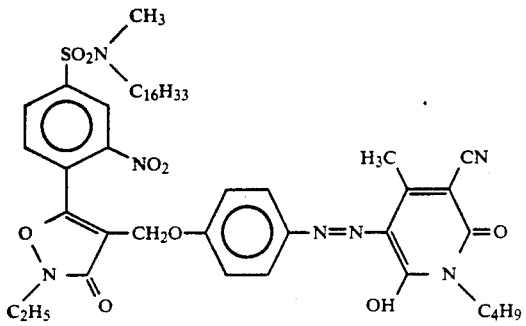

-continued

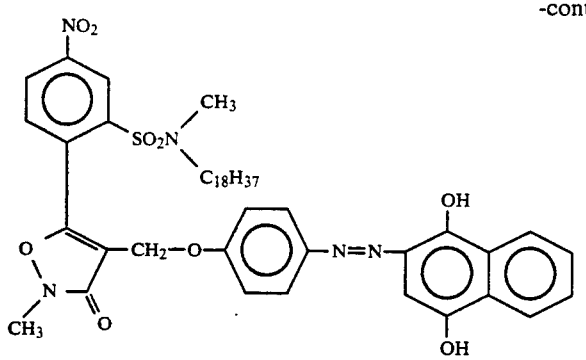

The aforesaid compounds of formula (I) can be synthesized by various methods. Few examples thereof are shown below.

Synthesis Example 1

Synthesis of Compound 5

Step 1

Synthesis of 2 Methyl-5-phenyl-3-isooxazolone

To 60 g of 5-phenyl-3-isooxazolone was added 150 ml of methyl p-toluenesulfonate and the mixture obtained wa stirred for 3 hours at 80° C. The reaction mixture was allowed to cool, and after gradually adding thereto 30 ml of an aqueous 10% sodium hydroxide solution and 50 ml of an aqueous 30% ammonia solution under cooling, the resultant mixture was stirred for one hour at room temperature. Then, 500 ml of water was further added thereto and the mixture was stirred for a few hours at room temperature to deposit crystals, which were collected by filtration and dried to provide 30 g of the desired compound. The yield was 46%.

Step 2

Synthesis of 2-Methyl-4-chloromethyl-5-phenyl-3-isooxazolone

To 10 g of 2-methyl-5-phenyl-3-isooxazolone was added 50 ml of glacial acetic acid and after further adding thereto 10 g of para-formaldehyde and 5 g of zinc chloride, hydrogen chloride gas was blown into the mixture with vigorous stirring.

The temperature of the mixture was gradually increased to 80° C. and after adding thereto 5 g of zinc chloride and 1 ml of concentrated sulfuric acid at that temperature, the resultant mixture was stirred for 2 hours. The reaction mixture obtained was poured into ice water and crystals thus deposited were collected by filtrated and dried to provide 11.5 g of the desired product. The yield was 90%.

Step 3

Synthesis of 2-Methyl-4-chloromethyl-5-(4-nitrophenyl)-3-isooxazolone

After cooling 76 ml of concentrated nitric acid (specific gravity 1.42) to 0° C., 80 ml of concentrated sulfuric acid was gradually added thereto and further 9 g of 2-methyl-4 chloromethyl-5-phenyl-3-isooxazolone was added thereto as crystals thereof while keeping the temperature thereof below 5° C. The resultant mixture was stirred for 30 minutes at 5° C. and poured into 2 liters of ice water followed by stirring for one hour to deposit crystals, which were collected by filtration and dried to provide 9.4 g of the desired product. Th- yield was 87%.

Step 4

Synthesis of Compound 5

To a mixture of 3 g of 2-methyl-4-chloro-5-(4-nitrophenyl)-3-isooxazolone, 4.6 g of dye A* (shown below), 2.3 g of potassium carbonate, and 100 mg of sodium iodide was added 30 ml of acetone followed by refluxing for 2 hours.

Dye A*:

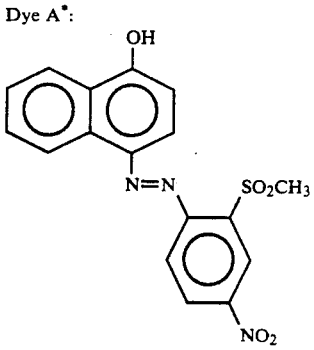

After allowing the mixture to cool and filtering off inorganic matters, acetone was distilled off under a reduced pressure and methanol was added thereto to form crystals. The crystals were collected, recrystallized several times from methanol, and finally recrystallized from a mixed solvent of dimethylformamide and methanol (1:5) to provide 2 g of the crystals of Compound 5 having a melting point of from 208° C to 210° C. The yield was 30%.

Compound 5 is identified by the following N.M.R. data.

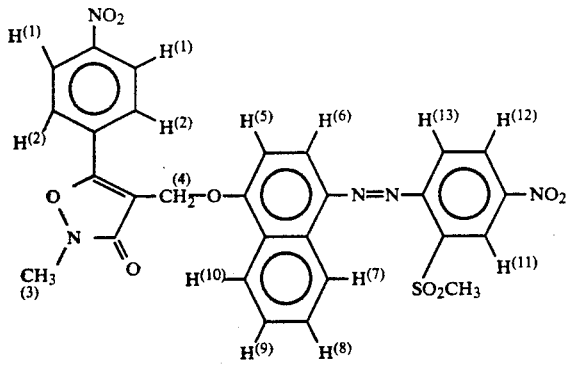

| H | δ chemical shift (ppm) | Proton number | Multiplet | |
|---|---|---|---|---|
| 1 | 8.37 | 2H | d | AA'BB' |
| 2 | 8.10 | 2H | d | |
| 3 | 3.75 | 3H | s | |
| 4 | 5.35 | 2H | s | |
| 5 | 7.38 | 1H | d | |
| 6 | 8.07 | 1H | d | |
| 7 | 8.97 | 1H | d | |
| 8 | 7.75 | 1H | dd | |
| 9 | 7.60 | 1H | dd | |
| 10 | 8.25 | 1H | d | |
| 11 | 9.10 | 1H | d | |
| 12 | 8.59 | 1H | dd | |
| 13 | 8.10 | 1H | d | |

Solvent used for measurement: $CHCl_3$ *Id*
Apparatus used for measurement:
WM400 400 MHz NMR (made by Brucker Co., Ltd.)

Synthesis Example 2

Synthesis of Compound 2

Step 1

Synthesis of 5-(4-N-methy-N-octadecylsulfamoyl-phenyl)-2-methyl-3-isooxazolone

In 800 ml of chloroform was dissolved 110 g of 5-phenyl-2-methyl-3-isooxazolone and after adding dropwise 93 g of chlorosulfonic acid to the solution under ice-cooling, the mixture was stirred for one hour at room temperature. After the reaction was over, the reaction mixture obtained was poured into ice water and 500 ml of chloroform was added thereto. An organic layer formed was separated and the solvent was distilled off under reduced pressure. The crude reaction product thus formed was dissolved in 500 ml of chloroform and after adding thereto 65 g of triethylamine, the temperature thereof was controlled to 5° C. Then, a chloroform solution of 184 g of N-methyloctadecylamine was added dropwise to the solution. After the reaction was over, water was added to the reaction mixture and after separating an organic layer formed, the organic layer was purified by silica gel column chromatography to provide 39 g of the desired product. The yield was 12%.

Step 2

Synthesis of 5-(4-N-methyl-N-octadecylsulfamoyl-2-nitrophencyl)-2-methyl-3-isooxazolone After cooling 50 ml of concentrated nitric acid (specific gravity 1.42) to 0° C., 55 ml of concentrated sulfuric acid was gradually added thereto and then 10 g of 5-(4-N-methyl-N-octadecylsulfamoylphenyl)-2-methyl-3-isooxazolone was gradually added to the solution as crystals thereof at temperature below 5° C.

Then, after stirring the mixture for 30 minutes at 5° C., the temperature thereof was raised to 40° C. followed by stirring for 30 minutes, 2 liters of ice water was poured into the mixture. Crystals deposited were collected by filtration, subjected to silica gel column chromatography, and the desired product was obtained from the fraction of a mixture of hexane and ethyl acetate (1:1). The amount of the product was 2.8 g and the yield thereof was 25.8%.

Step 3

Synthesis of
5-(4-N-methyl-N-octadecylsulfamoyl-2-nitrophenyl)-2-methyl-4-chloromethyl-3-isooxazolone To 10 g of 5-(4-N-methyl-N-octadecylsulfamoyl-2-nitro-phenyl)-2-methyl-3-isooxazolone was added 10 ml of glacial acetic acid and after further adding thereto 8 g of para-formaldehyde and 4 g of zinc chloride, a hydrogen chloride gas was blown into the mixture with vigorous stirring at room temperature. The temperature thereof was gradually raised to 80° C. and 5 g of zinc chloride and 0.5 ml of concentrated sulfuric acid were added thereto followed by stirring for 2 hours while blowing a hydrogen chloride gas into the mixture during stirring. The reaction mixture formed was poured into ice water and crystals thus deposited were collected by filtration and purified by column chromatography to provide 6.9 g of the desired product. The yield was 63.5%.

Step 4

Synthesis of
4-(4-t-butoxycarbonylaminophenoxy)methyl-5-(4-N-methyl-N-octadecylsulfamoyl-2-nitrophenyl)-2-methyl-3-isooxazolone A mixture of 8.2 g of 4-chloromethyl-5-(4-N-methyl-N-octadecylsulfamoyl-2-nitrophenyl)-2-methyl-3-isooxazolone, 3.2 g of 4-t-butoxycarbonylaminophenol, 3.0 g of potassium carbonate, 0.5 g of sodium iodide, and 100 ml of acetone was refluxed for 5 hours. After the reaction was over, acetone was distilled off and the product was extracted with the addition of a mixture of ethyl acetate and water. The organic layer formed was separated and concentrated, and the residue obtained was purified by silica gel column chromatography to provide 7.2 g of the desired product. The yield wa 68.2%.

Step 5

Synthesis of
4-(4-aminophenoxy)methyl-5-(4-N-methyl-N-octadecylsulfamoyl-2-nitrophenyl)-2-methyl-3-isooxazolone In chloroform was dissolved 7.2 g of 4-(4-t-butoxycarbonylaminophenoxy)methyl-5-(4-N-methyl-N-octadecylsulfamoyl-2 nitrophenyl)-2-methyl-3-isooxazolone and after cooling the solution below 5° C., 10 ml of trifluoroacetic acid was gradually added dropwise to the solution. After the reaction was over, the reaction mixture obtained was poured into an aqueous sodium hydrogencarbonate solution for neutralization and then extracted with ethyl acetate. The extract obtained was purified by silica gel flash column chromatography to provide 5.6 g of the desired product. The yield was 89.1%.

Step 6

Synthesis of Compound 2

In 40 ml of dimethylacetamide was dissolved 5.2 g of 4-(4-aminophenoxy)methyl 5-(4-N-methyl-N-octadecylsulfamoyl-2-nitrophenyl)-2-methyl-3-isooxazolone and the solution was cooled to 0° C. Then, after adding thereto 0.8 g of pyridine, 3.0 g of Compound A* (shown below) was added to the mixture followed by allowing a reaction to take place for 2 hours.

After the reaction was over, methanol was added to the reaction mixture to an extent of not depositing oily matters followed by stirring to deposit crystals. The crystals were collected by filtration and recrystallized from a mixed solvent of acetone and methanol (1:3) to provide 3.0 g of the desired product having a melting point of from 138° C. to 140° C. The yield was 38.2%.

Compound A*:

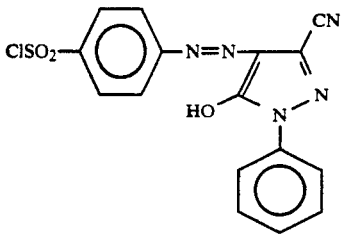

The compound of formula (I) for use in this invention may be present in a light-sensitive silver halide emulsion layer or other layer(s) (e.g., protective layer, interlayer, filter layer, antihalation layer, image-receiving layer, etc.) Also, two kinds of the compound of formula (I) wherein each PUG is a different photographically useful group may be present in the photographic material. For example, when a compound wherein PUG is a diffusible dye and a compound wherein PUG is a development inhibitor are used, transferred dye images having a good S/N ratio are obtained.

The compound of formula (I) can be used in an amount over a wide range. The preferred amount thereof depends upon the type of PUG employed. For example, when PUG is a diffusible dye, the compound is preferably used in the range of from about 0.05 mmol/m$^2$ to about 50 mmol/m$^2$, preferably from about 0.1 mmol/m$^2$ to about 5 mmols/m$^2$ although the optimum amount differs according to the extinction coefficient of the dye. When PUG is a development inhibitor, the compound is preferably used in the range of from about $1\times10^{-7}$ mol to about $1\times10^{-1}$ mol, and more preferably from about $1\times10^{-3}$ mol to about $1\times10^{-2}$ mol per mol of silver halide in the layer in which the compound of formula (I) is contained. Also, when PUG is a development accelerator or a nucleating agent, the compound is preferably used in the amount as described above for the compound having a development inhibitor as PUG. When PUG is a silver halide solvent, the compound is preferably used in the range of from about $1\times10^{-5}$ mol to about $1\times10^{3}$ mols, and more preferably from about $1\times10^{-4}$ mol to about $1\times10^{1}$ mol per mol of silver halide in the layer in which the compound of formula (I) is contained.

The compound of formula (I) for use in this invention releases a photographically useful group or a precursor thereof (PUG) by accepting an electron from a reducing material. Accordingly, if a reducing material uniformly reacts with the aforesaid compound, the photographically useful group or the precursor thereof can be uniformly released, and if the reducing material is imagewise converted into the oxidation product thereof, the photographically useful group or the precursor thereof can be reverse-imagewise released.

Also, in this case, the photographically useful group may have not only a property of increasing or exhibiting its photographic function after being released, but also may have a property of exhibiting this function before the release thereof from (Time) and reducing or losing this function after being released. Furthermore, the photographically useful group may have a property such that for example, the water solubility of PUG is increased after being released, whereby as the result of being reverse-imagewise dissolved, the compound of formula (I) imagewise remaining will also exhibit a useful function.

In other words, the compound of formula (I) in this invention can uniformly, reverse-imagewise, or imagewise exhibit a certain function with respect to silver development.

Accordingly, there are various uses for the compound in this invention and the practical application and utilization examples thereof are shown below, although the invention is not limited to these usages.

(1) When the photographically useful group of the compound in this invention is a diffusible dye, color images can be formed by a diffusion transfer process or a transfer process by sublimation. In this case, a negative working emulsion is used positive images are obtained or when a positive-working emulsion is used, negative images are formed.

(2) When the photographically useful group of the compound in this invention is a dye which is colorless or the absorption wavelength of which has been changed when the dye is bonded and is colored or discolored after being released, the color of the system containing the compound can be changed before and after the release of the group. Accordingly, by utilizing the compound, images can be formed.

(3) When the photographically useful group of the compound in this invention is an antifoggant, the formation of fog can be effectively prevented without causing the undesirable reduction in photographic sensitivity since a large amount of the antifoggant is released in the non-developed portions as compared to the developed portions of the photographic light-sensitive material containing the compound. In this case, the emulsion may be an auto-positive emulsion or a negative working emulsion.

More utilization examples are as follows.

TABLE A

| | Kind of PUG | Overall Effect Upon Release | Effect Upon Release Counter-corresponding to Development of Silver Halide |
|---|---|---|---|
| 1. | Image-forming Dye | — | Posi-posi color image forming system |
| 2. | Photographic Dye (yellow emulsion, anti halation, etc.) | Yellow filter emulsion substitute, Separate layer dyeing, Improvement of color reproducibility, Improvement of | Tone improvement of silver image, Improvement of sharpness |

TABLE A-continued

| | Kind of PUG | Overall Effect Upon Release | Effect Upon Release Counter-corresponding to Development of Silver Halide |
|---|---|---|---|
| | | sharpness, Sensitivity control | |
| 3. | UV Absorbent | Color reproduction improvement | Sensitivity control, Gradation control |
| 4. | Optical Whitening Agent | Whiteness increase of background, Desilvering acceleration | S/N improvement by increasing whiteness of non-image portion only |
| 5. | Antioxidant | Stain control, Fading prevention | Stain control |
| 6. | Masking Dye | — | Color reproduction improvement |
| 7. | Development Inhibitor, Antifoggant | $D_{min}$ reduction, Development step | Graininess improvement, Sharpness improvement, Dot gradation control |
| 8. | Silver Halide Solvent | Development acceleration | Sharpness improvement |
| 9. | Development Accelerator | Development acceleration | Gradation control, Sensitivity control |
| 10. | Nucleating Agent | Nucleation acceleration, Development acceleration | Gradation control |
| 11. | Fix Accelerator | Fix acceleration | Fix acceleration |
| 12. | Reducing Agent | Color mixing prevention, Development acceleration, Graininess improvement, Gradation control | Color mixing prevention, Graininess improvement, Gradation control |
| 13. | Silver Image Toning Agent | Tone control | Tone control |
| 14. | Layer Quality Improving Agent | Development acceleration, Increase of silver image covering power | Development acceleration |
| 15. | Toe Cutting Agent | Contrast increase | Gradation control |
| 16. | Bleach Accelerator | Bleach acceleration | Bleach acceleration |
| 17. | Charge Vanishing Polymer | Separate layer dyeing (Yellow filter emulsion substitute, Anti halation, Irradiation prevention, etc.) | Color image-forming system |
| 18. | Polymer Dissolving out at Processing | Increase of covering power | Formation of relief |

As described above, a tremendous number of applications are possible for the compounds of formula (I) in this invention. Furthermore, the compounds for use in this invention have excellent performance as compared with conventional compounds having similar functions. That is, (1) The compound in this invention can be used over a very wide temperature range since the compound can release a photographically useful group at a sufficiently high rate even at temperatures below −20° C. and is scarcely decomposed at very high temperatures. Also, as to pH, the compound can be used over almost the entire pH range capable of causing a reduction reaction. From the practical photographic view point, the preferred temperature range is from −20° C. to +180° C. and the preferred pH range is from 6.0 to 14.0.

(2) Since the compound in this invention has an acid property, the compound is completely stable in an acidic atmosphere during storage of the photographic material containing the compound. Accordingly, the photographic material containing it has very high storage stability.

(3) Furthermore, the compound in this invention is also excellent in the following property. A compound formed by being reduced during processing, that is, the reduction decomposition product of the compound in this invention is chemically inactive and does not give any undesirable side-reaction during processing and provides no adverse influences during storage of photographs, such as the stability of images.

When the compounds of formula (I) in this invention and other various additives described hereinbelow are water soluble, they can be added to a coating composition of a hydrophilic colloid as a solution in water or a water-miscible organic solvent. Also, when the compound and/or the additive is dispersed in a latex, the latex can be added to a hydrophilic colloid coating composition as it is. Furthermore, when the compound and/or the additive is an oil-soluble polymer, it can be dispersed in a hydrophilic colloid coating composition by a dispersion method usually used for dispersing couplers (e.g., an oil dispersion method, a Fischer's dispersion method, and a polymer dispersion method). Also, they can be dispersed by a solid dispersion method without using a solvent.

High-boiling organic solvents used for the oil dispersion method include, for example, phthalic acid alkyl esters (e.g., dibutyl phthalate and dioctyl phthalate), phosphoric acid esters (e.g., diphenyl phosphate, triphenyl phosphate, tricyclohexyl phosphate, tricresyl phosphate, and dioctylbutyl phosphate), citric acid esters (e.g., tributyl acetylcitrate), benzoic acid esters (e.g., octyl benzoate), alkylamides (e.g., diethyl laurylamide), fatty acid esters (e.g., dibutoxyethyl succinate and dioctyl azerate), trimesic acid esters (tributyl trimesate), carboxylic acids described in JP-A No. 63-85633, the compounds described in JP-A Nos. 59-83154, 59-17845, 59-178452, 59-178453, 59-178454, 59-178455, and 59-178457, and a non-diffusible carboxylic acid derivative represented by formula (a)

$$(R_1\text{—}COO^{\ominus})_nMn^{\oplus} \qquad (a)$$

wherein $R^1$ represents a substituent imparting non-diffusibility to the compound of formula (a); $Mn^{\oplus}$ represents a hydrogen ion, a metal ion (e.g., Mn, Ti, Si, Zn, Cr, Fe, Co, Mo, Sn, etc.), or an ammonium ion; and n represents an integer of from 1 to 4.

The group shown by RI imparting a non-diffusibility to the compound of formula (a) has a carbon atom number of from 8 to 40, and preferably from 12 to 32.

Specific examples of the compound shown by formula (a) are illustrated below.

(a-1)

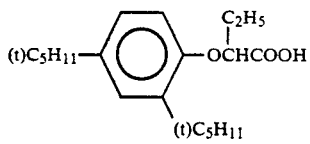

(a-2)

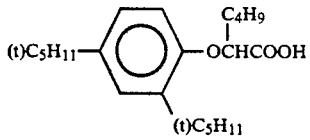

(a-3)

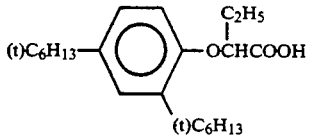

(a-4) $C_{17}H_{35}COO^-NH_4^+$ (a-5)

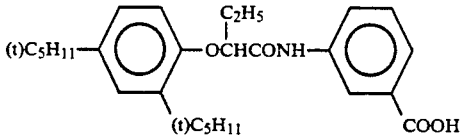

(a-6)

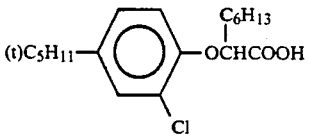

(a-7)

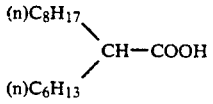

(a-8)

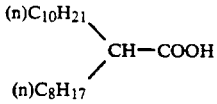

(a-9)

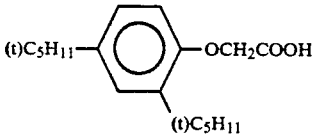

(a-10)

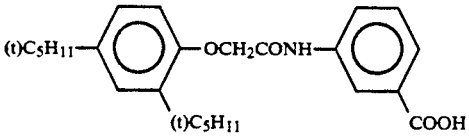

(a-11)

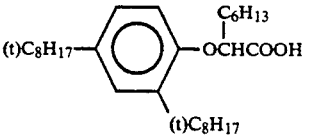

In place of or together with the aforesaid high-boiling organic solvent can be used a low-boiling organic solvent having a boiling point of from about 30° C. to about 160° C., such as a lower alkyl acetate (e.g., ethyl acetate and butyl acetate), ethyl propionate, sec-butyl alcohol, methyl isobutyl ketone, βethoxyethyl acetate, methylcellosolve acetate, and cyclohexanone. Furthermore, after dispersing, the low-boiling organic solvent may be, if necessary, removed by ultrafiltration, etc.

On the other hand, a solid dispersion method is a method of dispersing finely ground particles of the aforesaid compound in a hydrophilic colloid. For finely grinding the compound, an appropriate mill (grinder) is usually used but in this case the mill must have a sufficient shearing force for grinding the material into necessary particle sizes within a proper time. The grinding method and a suitable mill are described in U.S. Pat. Nos. 2,581,414 and 2,855,156 and JP-A No. 52-110012.

The reducing material which is used for releasing PUG from the compound of formula (I) may be an inorganic compound or an organic compound, but a reducing material having an oxidation potential lower than the standard reduction potential of silver ion/silver (0.80 volt) is preferred.

Suitable inorganic compounds include metals having an oxidation potential of lower than 0.8 volt, such as Mn, Ti, Si, Zn, Cr, Fe, Co, Mo, Sn, Pb, W, Hz, Sb, Cu, Hg, etc., ions having an oxidation potential of lower than 0.8 volt or complex compounds thereof, such as $Cr^{2+}$, $V^{2+}$, $Cu^{+}$, $Fe^{2+}$, $MnO_4^{2-}$, $I^-$, $Co(CN)_6^{4-}$, $Fe(CN)_6^{4-}$, $(Fe\text{-}EDTA)^{2-}$, etc., metal hydrides having an oxidation potential of lower than 0.8 volt, such as NaH, LiH, KH, $NaBH_4$, $LiBH_4$, $LiAl(O\text{-}t\text{-}C_4H_9)_3H$, $LiAl(OCH_3)_3H$, etc., and sulfur compounds or phosphorus compounds having an oxidation potential of lower than 0.8 volt, such as $Na_2SO_3$, NaHS, $NaHSO_3$, $H_3P$, $H_2S$, $Na_2S$, $Na_2S_2$, etc.

Suitable organic reducing agents include organic nitrogen compounds such as alkylamines and arylamines, organic sulfur compounds such as alkylmercaptans and arylmercaptans, and organic phosphorus compounds such as alkylphosphins, and arylphosphins but the reducing agents for silver halide obeying the Kendal Pelz equation described in James, *The Theory of the Photographic Process*, 4th edition, 1977, page 299 are preferred.

Examples of the preferred reducing agent are 3-pyrazolidones and the precursors thereof (e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p tolyl-3-pyrazolidone, 1-phenyl-4-methyl-3-pyrazolidone, 1 phenyl-5-methyl-3-pyrazolidone, 1-phenyl-4,4-bis (hydroxymethyl)-3-pyrazolidone, 1,4-di-methyl-3-pyrazolidone, 4-methyl-3-pyrazolidone, 4,4-di-methyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4 methyl- 3-pyrazolidone, 1-(4-tolyl)-3 pyra-zolidone, 1-(3 tolyl)-3-pyrazolidone, 1-(3-tolyl)-4,4-dimethyl-3pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl 4-lauroyloxymethyl-3-pyrazolidone, 1-phenyl-4,4-bis(lauroyloxymethyl)-3-pyrazolidone, 1-phenyl-2-acetyl-3-pyrazolidone, and 1-phenyl-3-acetoxypyrazolidone) and hydroquinones and the precursors thereof (e.g., hydroquinone, toluhydroquinone, 2,6-dimethyl-hydroquinone, t-butylhydroquinone, 2,5-di-t-butylhydroquinone, t-octylhydroquinone, 2,5-di-t-octylhydroquinone, pentadecyl hydroquinone, sodium 5-pentadecylhydroquinone-2-sulfonate, p-benzoyloxyphenol, 2-methyl-4-benzoyloxyphenol, and 2-t-butyl-4-(4-chlorobenzoyloxy)phenol).

Other examples of useful reducing agents, in addition to reducing agents for silver halide, include color developing agents. p-Phenylene series color developing agents such as p-phenylenediamine are described in U.S. Pat. No. 3,531,286. Furthermore, the aminophenols described in U.S. Pat. No. 3,761,270 are also useful as the reducing material. Particularly useful aminophenol reducing agents are 4-amino-2,6-dichlorophenol, 4-amino-2,6-dibromophenol, 4-amino-2-methylphenol sulfate, 4-amino-3-methylphenol sulfate, and 4-amino-2,6-dichlorophenol hydrochloride.

Furthermore, 2,6-dichloro-4-substituted sulfonamidophenol and 2,6-dibromo-4-substituted sulfonamidophenol described in Research Disclosure, Vol. 151, No. 15108 (November, 1976) and U.S. Pat. No. 4,021,240 and p-(N,N-dialkylaminophenyl) sulfamine described in JP-A No. 59-16740 are also useful as the reducing agent. Moreover, naphtholic reducing agents such as 4-aminonaphthol derivatives, etc., and the 4-substituted sulfonamidonaphthol derivatives described in JP-A No. 61-259253 are particularly useful in this invention.

Also, as general color developing agents which can be used as the reducing material in this invention, there are aminohydroxypyrazole derivatives described in U.S. Pat. No. 2,895,825, aminopyrazoline derivatives described in U.S. Pat. No. 2,892,714, and hydrazone derivatives described in *Research Disclosure*, RD-19412, RD-19415, (June, 1980), pages 227–230 and 236–240. These color developing agents may be used singly or as a combination thereof.

When a non-diffusible reducing material (electron-donating material) is incorporated in a photographic light-sensitive material, it is preferred to use such a reducing material in combination with an electron transmitting agent (ETA) for accelerating the electron transfer between the reducing material and a developable silver halide emulsion. The electron donating material and/or the electron transmitting agent may be used in the form of the precursor thereof or the electron donating material and the electron transmitting agent may be used together with the precursors thereof.

Preferred electron donating materials are compounds represented by following formula (C) or (D):

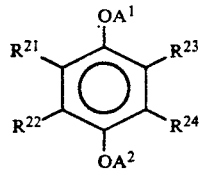

(C)

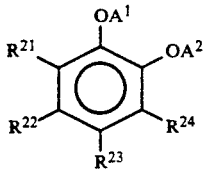

(D)

wherein $A^1$ and $A^2$ each represents a hydrogen atom or a protective group for the phenolic hydroxy group capable of converting into a hydrogen atom (i.e., deprotecting) by a nucleating reagent.

The nucleating agent may be an anionic reagent such as OH—, RO— (wherein R represents an alkyl group or an aryl group), hydroxamic acid anions, $SO_3^{2-}$ etc., and compounds having a non-conjugated electron pair, such as primary or secondary amines, hydrazines, hydroxylamines, alcohols, thiols, etc.

Preferred examples of $A^1$ and $A^2$ are a hydrogen atom, an acyl group, an alkylsulfonyl group, an arylsulfonyl group, an alkoxycarbonyl group, an aryloxycarbonyl group, a dialkylphosphoryl group, a diarylphosphoryl group, or a protective group disclosed in JP-A Nos. 59-197037 and 59-20105. Also, if possible, $A^1$ and/or $A^2$ may combine with $R^{21}$, $R^{22}$, $R^{23}$, and/or $R^{24}$ to form a ring. Also, $A^1$ and $A^2$ may be the same or different.

In the aforesaid formulae (C) and (D), $R^{21}$, $R^{22}$, $R^{23}$, and $R^{24}$ each represents a hydrogen atom, an alkyl group (including a substituted alkyl group, e.g., methyl, ethyl, n-butyl, cyclohexyl, n-octyl, allyl, sec-octyl, tert-octyl, n-dodecyl, n-pentadecyl, n-hexadecyl, tertoctadecyl, 3-hexadecanoyl-aminophenylmethyl, 4-hexadecylsulfonylaminophenylmethyl, 2-ethoxycarbonylethyl, 3-carboxypropyl, N-ethylhexadecylsulfonylaminomethyl, and N-methyldodecylsulfonylaminoethyl), an aryl group (including a substituted aryl group, e.g., phenyl, 3-hexadecyloxyphenyl, 3-methoxyphenyl, 3-sulfophenyl, 3 chlorophenyl, 2-carboxyphenyl, and 3-dodecanoylaminophenyl), an alkylthio group (including a substituted alkylthio group, e.g., n-butylthio, methylthio, tert-octylthio, n-dodecylthio, 2-hydroxyethylthio, n-hexadecylthio, and 3-ethoxycarbonylpropylthio), an arylthio group (including a substituted arylthio group, e.g., phenylthio, 4-chlorophenylthio, 2-n-octyloxy-5-t-butylphenylthio, 4-dodecyloxyphenylthio and 4-hexadecanoylaminophenylthio), a sulfonyl group (including a substituted aryl- or alkylsulfonyl group, e.g., methanesulfonyl, butanesulfonyl, p-toluenesulfonyl, 4-dodecyloxyphenylsulfonyl, and 4-acetylaminophenylsulfonyl), a sulfo group, a halogen atom (e.g., fluorine, chlorine, bromine, and iodine), a cyano group, a carbamoyl group (including a substituted carbamoyl group, e.g., methylcarbamoyl, diethylcarbamoyl, 3-(2,4-di-t-pentylphenyl-oxy)propylcarbamoyl, cyclohexylcarbamoyl, and di-n-octylcarbamoyl), a sulfamoyl group (including a substituted sulfamoyl group, e.g., diethylsulfamoyl, di-n-octylsulfamoyl, n-hexadecylsulfamoyl, and 3-isohexadecanoylaminophenylsulfamoyl), an amido group (including a substituted amido group, e.g., acetamido, iso-butyroylamino, 4-tetradecyloxyphenylbenzamido, and 3-hexadecanoylaminobenzamido), an imido group (including a substituted imido group, e.g., succinic acid imido, 3-laurylsuccinic acid imido, and phthalimido), a carboxy group, a sulfonamido group (including a substituted sulfonamido group, e.g., methanesulfonamido, octanesulfonamido, hexadecanesulfonamido, benzenesulfonamido, toluenesulfonamido, and 4-lauryloxy-benzenesulfonamido).

The total carbon atom number of $R^{21}$ to $R^{24}$ is at least 8.

$R^{21}$ and $R^{22}$ and/or $R^{23}$ and $R^{24}$ in formula (C) or $R^{21}$ and $R^{22}$, $R^{22}$ and $R^{23}$, and/or $R^{23}$ and $R^{24}$ in formula (D) may combine with each other to form a saturated or unsaturated ring.

In the electron-donating material shown by formula (C) or (D), it is preferred that at least two of $R^{21}$ to $R^{24}$ are other substituents than a hydrogen atom. In a particularly preferred compound, at least one of $R^{21}$ and $R^{22}$ and at least one of $R^{23}$ and $R^{24}$ are other substituents than a hydrogen atom.

The aforesaid electron donating materials may be used as a combination thereof or the electron donating material may be used together with a precursor thereof. Also, the electron-donating material may be same as the reducing material used in this invention.

Examples of the electron- donating material are illustrated below, but the invention is not limited to them.

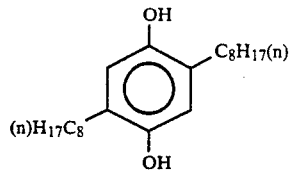

(ED-1)

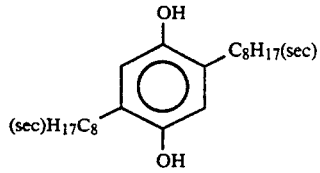

(ED-2)

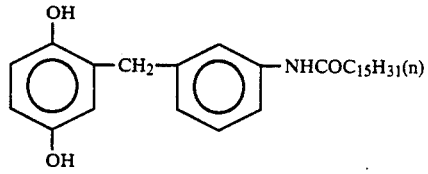

(ED-3)

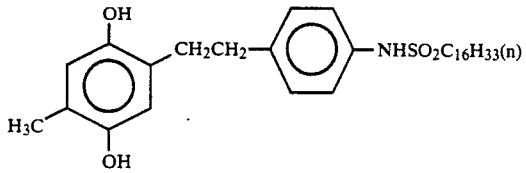

(ED-4)

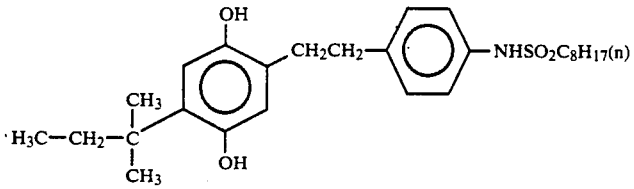

(ED-5)

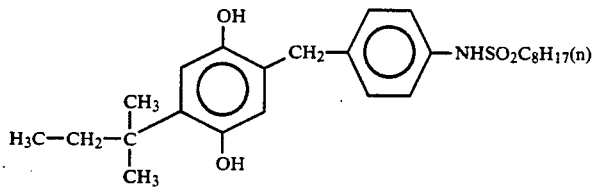

(ED-6)

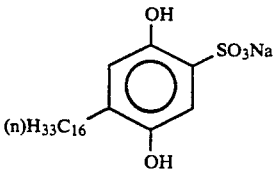

(ED-7)

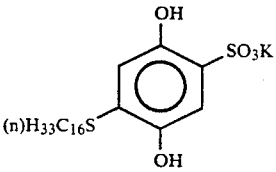

(ED-8)

-continued (ED-9)

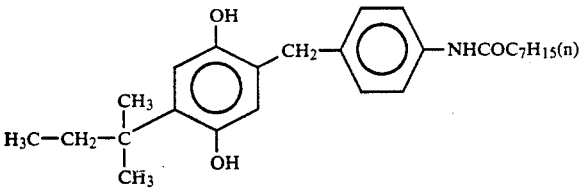

(ED-10)

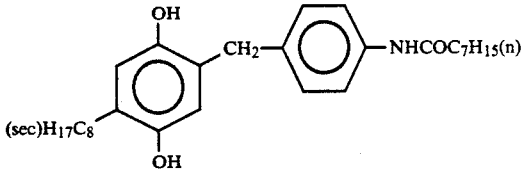

(ED-11)

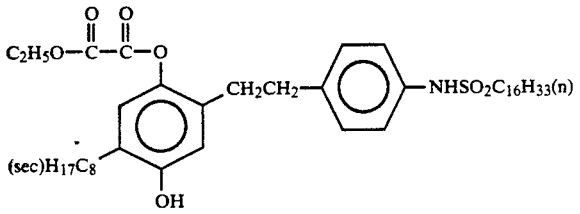

(ED-12)

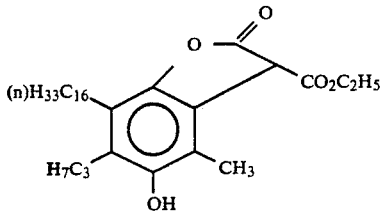

Also, for increasing the storage stability of a photographic light-sensitive material, the electron-donating material(s) may be incorporated in the material in the form of the oxidation product(s) thereof.

The amount of the electron donating material (or the precursor thereof) may be selected over a wide range but is preferably from 0.01 mol to 50 mols, and more preferably from 0.1 mol to 5 mols per mol of the compound of formula (I) or is from 0.001 mol to 5 mols, and preferably from 0.01 mol to 1.5 mols per mol of silver halide in the layer in which the electron donating material is contained.

As the electron transmitting agent (ETA) which is used in combination with the electron donating material described above, any compound which is oxidized by silver halide to an oxidation product having a faculty of crossoxidizing the aforesaid electron-donating material can be used, but the compound is preferably mobile.

Particularly preferred ETA is a compound shown by following formulae (X -I) or (X-II);

(X-I)

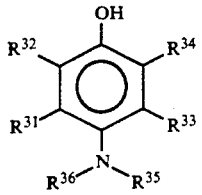

-continued (X-II)

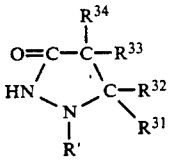

wherein $R^1$ represents an aryl group and $R^{31}$, $R^{32}$, $R^{33}$, $R^{34}$, $R^{35}$, and $R^{36}$, which may be the same or different, each represents a hydro9en atom, a halo9en atom, an acylamino group, an alkoxy group, an alkylthio group, an alkyl group or an aryl group.

Examples of the aryl group shown by $R^1$ in formula (X-I) and (X-II) are phenyl, naphthyl, tolyl, and xylyl and the aryl group may be substituted by, for example, a halogen atom (e.g., chlorine and bromine), an amino group, an alkoxy group, an aryloxy group, a hydroxy group, an aryl group, a carbonamido group, a sulfonamido group, an alkanoyloxy group, a benzoyloxy group, a ureido group, a carbamate group, a carbamoyloxy group, a carbonate group, a carboxy group, a sulfo group, or an alkyl group (e.g., methyl, ethyl, and propyl).

The alkyl group shown by $R^{31}$, $R^{32}$, $R^{33}$, $R^{34}$, $R^{35}$ and $R^{36}$ is an alkyl group having from 1 to 10 carbon atoms (e.g., methyl, ethyl, propyl, and butyl) and the alkyl group may be substituted by a hydroxy group, an amino group, a sulfo group, a carboxy group, etc. Also, as the r aryl group shown by $R^{31}$ to $R^{36}$, there are phenyl, naphthyl, xylyl, tolyl, etc., and the aryl group may be substituted by a halogen atom (e.g., chlorine and bromine), a hydroxy group, an alkoxy group (e.g., methoxy and ethoxy), a sulfo group, a carboxy group, etc.

In this invention, the compound shown by formula (X-II) is particularly preferred as ETA. In formula (X-II), $R^{31}$, $R^{32}$, $R^{33}$, and $R^{34}$ each is preferably a hydrogen atom, an alkyl group having from 1 to 10 carbon atoms, a substituted alkyl group having from 1 to 10 carbon atoms or a substituted or unsubstituted aryl group, and is more preferably a hydrogen atom, a methyl group, a hydroxymethyl group, a phenyl group, or a phenyl group substituted by a hydrophilic group such as a hydroxy group, an alkoxy group, a sulfo group, a carboxy group, etc.

Specific examples of the compounds shown by formulae (X-I) and (X-II) ar illustrated below.

(X-1)

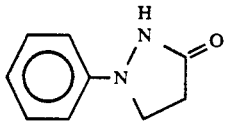

(X-2)

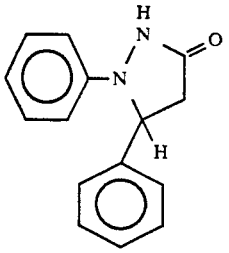

(X-3)

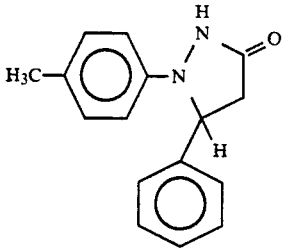

(X-4)

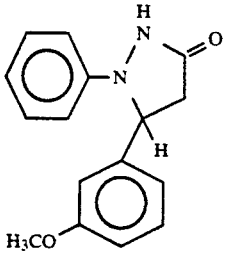

(X-5)

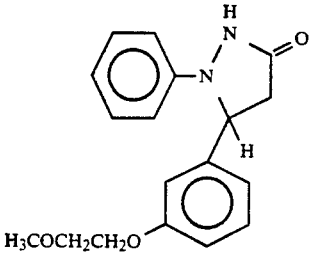

-continued (X-6)

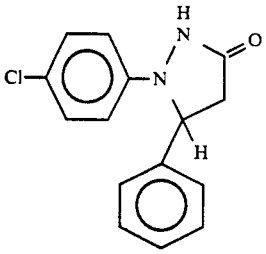

(X-7)

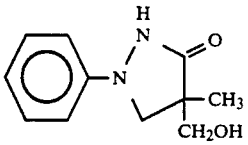

(X-8)

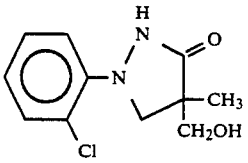

(X-9)

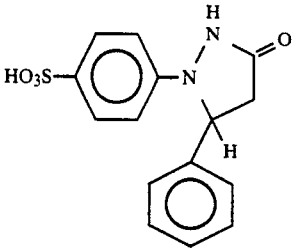

(X-10)

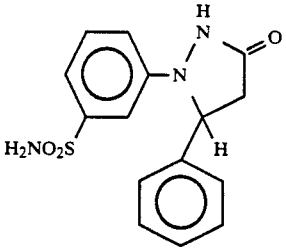

An ETA precursor which may be used in this invention can be a compound which does not have a developing action during the storage of the photographic light-sensitive material before use, but which releases ETA by the action of a proper activator (e.g., a base and a nucleating agent) or heat.

In particular, since in the ETA precursor for use in this invention, the reactive functional group of ETA is blocked by a blocking group, the precursor does not have a function as an ETA before development, but functions as an ETA by the cleavage of the blocking group under alkaline conditions or by heating.

Suitable ETA precursors for use in this invention include, for example, 2- and 3-acryl derivatives of 1-phenyl-3-pyrazolidone, 2-aminoalkyl or hydroxyalkyl derivatives, metal salts (lead salts, cadmium salts, calcium salts, barium salts, etc.,) of hydroquinone, catechol, etc., halogenated acyl derivatives of hydroquinone, oxazine and bisoxazine derivatives of hydroquinone, lactone type ETA precursors, hydroquinone precursors containing a quarternary ammonium group, cyclohexan-2-ene-1,4-dione type compounds, compounds releasing ETA by an electral transfer reaction, compounds releasing ETA by an intramolecular displacement reaction, ETA precursors blocked by a phthalido group, and ETA precursors blocked by an indomethyl group.

The ETA precursors for use in this invention are known compounds, and for example, the developing agent precursors described in U.S. Pat. Nos. 3,241,967, 3,246,988, 3,295,978, 3,462,266, 3,586,506, 3,615,439, 3,650,749, 4,209,580, 4,330,617, and 4,310,612, British Patent Nos. 1,023,701, 1,231,830, 1,258,924, and 1,346,920, JP-A Nos. 57-40245, 58-1139, 58-1140, 59 178458, 59-182449, and 59-182450 can be used.

In particular, the precursors of 1-phenyl-3-pyrazolidones described in JP-A Nos. 59-178458, 59-182449, and 59-182450 are preferred.

This invention can be applied to a so-called conventional photographic light-sensitive material which is developed using a developer at about room temperature or to a heat-developable light-sensitive material.

When the invention is applied to a conventional photographic light sensitive material, a suitable system providing a combination of the aforesaid reducing material or electron donating material (and/or the precursor thereof) and ETA (and/or the precursor) to a photographic light-sensitive material includes a system of supplying the combination to the light-sensitive material in the form of developer at development and a system of incorporating the electron donating material and/or the precursor in the light-sensitive material and supplying ETA and/or the precursor in the form of developer. These are the preferred systems. In the former case, the preferred amounts are from 0.001 mol/liter to 1 mol/liter as the total concentration in the developer, and in the latter case, the amount of the electron donating material and/or the precursor incorporated in a light-sensitive material is from 0.01 mol to 50 mols per mol of the compound of formula (I) present in the light-sensitive material and the amount of ETA and/or the precurso is from 0.001 mol/liter to 1 mol/liter as the concentration in the developer.

When the invention is applied to a heat-developable light-sensitive material, it is preferred to incorporate the electron donating material and/or the precursor thereof and ETA and/or the precursor thereof in the light-sensitive material.

The electron donating material and/or the precursor thereof and ETA and/or the precursor thereof can be present in the same photographic layer or separate photographic layers of a photographic light-sensitive material. Also, the reducing material may be present in the same layer containing the compound (I) for use in this invention or in another layer than the layer containing the compound of formula (I), but it is preferred that the non-diffusible electron donating material and/or the precursor thereof exists in the same layer as the compound of formula (I). ETA and/or the precursor thereof may be present in an image-receiving material (dye-fixing material) or, when heat development is performed in the presence of a slight amount of water, they may be dissolved in the water. In the heat-developable embodiment, the total amount of these reducing agents is from 0.01 mol to 50 mols and preferably from 0.1 mol to 5 mols per mol of the compound of formula (I) in this invention or from 0.001 to 5 mols, and preferably from 0.001 mol to 1.5 mols per mol of silver halide in the layer in which the reducing agent is contained:

Also, the amount of ETA and/or the precursor thereof is not more than 60 mol%, and preferably not more than 40 mol% of the total amount of the reducing agents. When ETA and/or the precursor thereof is applied as a solution in water, the concentration thereof is preferably from $10^{-4}$ mol/liter to 1 mol/liter.

When the reducing material(s) are present in a photographic light-sensitive material as described above, it is preferred for increasing the storage stability of the light-sensitive material to employ conditions so as not to cause a reaction of the compound of formula (I) and the reducing material during storage. As one such means, the precursor of the reducing material (the precursor or the oxidation product of electron donating material or the precursor of ETA) is used as described above. Also, in other means, the compound of formula (I) is isolated from at least a part of the reducing material by microcapsule wall. Examples of this embodiment include the following modes:

| Mode | Inside Microcapsule | Outside Microcapsule |
|---|---|---|
| A | Compound of Formula (1) | Reducing Agent |
| B | Reducing Agent | Compound of Formula (I) |
| C | Reducing Agent | Compound of Formula (I) + Reducing Agent |
| D | Compound of Formula (I) + Reducing Agent | Reducing Agent |

When plural kinds of reducing agents are used, a specific type of reducing agent may be isolated from the compound (2) of this invention by microcapsule walls, or at least a part of each reducing agent may be isolated from the compound of this invention. In particular, it is preferred that a non-diffusible reducing agent (e.g., the above-described electron donating material) be isolated from the compound of formula (I) for use in this invention. Also, for increasing the diffusion rate of the released photographically useful group (e.g., a dye), it is preferred that the compound of this invention is present outside the microcapsules.

In this case, light-sensitive silver halide, a binder, and various additives as described hereinbelow may be present inside or outside the microcapsules.

The aforesaid microcapsules can be prepared by the methods known in the field of the art. For example, a method of utilizing coacervation of a hydrophilic wall-forming material as described in U.S. Pat. Nos. 2,800,457 and 2,800,458, an interfacial polymerization method as described in U.S. Pat. No. 3,287,154, British Patent No. 990,443, JP-B Nos. 38-19574, 42-446, and 42-771 (the term "JP-B" as used herein means an "examined Japanese patent publication"), a method by the deposition of polymer as described in U.S. Pat. Nos. 3,418,250 and 3,660,304, a method of using an isocyanate polyol wall material as described in U.S. Pat. No. 3,796,669, a method of using an isocyanate wall material as described in U.S. Pat. No. 3,914,511, a method of using a ureaformaldehyde or urea-formaldehyde-resorcinol series wall-forming material as described in U.S. Pat. Nos. 4,001,140, 4,087,376, and 4,089,802, a method of using a melamine-formaldehyde resin or hydroxypropylcellulose wall-forming material as described in U.S. Pat. No. 4,025,455, an in situ method by the polymerization of monomers as described in JP-B No.36-9163 and JP-A No. 51-9079, an electrolysis, dispersion, and cooling method as described in British Patent Nos. 952,807 and 965,074, and a spray drying method as described in U.S. Pat. No. 3,111,407 and British Patent No. 930,422, may be used. It is preferred that after emulsifying microcapsule core materials, a polymer film be formed as the microcapsule walls, although the invention is not limited to such a method.

For forming microcapsule walls in this invention, the use of a microencapsulation method by the polymerization of a reactant from the inside of oil droplets gives particularly advantageous effects. That is, microcapsules having uniform particle size and which are suitable for light-sensitive materials excellent in shelf life can be obtained in a short period of time.

For example, when polyurethane is used as a capsule wall material, a polyhydric isocyanate and a second material (e.g., polyol and polyamine) forming the capsule wall by causing a reaction therewith, are mixed in an oily liquid being encapsulated, the mixture is dispersed by emulsification in water, and then the temperature of the system is raised, whereby the polymer-forming reaction occurs at the interfaces of the oil droplets to form microcapsule walls. In this case, a low-boiling auxiliary solvent having a high dissolving power can be used in the oily liquid.

Suitable polyhydric isocyanates and polyols or polyamines being reacted with the isocyanate are described in U.S. Pat. Nos. 3,281,383, 3,773,695, and 3,793,268, JP-B Nos. 48-40347 and 49-24159, JP-A Nos. 48-80191, 48-84086, and 60-49991.

In the case of forming microcapsules, a water-soluble polymer can be used in this invention as the microcapsule material and the water-soluble polymer may be a water soluble anionic polymer, a water-soluble nonionic polymer and a water-soluble amphoteric polymer.

The water-soluble polymer is used as an aqueous solution of from 0.01 to 10% by weight.

The particle size of the microcapsules is preferably controlled to not more than 20 μm. That is, the particle size of the microcapsules in this invention is generally not more than 80 μm but is preferably not more than 20 μm from the view point of storage stability and stability during handling.

Means of increasing the storage stability of the compound of formula (I) for use in this invention in the photographic light-sensitive material include a method of keeping the film pH of the light-sensitive material during storage below 7, and particularly from 4 to 7. In this case, the film pH can be obtained by spotting 20 μl of water on the surface of the top layer of the light-sensitive material and measuring the pH value in the equilibrium state by bringing a pH electrode having a flat tip (sensor portion) into contact with the water drop.

That is, by keeping the pH in the layer of the light-sensitive material between 4 to 7, the deviation of photographic properties with the passage of time can be unexpectedly greatly controlled without substantially inhibiting the development.

For keeping the film pH of a light-sensitive material at 4 to 7, an acid or the acid salt thereof is used. An acid having an acid dissociation constant pKa of not higher than 7, and preferably not higher than 5 is useful. Suitable such acids are described in *Kagaku Binran* (*Chemical Handbook*), (*Foundation*), pages 993–1000, published 1975. Also, a heat-decomposable carboxylic acid is useful and specific examples of such a heat-decomposable carboxylic acid are described in JP-A No. 61-42650.

Furthermore, a polymer composed of polystyrenesulfonic acid, polyacrylic acid, etc., or derivatives thereof can be used as the acid. In this case, the molecular weight of the polymer is preferably at least 1,000, and more preferably at least 5,000 from the viewpoint of stain prevention by the dissolving off of the polymer in a processing solution such as a developer, etc.

The silver halide for use in the photographic material of this invention includes silver chloride, silver bromide, silver iodide, silver chlorobromide, silver chloroiodide, silver iodobromide, or silver chloroiodo-bromide. The halogen composition in the silver halide grains may be uniform throughout the grain or may differ between the surface portion and the inside thereof (as described in JP-A Nos. 57-154232, 58-108533, 59-48755, and 59 52237, U.S. Pat. No. 4,433,048, and European Patent No. 100,948). Also, tabular silver halide grains having a thickness of less than 0.5 μm, a diameter of at least 0.6 μm, and a mean aspect ratio of at least 5 (described in U.S. Pat. Nos. 4,414,310 and 4,435,499 and West German Patent Application (OLS) No. 3,241,646Al) and a mono-dispersed silver halide emulsion having almost uniform grain size distribution (described in JP-A Nos. 57-178235, 58-100846, and 58-14829, PCT Application (unexamined published) No. 83/02338 A1, European Patent Nos. 64,412A3 and 93,377A1) can be used in this invention. Two or more kinds of silver halides each having different crystal habit, halogen composition, grain size, and grain size distribution may be used as a mixture thereof. Also, by using a mixture of two or more kinds of mono-dispersed emulsions each having different grain sizes, the gradation can be desirably controlled.

The silver halide grains for use in this invention have a mean grain size of preferably from 0.001 μm to 10 μm, and more preferably from 0.001 μm to 5 μm.

The silver halide emulsion for use in this invention can be prepared by an acid method, a neutralization method, or an ammonia method and as a method of reacting a soluble silver salt and a soluble halide, a single jet method, a double jet method, or a combination thereof can be used. A so-called reverse mixing method of forming silver halide grains in the presence of excess silver ions or a controlled double jet method of keeping a constant pAg can be employed. Also, for increasing the grain growingrate, the concentration, the addition amount, or the addition rate of the silver salt and halide being added can be increased as described in JP-A Nos. 55 142329 and 55-158124, and U.S. Pat. No. 3,650,757.

Silver halide grains of an epitaxial junction type as described in JP-A No. 56-16124 and U.S. Pat. No. 4,094,684 can be also used in this invention.

In the step of forming silver halide grains for use in this invention, ammonia, the organic thioether derivatives described in JP-B No. 47-11386 and the sulfur-containing compounds described in JP-A No. 53-144319 can be used as a silver halide solvent.

At the step of grain formation or physical ripening of the silver halide grains may be present a cadmium salt, a zinc salt, a lead salt, a thallium salt, etc.

Furthermore, for improving the high illuminance failure or low illuminance failure, a water-soluble iridium salt such as iridium (III, IV) chloride, ammonium hexachloroiridate, etc., or a water-soluble rhodium salt such as rhodiumchloride, etc., can be used. In particular, by incorporating iridium of from $10^{-9}$ to $10^{-5}$ mol per mol of silver halide, a silver halide emulsion excellent in the qualities of reciprocity law failure, fog, and gradation can be obtained.

Soluble salts may be removed from the silver halide emulsion after formation of the precipitates or after physical ripening, and for this purpose, a noodle washing method or a flocculation method can be used.

The silver halide emulsion may be used as a primitive emulsion but is usually chemically sensitized. For an emulsion for conventional photographic light-sensitive materials, a sulfur sensitization method, a reduction sensitization method, a noble metal sensitization method, etc., can be used solely or as a combination thereof. Such a chemical sensitization can also be performed in the presence of a nitrogen-containing heterocyclic compound (JP-A Nos. 58-126526 and 58-215644).

The silver halide emulsion for use in this invention may be of a surface latent image type of forming latent images mainly on the surface of the grain or of an internal latent image type of forming latent images mainly in the interior thereof. A direct reversal silver halide emulsion composed of a combination of an internal latent image type emulsion and a nucleating agent can be used in this invention. Internal latent image type emulsions suitable for this purpose are described in U.S. Pat. Nos. 2,592,250 and 3,761,276, JP-B No. 58-3534, and JP-A No. 57-136641. Also, suitable nucleating agents are described in U.S. Pat. Nos. 3,227,552, 4,245,037, 4,255,511, 4,266,316, and 4,276,364, and West German Patent Application (OLS) No. 2,635,316.

The silver halide emulsion for use in this invention may be spectrally sensitized by methine dyes, etc. Suitable sensitizing dyes include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes, and complex merocyanine dyes.

To these dyes can be applied nuclei ordinary utilized for cyanine dyes as basic heterocyclic nuclei. That is, pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing an aliphatic hydrocarbon ring to the aforesaid nuclei, and the nuclei formed by fusing an aromatic hydrocarbon ring to the aforesaid nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc., can be applied for the dyes described above. These nuclei may be substituted on carbon atoms.

To mercocyanine dyes or complex merocyanine dyes may be applied 5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as nuclei having a ketomethylene structure.

These sensitizing dyes may be used singly or as a combination thereof. A combination of sensitizing dyes is frequently used for the purpose of supersensitization.

The silver halide emulsion for use in this invention may contain a dye having no spectral sensitizing activity by itself or a material which does not substantially absorb visible light and shows supersensitizing activity together with the aforesaid sensitizing dye(s). Examples of these materials are aminostyryl compounds substituted by a nitrogen-containing heterocyclic group (described, e.g., in U.S. Pat. Nos. 2,933,390 and 3,635,721), aromatic organic acid-formaldehyde condensates (described, e.g., in U.S. Pat. No. 3,743,510), cadmium salts, and azaindene compounds. The combinations described in U.S. Pat. Nos. 3,615,613, 3,615,641, 3,617,295 and 3,635,721 are particularly useful.

The photographic emulsions for use in this invention may further contain surface active agents singly or as a mixture thereof.

The surface active agents are usually used as coating aids, but they sometimes may be used for other purposes such a the improvement of emulsification dispersion, the improvement of photographic sensitivity, static prevention, sticking prevention, etc.

Suitable surface active agents for use in this invention include natural surface active agents such as saponin, etc.; nonionic surface active agents such as alkylene oxide series, glycerol series, glycidol series, etc.; cationic surface active agents such as higher alkylamines, quaternary ammonium salts, heterocyclic rings such as pyridine, etc., phosphoniums, sulfoniums, etc.; anionic surface active agents containing an acid group such a carboxylic acid, sulfonic acid, phosphoric acid, sulfuric acid ester, phosphoric acid ester, etc.; and amphoteric surface active agents such as amino acids, aminosulfonic acids, sulfuric or phosphoric acid esters of aminoalcohol, etc.

The photographic emulsions for use in this invention may further contain various kinds of compounds for preventing the formation of fog during the production, storage, and/or photographic processing of the photographic light-sensitive materials or stabilizing the photographic performance of the light-sensitive materials. Examples of such compounds are development inhibitors explained above for PUG.

The photographic emulsion layer(s) of the photographic light sensitive materials of this invention may further contain thioether compounds, thiomorpholines, quaternary ammonium salts, urethane derivatives, urea derivatives, imidazole derivatives, 3-pyrazolidones, etc., for increasing the sensitivity, contrast, and/or accelerating the development.

The photographic light-sensitive material of this invention can further contain in the photographic emulsion layer(s) or other hydrophilic colloid layer(s) a dispersion of a water-insoluble or sparingly water soluble synthetic polymer for improving the dimensional stability, etc. As examples, there are polymers or copolymers composed of alkyl (meth)acrylate, alkoxyalkyl (meth)acrylate, glycidyl (meth)acrylate, (meth)acrylamide, vinyl esters (e.g., vinyl acetate), acrylonitrile, olefin, styrene, etc., solely or as a combination thereof, or a combination of the aforesaid monomers and acrylic acid, methacrylic acid, $\alpha,\beta$-unsaturated dicarboxylic acid, hydroxyalkyl (meth)acrylate, sulfoalkyl (meth)acrylate, styrenesulfonic acid, etc.

Suitable binders for the emulsion layers and auxiliary layers (e.g., protective layers, interlayers, etc.) of the photographic light-sensitive material of this invention include a hydrophilic colloid, preferably, and in particular, gelatin is advantageously used but other hydrophilic colloids can be used. Examples of such hydrophilic colloids are proteins such as gelatin derivatives, graft polymers of gelatin and other polymer, albumin, casein, etc.; cellulose derivatives such as hydroxyethyl cellulose, carboxymethyl cellulose, cellulose sulfuric acid esters, etc.; saccharide derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinyl imidazole, polyvinylpyrazole, etc.

As gelatin, limed gelatin, acid treated gelatin, enzyme-treated gelatin, etc., can be used.

The photographic light-sensitive material of this invention may further contain inorganic or organic hardening agents in the photographic emulsion layers and other hydrophilic colloid layers. Examples of such hardening agents are chromium salts (e.g., chromium alum and chromium acetate), aldehydes (e.g., formaldehyde, glyoxal, and glutaraldehyde), N-methylol compounds (e.g., dimethylolurea and methyloldimethylhydantoin), dioxane derivatives (e.g., 2,3-dihydroxydioxane), active vinyl compounds (1,3,5-triacryloyl-hexahydro-s-triazine and 1,3-vinylsulfonyl-2-propanol), active halogen compounds (e.g., 2,4-dichloro-6-hydroxy-s-triazine), mucohalogenic acids (e.g., mucochloric acid and mucophenoxychloric acid). They can be used singly or as a combination thereof.

Furthermore, in the silver halide photographic materials of this invention may be further various additives such as whitening agents, dyes, desensitizers, coating aids, antistatic agents, plasticizers, lubricants, matting agents, development accelerators, mordants, ultraviolet absorbents, fading preventing agents, color fog preventing agents, etc. These additives and details of their location, amounts, etc. are described in *Research Disclosure*, Vol. 176 (RD-17643), pages 22–31, (December, 1978).

The compound of formula (I) for use in this invention can be used in any conventional silver halide photographic material which is developed using a developer at normal temperature, such as, for example, radiographic films (industrial X-ray films, medical indirect X-ray films, medical direct X-ray films, etc.), light-sensitive materials for printing (photographic films for line images or dot images, photographic films for contact work, photographic films or papers for photomachining, etc.), general black and white photographic papers, black and white photographic films for shooting, scanner photographic films, color negative photographic films, color photographic papers, color reversal photographic films, color reversal photographic papers, color photographic papers for copying, direct reversal black and white light-sensitive materials, color diffusion transfer photographic materials, etc.

The photographic light-sensitive materials for printing to which the compound of formula (I) can be applied include not only so-called lithographic films but also printing light-sensitive materials containing silver chlorobromide or silver chloroiodo-bromide (content of silver iodode being 0 to 5%) containing more than 60% silver chloride and a polyalkylene oxide described in U.S. Pat. No. 4,452,882 and the printing light-sensitive materials forming superhigh contrast negative images by the action of arylhydrazines using a stable developer described in U.S. Pat. No. 4,224,401.

The color photographic material to which the compound of formula (I) is applied generally has at least two emulsion layers each having a different spectral sensitivity. A multilayer natural color photographic material of this invention usually has at least one red-sensitive emulsion layer, at least one green-sensitive emulsion layer, and at least one blue-sensitive emulsion layer on a support. The disposition order of these layers can be optionally selected according to the purpose. In a preferred embodiment thereof, the order of the layer disposition is a red-sensitive layer, a green-sensitive layer, and a blue-sensitive layer or a blue-sensitive layer, a red-sensitive layer, and a green-sensitive layer from the support side.

Also, each emulsion layer may be composed of two or more emulsion layers each having different sensitivities or a light-insensitive layer may be present between two or more emulsion layers having the same color sensitivity.

Usually, a red-sensitive emulsion layer contains a cyan-forming coupler, a green-sensitive emulsion layer contains a magenta-forming coupler, and a blue-sensitive emulsion layer contains a yellow-forming coupler but as the case may be, other different combinations can be employed.

In this invention, various kinds of color couplers can be used. A color coupler is a compound capable of forming a dye by causing a coupling reaction with the oxidation product of an aromatic amine developing agent.

Typical examples of useful color couplers are naphtholic or phenolic compounds pyrazolone or pyrazoloazole compounds, and open chain or heterocyclic ketomethylene compounds. Suitable cyan, magenta, and yellow couplers such as the above, which can be used in this invention are described in the patents cited in *Research Disclosure*, No. 17643, VII-D (December, 1978) and ibid., No. 18717 (November, 1979).

The color couplers incorporated in the photographic light-sensitive materials of this invention are preferably rendered non-diffusible by having a ballast group or by being polymerized. In this invention, 2-equivalent couplers, the coupling active position of which has been substituted by a coupling releasable group, is more preferable than 4-equivalent couplers having a hydrogen atom at the coupling active position as to reducing the coated amount of silver. Furthermore, non-coloring couplers, couplers giving a dye having a proper diffusibility DIR couplers releasing a development inhibitor upon a coupling reaction, or couplers releasing a development accelerator can be used in this invention.

For processing the silver halide photographic light-sensitive materials of this invention by an ordinary wet process, known processes and known processing solutions can be used. The processing temperature is usually from 18° C. to 50° C. but a temperature lower than 18° C. or higher than 50° C. may be employed as the case may be. Also, according to the purpose, a black and white process including a development process forming silver images or a color photographic process including a development process of forming color images can be applied.

Suitable photographic processes are described in James, *The Theory of the Photographic Process*, 4th edition, pages 291–436 and *Research Disclosure*, No. 17643, pages 28–30 (December, 1978).

After black and white development, the light-sensitive material is fixed and a fix solution having a conventional composition can be used for fixing. As a fixing agent, thiosulfates, thiocyanates, or organic sulfur compounds which are known to have an effect as a fixing agent can be used. The fix solution may contain a water-soluble aluminum salt as a hardening agent.

After color development, the light sensitive material is usually bleached. The bleach process may be performed simultaneously with or separately from a fix process. As a bleaching agent, compounds of polyvalent metals such as iron(III), cobalt(III), chromium(IV), copper(II), etc., peracids, quinones, nitroso compounds, etc., can be used.

Specific examples of the bleaching agent are ferricyanides, bichromates, organic complex salts of iron(III) or cobalt(III), complex salts of aminopolycarboxylic acids (e.g., ethylenediaminetetraacetic acid, nitrilotriacetic acid, and 1,3 diamino-2-propanoltetraacetic acid) or organic acids (e.g., citric acid, tartaric acid, and malic acid), persulfates, permanganates, and nitrosophenol. Among these compounds, potassium ferricyanide, ethylenediaminetetraacetic acid iron(III) sodium and ethylenediaminetetraacetic acid iron(III) ammonium are particularly useful. The ethylenediaminetetraacetic acid iron(III) complex salts ar useful in both the independent bleach solution and the mono-bath bleach-fix (blix) solution.

The bleach solution or blix solution may further contain various additives such as bleach accelerators described in U.S. Pat. Nos. 3,042,520 and 3,241,966, JP-B Nos. 45-8506 and 45-8836, thiol compounds described in JP-A No. 53-65732, etc.

The.compound of formula (I) for use in this invention can be also applied to a heat-developable light-sensitive material forming black and white images or coupler dye images. A heat-developable light-sensitive material fundamentally comprising a layer containing light-sensitive silver halide, a binder, and a reducing agent on a support and if necessary, further containing an organic metal salt oxidizing agent, a dye-providing compound (a reducing agent may also be necessary to react with the dye-providing compound as explained below), etc. In this case, it is preferred that the compound of formula (I) in this invention is used as the dye-providing compound. These components frequently are present in one layer, but may be present in separate layers if they are in a reactable state. For example, if the color dye providing compound exists in a layer under a layer of a silver halide emulsion, reduction in sensitivity can be desirably prevented.

For obtaining colors over a wide range in a chromaticity using the three primary colors of yellow, magenta, and cyan, a combination of at least three silver halide emulsion layers each having light sensitivity in a different spectral region is used. For example, a combination of a blue-sensitive layer, a green-sensitive layer, and a red-sensitive layer or a combination of a green-sensitive layer, a red-sensitive layer, and an infrared-sensitive layer may be used. These layers may be disposed in an order known in conventional color photographic light sensitive materials. Also, if necessary, each light-sensitive layer may be composed of two or more layers.

The heat-developable light-sensitive materials in this invention may further comprise various auxiliary layers such as a protective layer, a subbing layer, interlayers, a yellow filter layer, an antihalation layer, a back layer, etc.

In the heat-developable light-sensitive material, an organic metal salt can be used as an oxidizing agent together with light-sensitive silver halide. In this case, it is necessary that the light-sensitive silver halide and the organic metal salt be in contact or in an adjacent state.

Among these organic metal salts, an organic silver salt is particularly preferably used.

Suitable organic compounds capable of forming the aforesaid silver salt oxidizing agent include the compounds described in U.S. Pat. No. 4,500,626, columns 52–53. Also, the silver salt of a carboxylic acid having an alkinyl group such as phenylpropionic acid silver described in JP-A No. 60-113235 and acetylene silver described in JP-A No. 61-249044 are useful. Two or more kinds of organic silver salts may be used together.

The aforesaid organic silver salt can be used in an amount of from 0.01 to 10 mols, and preferably from 0.01 to 1 mol per mol of light-sensitive silver halide. The total coating amount of light-sensitive silver halide and the organic silver salt is usually from 50 mg/m$^2$ to 10 g/m$^2$ as silver.

It is preferred that the compound of formula (I) wherein PUG is a diffusible dye is used as the dye-providing compound for the heat-developable light-sensitive material of this invention, but the compound of formula (I) wherein PUG is another type of photographically useful group (e.g., a development inhibitor) than a dye, or other compounds, may be used as the dye-providing compound in this invention.

As such other dye-providing compound, there are compounds (couplers) forming a dye by causing an oxidative coupling reaction. The couplers may be 4-equivalent couplers or 2-equivalent couplers. Also, 2-equivalent couplers having a non-diffusible group as a releasable group and forming a diffusible dye by an oxidative coupling reaction are preferred. Specific examples of the developing agent and couplers are described in T.H. James, *The Theory of the Photographic Process*, pages 291–334 and 354–361, JP-A Nos. 58-123533, 58-149046, 58-149047, 59-111148, 59-124399, 59-174835, 59-231539, 59-231540, 60-2950, 60-2951, 60-14242, 60-23474, and 60-66249.

Also, as other examples of the dye-providing compound, there are compounds having a function of imagewise releasing or diffusing a diffusible dye. A compound of this type can be shown by formula (LI)

$$(\text{Dye-Y})_n\text{-Z} \qquad \text{(LI)}$$

wherein Dye represents a dye group or dye precursor group, the absorption wavelength of which has been temporarily shifted to short wavelength side; Y represents a single bond or a linking group; Z represents a group having a property of giving a difference in the diffusibility of the compound shown by $(\text{Dye-Y})_n$-Z corresponding or counter-corresponding to a light-sensitive silver salt providing imagewise latent images or releasing Dye and giving no difference in diffusibility between Dye released and $(\text{Dye-Y})_n$Z; and n represents 1 or 2, with the proviso that when n is 2, two (Dye-Y)s may be the same or different.

Specific examples of the dye-providing compound shown by formula (LI) include compounds (1) to (5) generally described below. In addition, the following categories of compounds (1) to (3) form a diffusible dye image (positive dye image) counter-corresponding to the development of silver halide, and categories of compounds (4) and (5) form a diffusible dye image (negative dye image) corresponding to the development of silver halide.

(1) Dye developing agent linking a hydroquinone series developing agent and a dye component described in U.S. Pat. Nos. 3,134,764, 3,362,819, 3,597,200, 3,544,545, and 3,482,972. The dye developing agent is diffusible in an alkaline condition but becomes non-diffusible by causing reaction with silver halide.

(2) Non-diffusible compound releasing a diffusible dye under an alkaline condition but losing this faculty when the compound reacts with silver halide, as described in U.S. Pat. No. 4,503,137. Examples of such a compound are compounds releasing a diffusible dye by an intramolecular substitution reaction described in U.S. Pat. No. 3,980,479 and compounds releasing a diffusible dye by an intramolecular rearrangement reaction of an isooxazolone ring described in U.S. Pat. No. 4,199,354.

(3) Non-diffusible compound releasing a diffusible dye by causing reaction with a remaining reducing agent without being oxidized by development as described in U.S. Pat. No. 4,559,290, European Patent No. 220,746A2, and *Kokai Giho*, No. 87-6199.

Examples of such a compound are compounds releasing a diffusible dye by an intramolecular nucleophilic substitution reaction after being reduced as described in U.S. Pat. Nos. 4,139,389 and 4,139,379, JP-A Nos. 59-185333 and 57-84453, compounds releasing a diffusible dye by an intramolecular electron transfer reaction after being reduced as described in U.S. Pat. No. 4,232,107, JP-A Nos. 59-101649 and 61-88257, and *Research Disclosure* No. 24025 (April, 1984), compounds releasing a diffusible dye by the cleavage of a single bond after being reduced as described in West German Patent No. 3,008,588A, JP-A No. 56-142530, U.S. Pat. Nos. 4,343,893 and 4,615,884, nitro compounds releasing a diffusible dye after receiving an electron as described in U.S. Pat. No. 4,450,223, compounds releasing a diffusible dye after receiving an electron as described in U.S. Pat. No. 4,609,610, etc.

Also, examples of more preferred such compounds are compounds having an N-X bond (wherein X represents oxygen, sulfur or nitrogen) and an electron attracting group in one molecule as described in European Patent No. 220,746A2, Kokai Giho, No. 87-6199, JP-A Nos. 63-201653 and 63-201654, compounds having $SO_2$-X (wherein X is same as above) and an electron attracting group in one molecule as described in Japanese Patent Application No. 62-106885, compounds having a PO-X bond (wherein X is same as defined above) and an electron attracting group in one molecule as described in Japanese Patent Application No. 62-106895, and compounds having a C—X' bond (wherein X' is same as X or —$SO_2$—) and an electron attracting group in one molecule as described in Japanese Patent Application No. 62-106887.

Of these compounds, a compound having the N—X bond and an electron attracting group in one molecule is particularly preferred. Specific examples thereof are the compounds (1) to (3), (7) to (10), (12), (13), (15), (23) to (26), (31), (32), (35), (36), (40], (41), (44), (53) to (59), (64), and (70) described in European Patent No. 220,746A2 and the compounds (11) to (23) described in *Kokai Giho*, No. 87-6199.

(4) Compound (DDR coupler) having a diffusible dye as a releasable dye and releasing the diffusible dye by the reaction with the oxidation product of a reducing agent. Practical examples thereof are described in British Patent No. 1,330,524, JP-B No. 48-39165, and U.S. Pat. Nos. 3,443,940, 4,474,867, and 4,483,914.

(5) Compound (DDR compound) which is reductive to silver halide or an organic silver salt and releases a diffusible dye by reducing a targeted component. In the case of using such a compound, other reducing agents may not be used and hence the use of the compound is preferred since staining of images by oxidation decomposition products of a reducing agent does not occur. Typical examples of such a compound are described in U.S. Pat. Nos. 3,928,312, 4,053,312, 4,055,428, 4,336,322, 3,725,062, 3,728,113, 3,443,939, and 4,500,626, JP-A Nos. 59-65839, 69839, 53-3819, 51-104343, 58-116537, and 57-179840, *Research Disclosure*, No. 17465 (October, 1978), etc. As typical examples of the DRR compound, there are the compounds described in aforesaid U.S. Pat. No. 4,500,626, columns 22–44 and in particular, the compounds (1) to (3), (10) to (13), (16) to (19), (28) to (30), (33) to (35), (38) to (40), and (42) to (64) described in the aforesaid U.S. Patent are preferred. Also, the compounds described in U.S. Pat. No. 4,639,408, columns 37–39 are useful.

As other dye-providing compounds than the aforesaid couplers and those shown by formula (LI), dye silver compounds composed of an organic silver salt and a dye bonded with each other (described in *Research Disclosure*, May, 1978, pages 54–58), azo dyes which are used for a heat-developable silver dye bleaching process (described in U.S. Pat. No. 4,235,957 and *Research Disclosure*, April, 1976, pages 30–32), and leuco dyes (described in U.S. Pat. Nos. 3,985,656 and 4,022,617) can be also used in this invention.

In this invention, a compound capable of activating the development of a light-sensitive element and, at the same time, stabilizing the images can be used. Practical examples of the preferred compounds are described in U.S. Pat. No. 4,500,626, columns 51–52.

In a system of forming images by the diffusion transfer of dyes, a dye-fixing element is used with a light sensitive element. The dye-fixing element may be such that the element is formed on a different support than the support containing the light-sensitive element, or an embodiment wherein both elements are formed on the same support. The relationship between the light-sensitive element and the dye-fixing element to each other, the relationship of these element and their supports, and the relationship of the light-sensitive element and a white reflection layer which can be applied to this invention are suitably described in U.S. Pat. No. 4,500,626, column 57.

The dye-fixing element which is preferably used in this invention has at least one layer containing a mordant and a binder. As the mordant, any mordants known in the field of photography can be used and practical examples thereof are described in U.S. Pat. No. 4,500, 626, columns 58–59, JP-A No. 61-88256, pages 32–41, JP-A Nos. 60-118834, 60-119557, 60-235134, 62-244043, and 62-244036. Also, the dye acceptive polymers described in U.S. Pat. No. 4,463,079 can be used.

In the dye-fixing element, if necessary, a protective layer, a releasing layer, a curling preventing layer, etc., can be formed. A protective layer is particularly useful.

As the binder for constituting the layers of the dye-fixing element, natural polymers or synthetic polymers, i.e., the same as the binders for the light-sensitive elements or materials, can be used.

One or more layers constituting the light-sensitive element and the dye-fixing element of this invention may contain a heat solvent, a plasticizer, a fading preventing agent, an ultraviolet absorbent, a lubricant, a matting agent, an antioxidant, a dispersive vinyl compound for increasing the dimensional stability, a surface active agent, an optical whitening agent, etc. Specific examples of these additives are described in JP-A No. 61-88256, pages 26–32.

Also, in a system of conducting heat development and the transfer of dye simultaneously in the presence of a small amount of water, it is preferred for improving the storage stability of the light-sensitive element to incorporate a base and/or a base precursor as described hereinbelow to the dye-fixing element.

In the light-sensitive element and/or the dye-fixing element, an image formation accelerator can be used. The image formation accelerator has the function of accelerating the oxidation-reduction reaction of a silver salt oxidating agent and a reducing agent, forming a dye from the dye-providing material or decomposing the dye, accelerating the reaction for the release of a diffusible dye, and accelerating the transfer of a dye from the light-sensitive material layer to the dye-fixing layer. In its physicochemical function, the image formation accelerator may be classified into bases or base precursors, nucleophilic compounds, high-boiling point organic solvents (oil), heat solvents, surface active agents, and compounds having an interaction with silver or silver ions. In this case, however, these materials generally have composite functions and also plural functions as noted above. Details thereof are described in U S. Pat. No. 4,678,739, columns 38–40.

Suitable base precursor include salts of an organic acid and a base causing a decarbonization by heat and compounds releasing amines by an intramolecular nucleating substitution reaction, a Lossen rearrangement, or a Beckman rearrangement. Specific examples of the base precursor are described in U.S. Pat. No. 4,511,493 and JP-A No. 62–65038. Also, a combination of a sparingly soluble metal compound and a compound (referred to as complex-forming compound) capable of causing a complex forming reaction with a metal ion constituting the sparingly soluble metal compound described in European Patent Application (unexamined published) 210,660, and the compound forming a base by electrolysis described in JP-A No. 61-232451 can be used as the base precursor. In particular, the former combination is effective. It is advantageous to separately incorporate the sparingly soluble metal compound and the complex-forming compound in the light-sensitive element and the dye-fixing element.

In the light-sensitive element and/or the dye-fixing element of this invention, various development stopping agents can be used for obtaining always constant images in response to the deviation of the processing temperature and processing time at development.

The development stopping agent described above may be a compound capable of quickly neutralizing a base or reacting with a base after appropriate development to reduce the concentration of the base in the layer(s) of the light-sensitive material and, thus, to stop the development, or a compound capable of controlling the development by causing an interaction with silver or a silver salt.

Practically, there are an acid precursor releasing an acid by heating, an electrophonic compound causing a displacement reaction with an existing base, a nitrogen-containing heterocyclic compound, a mercapto compound or the precursor thereof. They are described, for example, in U.S. Pat. Nos. 4,670,373, 4,656,126, 4,610,957, 4,626,499, 4,678,735, and 4,639,408, JP-A Nos. 61-147249, 61-147244, 61-184539, 61-185743, 61-185744, 61-188540, 61-269148, and 61-269143.

The layers (photographic emulsion layer(s), dye-fixing layer, etc.) constituting the light-sensitive element and/or the dye-fixing element of this invention may further contain an inorganic or organic hardening agent.

Practical examples of the hardening agent are described in U.S. Pat. No. 4,678,739, column 41 and JP-A No. 59-16655 and they can be used singly or as a combination thereof.

A support which is used for the light-sensitive element and/or the dye-fixing element of this invention is composed of a material capable of enduring the processing temperature. A general type of support is a glass plate, a polymer film, a metal sheet and the like as well as the supports described in JP-A No. 61-147244 page 25.

The light-sensitive element and/or the dye-fixing element of this invention may have a conductive heating layer (or heat-generating layer) therein as a heating means for the heat development or the diffusion transfer of dye. In this case, the transparent or opaque heating element can be prepared by utilizing a conventional technique for ordinary resistance heating element. A suitable resistance heating element is a system of utilizing a thin film of an inorganic material showing semiconductivity and a system of utilizing a thin film of organic material composed of fine conductive particles dispersed in binder. Materials which can be used in these systems are described in JP-A No. 61-145544. In addition, the conductive layer (conductive heating layer) also functions as an antistatic layer.

As the coating method for the heat-developable light-sensitive layer, protective layer, interlayer, subbing layer, back layer, dye-fixing layer, etc., in this invention, the method described in U.S. Pat. No. 4,500,626, columns 55–56 can be applied.

As a light source for image exposure for recording images onto the light-sensitive element, different types of radiation including visible light can be used. In general, light sources for ordinary color print, such as a tungsten lamp, a xenon lamp, a mercury lamp, a halogen lamp (e.g., iodine lamp), a laser light source, CRT light source, a light emitting diode (LED), and the light sources described in U.S. Pat. No. 4,500,626, column 56 can be used.

The heating temperature in the heat development step may be from about 50° C. to about 250° C. but is particularly advantageously from about 80° C. to 180° C.

The diffusion transfer of dye may be performed simultaneously with the heat development or after finishing the heat development step. In the latter case, the heating temperature in the heat transfer step can be the range of from room temperature to the temperature used in the heat development step but is preferably the range of from 50° C. to about 10° C. lower than the temperature in the heat development step.

The transfer of dye occurs by heat only, but a solvent may be used for accelerating the transfer of dye. Also, as described in JP-A Nos. 59-218443 and 61-238056, a method of heating in the presence of a small amount of solvent (in particular, water) to perform the development and transfer simultaneously or continuously may be used. In this system, the heating temperature is preferably above 50° C. and below the boiling point of the solvent. For example, when the solvent is water, the heating temperature is preferably from 50° C. to below 100° C.

Examples of the solvent which is used for the acceleration of development and/or the transfer of the diffusible dye into the dye-fixing layer are water and a basic aqueous solution containing an inorganic alkali metal salt or an organic base (as the base, those described above as to the image formation accelerator are useful). Also, a low boiling point solvent or a mixture of a low-boiling point solvent and water or the aforesaid basic aqueous solution can be used. Furthermore, the solvent may contain a surface active agent, an antifoggant, a combination of a sparingly soluble metal salt and the complex-forming compound, etc.

The solvent can be applied to one or both of the dye-fixing element and the light-sensitive element. The amount of the solvent may be as small as less than the amount of solvent corresponding to the maximum swelled volume of the whole coated layers (in particular, less than the amount obtained by subtracting the weight of the whole coated layers from the amount of solvent corresponding to the maximum swelled volume of the whole coated layers).

A suitable manner of applying a solvent to the light-sensitive layer or the dye-fixing layer is a method described in JP-A No. 61-147244, page 26. Also, a solvent may be used in the light-sensitive element and/or the dye-fixing element in the form of being encapsulated in capsules.

Also, for accelerating the dye transfer, a system of incorporating a heat solvent which is solid at normal temperature but is dissolved at high temperature in the light-sensitive element and/or the dye-fixing element may be used. Furthermore, the layer containing the heat solvent may be a silver halide emulsion layer, an interlayer, a protective layer or a dye-fixing layer but is preferably a dye-fixing layer and/or a layer adjacent to the dye-fixing layer.

Examples of the heat solvent are ureas, pyridines, amides, sulfonamides, imides, alcohols, oximes, etc.

Also, for accelerating the dye transfer, a high-boiling point organic solvent may be present in the light-sensitive element and/or the dye-fixing element.

In the case of forming color images using the heat-developable light-sensitive material of this invention, various steps may be used in combination. For example, typical steps in the case of using a so-called two sheet type photographic material formed separately on different supports are as follows:

(i) Exposure step -heat development step superposing step of the light-sensitive material and the image-receiving material image transfer step .peeling off step.

(ii) Exposure step—superposing step of the light-sensitive material and the image-receiving material—heat-development and image transfer step—peeling off step.

(iii) Exposure step—heat development step—solvent applying step—superposing step of the light-sensitive material and the image-receiving material—image transfer step—peeling off step.

(iv) Exposure step—solvent applying step—superposing step of the light-sensitive material and the image-receiving material—heat development and transfer step peeling off step.

The peeling off step may be omitted according to the structure of the image-receiving material. The aforesaid steps are convenient classifications and in the case of continuously performing the plural steps, these steps are not distinctly classified as the case may be, as in the case of performing heat development in succession with the exposure step or the case of performing one step in plural stages. The combination of these steps can be selected according to the manner of generating a base, e.g., a manner of incorporating a heat decomposing type base precursor, or the manner of generating a base by reacting two compounds present in a photographic light-sensitive material in the presence of a solvent. Also, the combination can be selected by the manner of using an accelerator for controlling the rate of the development transfer.

Also, a system of heat developing a heat-developable light-sensitive material after keeping it for a definite period of time at a state of preferentially causing a reaction of silver halide and a reducing agent to a reaction of forming or releasing a diffusible dye during or after the image exposure may be used. In the aforesaid system, the state of preferentially causing a reaction of silver halide and a reducing agent to a reaction of forming or releasing a diffusible dye is a state of causing a reaction of silver halide and a reducing agent at temperature below a temperature of causing a reaction of forming or releasing a diffusible dye (the temperature is called a "heat developing temperature"). Also, the state of causing a reaction of silver halide and a reducing agent is a state of meeting the sufficient condition for causing the reaction of silver halide and a reducing agent by the pH and temperature of the light-sensitive layer(s) of the heat-developable light-sensitive material.

In this case, a temperature lower than the heat developing temperature is preferably a temperature of more than 10° C., and preferably more than 15° C., lower than the heat developing temperature (i.e., a temperature set for the reaction of forming or releasing a diffusible dye from the dye-providing compound). The temperature may differ in the aforesaid temperature range.

In this case, the term "keeping a definite period of time" mean that the light-sensitive material is kept for a time necessary for giving at least 5%, and particularly at least 10% developed silver of the finally attained silver amount.

The heating means in the development and/or the transfer step may be a heat plate, heating iron, heating roller, etc., as described in JP-A No. 61-147244, pages 26–27.

As a manner of applying pressure while superposing the light-sensitive element and the dye-fixing element, the method described in JP-A No. 61-147244, page 27 can be applied.

For processing the heat-developable light-sensitive material of this invention, various kinds of heat-developing apparatus can be used. Examples of the preferred means are described in JP-A Nos. 59-75247, 59-177547, 59-181353, 60-18951 and JU-A No. 62-25944 (the term "JU-A" as used herein means an "unexamined published Japanese utility model application").

The compound of formula (I) for use in this invention can be also used for a so-called color diffusion transfer silver halide photographic material which is developed using a processing solution at about room temperature. The color diffusion transfer process is described, e.g., in Belgian Patent No. 757,959. As the dye-providing material which can be used for the color diffusion transfer process, the compound of formula (I) wherein PUG is a diffusible dye can be used and also the compound shown by aforesaid formula (LI) can be used.

A suitable color diffusion transfer photographic element is described below.

The color diffusion transfer photographic element is preferably a film unit composed of a combination of a light-sensitive material (light-sensitive element) and a dye-fixing material (image-receiving element).

In a typical embodiment of the film unit, the aforesaid image-receiving element and light-sensitive element are formed in layers on a transparent support and after finishing the transferred image, it is unnecessary to peel off the light-sensitive element from the image-receiving element.

More practically, the image-receiving element is composed of at least one mordant layer and in a preferred embodiment, the light-sensitive element is composed of a combination of a blue-sensitive emulsion layer, a green-sensitive emulsion layer, and a red-sensitive emulsion layer, a combination of a green-sensitive emulsion layer, a red-sensitive emulsion layer, and an infrared-sensitive emulsion layer, or a combination of a blue-sensitive emulsion layer, a red-sensitive emulsion layer, and an infrared-sensitive emulsion layer, said emulsion layers being associated with a yellow dye-providing material, a magenta dye-providing material, and a cyan dye-providing material, respectively. In this case, the term "infrared-sensitive emulsion layer" means an emulsion layer having a light-sensitivity for light having wavelengths of 700 nm or longer, and in particular 740 nm or longer. Also, between the mordant layer and the light-sensitive layer or the dye-providing material-containing layer is formed a white reflecting layer containing a solid pigment such as titanium oxide, etc., for viewing the transferred images through the transparent support. In order to finish the development in a bright environment, a light-shading layer may be further formed between the white reflecting layer and the light-sensitive layer. Also, if desired, for peeling off the whole or a part of the light-sensitive element from the image-receiving element, a releasing layer may be formed at a proper position. Such an embodiment is described, e.g., in JP-A No. 56-67840 and Canadian Patent No. 674,082.

Also, in another non-peel-apart type embodiment, the aforesaid light-sensitive element is formed on a transparent support, a white reflecting layer is formed thereon, and further an image-receiving layer is formed on the white reflecting layer.

An embodiment wherein an image-receiving element, a white reflecting layer, a releasing layer, and the light-sensitive element are formed in layers on the same support and the light-sensitive element is intentionally separated from the image-receiving element is described in U.S. Pat. No. 3,730,718. On the other hand, as a typical embodiment wherein a light-sensitive element and an image-receiving element are separately formed on two different supports, respectively, there are generally a peel-apart type and a non-peel-apart type.

These two types are described below.

In a preferred embodiment of the peel-apart type film unit, a light reflecting layer is formed on the back surface of a support and at least one image-receiving layer is formed on the front surface of the support. Also, light-sensitive layer(s) may be formed on a support having a light-shading layer. Also, the light-sensitive element may be formed on a support having a light-shading layer and may be so designed that the coated layer of the light-sensitive layer does no face the coated surface of the mordant layer before finishing light exposure but after the light exposure (e.g., during development), the coated surface of the light-sensitive layer is turned t be superposed on the coated surface of the image-receiving layer. After finishing the transferred image on the mordant layer, the light-sensitive element is quickly peeled apart from the image-receiving element.

Furthermore, in a preferred embodiment of the non-peel-apart type film unit, at least a mordant layer is formed on a transparent support, a light-sensitive element is formed on a transparent support or a support having a light-shading layer, and the coated surface of the light-sensitive layer is superposed on the coated surface of the mordant layer.

In the aforesaid photographic element of a color diffusion transfer system may be incorporated a pressure-rupturable container (processing element) containing an alkaline processing solution. In a non-peel-apart-type film unit having the image-receiving element and the light-sensitive element on the same support, it is preferred that the aforesaid processing element is disposed between the light-sensitive element and a cove sheet formed thereon.

Also, in the embodiment wherein the light-sensitive element and the image-receiving element are separately formed on two supports, respectively, the processing element is disposed between the light-sensitive element and the image-receiving element at development.

It is preferred that the processing element contains a light-shading material (e.g., carbon black or a dye changing the color according to pH) and/or a white pigment (e.g., titanium oxide). Furthermore, in the film unit of a color diffusion transfer system, it is preferred that a neutralization timing mechanism composed of a combination of a neutralization layer and a timing layer be incorporated in the cover sheet, the image-receiving element, or the light-sensitive element.

The following examples are intended to illustrate the present invention but not to limit it in any way. Unless otherwise indicated, all parts, percents and the like are by weight.

EXAMPLE 1

A test element was prepared by successively coating the following layers (I) and (II) on a transparent polyethylene terephthalate support

Layer (I)

a) Gelatin dispersion of 0.27 mmol/m$^2$ of Compound 2 (reducible dye-providing material) of this invention and 0.4 g/m$^2$ of tricresyl phosphate.

b) Gelatin dispersion of 0.52 mmol/m2 of 1-phenyl-4-methyl-4 stearoyloxymethyl-3-pyrazolidone and 0.2 g/m$^2$ of tricresyl phosphate.

c) 0.22 g/m$^2$ of Guanidinetrichloroacetric acid.

d) 0.1 g/m$^2$ of Compound shown below

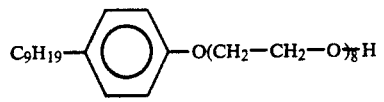

Layer (I) is a color material layer containing aforesaid components a) to d) and 1.2 g/m$^2$ of gelatin (including the gelatin contained in the aforesaid gelatin dispersions).

Layer (II)

a) Protective layer containing 0.37 g/m$^2$ of guanidinetrichloroacetic acid and 1 g/m$^2$ of gelatin.

The test element thus formed is defined as Sample 101. By following the same procedure as above except that Compounds 31, 21, 14, 3, 64, 63, 49, 65, 7, 22, and 61 described hereinbefore in the specification each was used in place of the dye-providing material (Compound 2) for Layer (I) in the same molar amount, Samples 102 to 112 were prepared.

An image-receiving sheet having a dye-fixing layer was prepared as follows.

In 200 ml of water was dissolved 10 g of poly(methyl acrylate-N,N,N-trimethyl-N-vinylbenzyl ammonium chloride) The molar ratio of methyl acrylate to vinylbenzyl ammonium chloride 1:1 and the solution was uniformly mixed with 100 g of an aqueous solution of 10% limed gelatin. The mixture was uniformly coated on a polyethylene terephthalate film at a wet thickness of 20 μm to provide an image-receiving sheet.

After heating each of the aforesaid sample elements 101 to 112 on a heat block heated at 140° C. for a definite period of time, 8 ml/m$^2$ of water was applied thereto, the sample element was superposed on the image-receiving sheet so that the coated layers faced each other, and after heating to 90° C. for 20 seconds to perform dye transfer, the image-receiving sheet was peeled apart. In this case, the reducible dye-releasing compound is reduced by the electron donating material by heating in the 1st stage to release a dye, whereby a high transferred dye concentration was obtained.

The heating time (T 50%) required to release half of the dye in the dye-providing material is shown in Table 1 together with the maximum attaining density (reflection).

TABLE 1

| Sample | Compound of Formula (I) | T50% (sec) | Maximum attaining density (reflection) |
|---|---|---|---|
| 101 | 2 | 18 | 1.68 (yellow) |
| 102 | 31 | 17 | 1.79 (magenta) |
| 103 | 21 | 19 | 1.80 (cyan) |
| 104 | 14 | 22 | 1.33 (yellow) |
| 105 | 3 | 24 | 1.38 (magenta) |
| 106 | 64 | 27 | 1.41 (cyan) |
| 107 | 63 | 12 | 1.97 (yellow) |
| 108 | 49 | 13 | 1.86 (magenta) |
| 109 | 65 | 13 | 2.01 (cyan) |
| 110 | 7 | 28 | 1.22 (yellow) |
| 111 | 22 | 31 | 1.05 (yellow) |
| 112 | 61 | 24 | 1.40 (yellow) |

From the results shown in Table 1, it can be seen that the dye-providing compounds in this invention can release a dye in a relatively short period of time and also the releasing rate of the dye can be easily controlled by the structure of the substituent.

EXAMPLE 2

Light-sensitive element (201) was prepared by coating the following layers on a transparent polyethylene tere- phthalate film support.

Layer (I)

a) Light-sensitive silver iodide emulsion (0.36 g/m$^2$-Ag)

b) Benzotriazole silver emulsion (0.18 g/m$^2$-Ag)

c) Gelatin dispersion of 0.27 mmol/m$^2$ of Compound in this invention and 1 g/m$^2$ of tricresyl phosphate d) Gelatin dispersion of 0.27 mmol/m2 of 1-phenyl-4-methyl-4-stearoyloxymethyl-3-pyrazolidone and 0.2 g/m$^2$ of tricresyl phosphate e) Base precursor having the following structure (0.44 g/m$^2$)

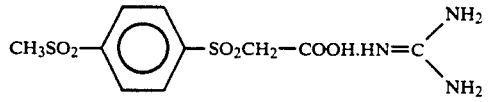

f) Compound of the following structure (0.1 g/m$^2$)

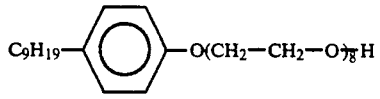

Layer (I) is a light-sensitive layer containing the aforesaid components a) to f) and 1.2 g/m$^2$ of gelatin including the gelatin contained in aforesaid components a) to d).

Layer (II)

a) A protective layer containing 0.74 g/m$^2$ of the aforesaid base precursor and 1 g/m$^2$ of gelatin.

By following the same procedure as above except that Compounds 31, 21, 14, 3, 64, 63, 49, and 65 each was used in place of Compound 2 in Layer (I) in the same molar amount, samples 202 to 209 were prepared. After exposing each of the samples to light, each sample was uniformly heated on a hot plate heated to 140° C. for 30 seconds. Then, after supplying 8 ml/m$^2$ of water onto the image-receiving sheet as in Example 1, the sheet was superposed onto the aforesaid light-sensitive element and after heating the assembly to 90° C. for 20 seconds, the image-receiving sheet was peeled apart to provide positive color images.

The photographic performance obtained by sensitometry was shown in Table 2 below.

TABLE 2

| Sample | Compound | Maximum density (reflection) | Minimum density |
|---|---|---|---|
| 201 | 2 | 1.78 | 0.27 |
| 202 | 31 | 1.75 | 0.32 |
| 203 | 21 | 1.70 | 0.28 |
| 204 | 14 | 1.20 | 0.22 |
| 205 | 3 | 1.31 | 0.19 |
| 206 | 64 | 1.39 | 0.23 |
| 207 | 63 | 1.90 | 0.50 |
| 208 | 49 | 1.92 | 0.40 |
| 209 | 65 | 1.89 | 0.41 |

EXAMPLE 3

Emulsion (I) for layer 1 in this example was prepared as follows.

To an aqueous gelatin solution (a solution of 20 g of gelatin and 3 g of sodium chloride in 1000 ml of water kept at 75° C.) were simultaneously added 600 ml of an aqueous solution of sodium chloride and potassium bromide and an aqueous silver nitrate solution (a solution of 0.59 mol of silver nitrate dissolved in 600 ml of water) with stirring at equi-flow rate over a period of 40 minutes. Thus, a mono-dispersed cubic silver chlorobromide emulsion (bromine 80 mol%) having a mean grain size of 0.35 μm was prepared. After washing and desalting, the emulsion was chemically sensitized with the addition of 5 mg of sodium thiosulfate and 20 mg of 4-hydroxy-6-methyl-1,3,3a,7-tetraazaindene at 60° C. The amount of the emulsion obtained was 600 g.

Emulsion (II) for layer 3 in this example was prepared as follows.

To an aqueous gelatin solution (a solution of 20 g of gelatin and 3 g of sodium chloride in 1000 ml of water kept at 75° C.) were simultaneously added 600 ml of an aqueous solution of sodium chloride and potassium bromide, an aqueous silver nitrate solution (a solution of 0.59 mol of silver nitrate dissolved in 600 ml of water) and a dye solution (I) shown below with stirring at equi-flow rate over a period of 40 minutes. Thus, a mono-dispersed cubic silver chlorobromide emulsion (bromide 80 mol%) having a mean grain size of 0.35 μm and having absorbed thereon 0.35 μm of dye was prepared.

After washing and desalting, the emulsion formed was chemically sensitized with the addition of 5 mg of sodium thiosulfate and 20 mg of 4-hydroxy-6-methyl-1,3,3a,7-tetraazaindene at 60° C. The amount of the emulsion obtained was 600 g.

Dye Solution (I)

Dye of the following structure 160 mg

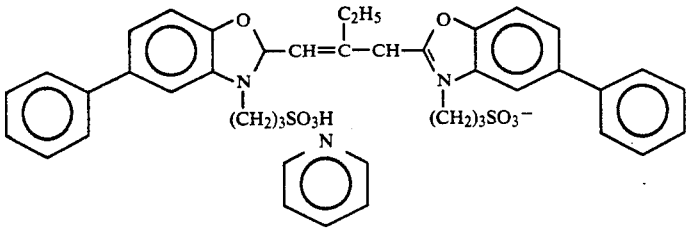

Emulsion (III) for layer 5was prepared as follows.

To an aqueous gelatin solution (a solution of 20 g of gelatin and ammonium dissolved in 1000 ml of water kept at 50° C.) were simultaneously added 1000 ml of an aqueous solution of potassium iodide and potassium bromide and an aqueous silver nitrate solution (a solution of 1 mol of silver nitrate dissolved in 1000 ml of water) with stirring while keeping a constant pAg. Thus, a monodispersed octahedral silver iodobromide emulsion (iodine 5 mol%) having a mean grain size of 0.5 μm was prepared.

After washing and desalting, the emulsion was gold- and sulfur-sensitized with the addition of 5 mg of chloro-auric acid (tetra-hydrate) and 2 mg of sodium thionitrate at 60° C. The amount of the emulsion was 1 kg.

Then, a gelatin dispersion of a dye-providing material was prepared as follows.

In 46 ml of cyclohexanone were dissolved 18 g of yellow dye-providing material Compound 2, 13 g of electron donating material (ED-1), and 9 g of tricyclohexyl phosphate at about 60° C. to form a homogeneous solution. The solution was mixed with 100 g of an aqueous solution of 10% limed gelatin, 60 ml of water and 1.5 g of sodium dodecylbenzenesulfonate with stirring and the mixture was dispersed by a homogenizer at 10,000 r.p.m. for 10 minutes. The dispersion is called a dispersion of yellow dye-providing material.

Dispersions of a magenta dye-providing material and a cyan dye-providing material were each prepared in the same manner as above using magenta dye-providing material Compound 31 or cyan dye-providing material Compound 21.

A multilayer color photographic material 301 having the layer construction shown below was prepared using the aforesaid components.

The support was a polyethylene terephthalate film 100 μm thick.

| | |
|---|---|
| Layer 1 Red-Sensitive Emulsion Layer | |
| Emulsion (I) | 0.36 g/m$^2$ as Ag |
| Sensitizing Dye (1)* | 1.07 × 10$^{-3}$ g/m$^2$ |
| Gelatin | 0.49 g/m$^2$ |
| Antifoggant (1)* | 1.25 × 10$^{-3}$ g/m$^2$ |
| Cyan Dye-Providing Material Compound (21) | 0.40 g/m$^2$ |
| High-Boiling Organic Solvent (1) | 0.20 g/m$^2$ |
| Electron Donating Material (ED-6) | 0.14 g/m$^2$ |
| Surface Active Agent (3)* | 0.04 g/m$^2$ |
| Electron Transmitting Agent (X-2) | 0.04 g/m$^2$ |
| Hardening Agent (1)* | 0.01 g/m$^2$ |
| Water-Soluble Polymer (2)* | 0.02 g/m$^2$ |
| Water-Soluble Polymer (3)* | 0.03 g/m$^2$ |
| Layer 2 Interlayer | |
| Gelatin | 0.80 g/m$^2$ |
| Zinc Hydroxide | 0.31 g/m$^2$ |
| Surface Active Agent (1)* | 0.06 g/m$^2$ |
| Surface Active Agent (4)* | 0.10 g/m$^2$ |
| Water-Soluble Polymer (2)* | 0.03 g/m$^2$ |
| Hardening Agent (1)* | 0.01 g/m$^2$ |
| Reducing Agent (1)* | 0.27 g/m$^2$ |
| Layer 3 Green-Sensitive Emulsion Layer | |
| Emulsion (II) | 0.41 g/m$^2$ as Ag |
| Gelatin | 0.47 g/m$^2$ |
| Antifoggant (1)* | 1.25 × 10$^{-3}$ g/m$^2$ |
| Magenta Dye-Providing Material Compound (31) | 0.37 g/m$^2$ |
| High-Boiling Organic Solvent (1)* | 0.19 g/m$^2$ |
| Electron Donating Material (ED-6) | 0.20 g/m$^2$ |
| Surface Active Agent (3)* | 0.04 g/m$^2$ |
| Electron Transmitting Agent (X-2) | 0.04 g/m$^2$ |
| Hardening Agent (1)* | 0.01 g/m$^2$ |
| Water-Soluble Polymer (3)* | 0.03 g/m$^2$ |
| Water-Soluble Polymer (2)* | 0.02 g/m$^2$ |
| Layer 4 Interlayer | |
| Gelatin | 0.75 g/m$^2$ |
| Zinc Hydroxide | 0.32 g/m$^2$ |
| Surface Active Agent (1)* | 0.02 g/m$^2$ |
| Surface Active Agent (4)* | 0.07 g/m$^2$ |
| Water-Soluble Polymer (2)* | 0.02 g/m$^2$ |
| Hardening Agent (1)* | 0.01 g/m$^2$ |
| Reducing Agent (1)* | 0.27 g/m$^2$ |
| Layer 5 Blue-Sensitive Emulsion Layer | |
| Emulsion (III) | 0.58 g/m$^2$ as Ag |
| Gelatin | 0.68 g/m$^2$ |
| Antifoggant (1)* | 0.36 × 10$^{-3}$ g/m$^2$ |
| Yellow Dye-Providing Material Compound (2) | 0.50 g/m$^2$ |
| High-Boiling Organic Solvent (1)* | 0.25 g/m$^2$ |
| Electron Donating Material (ED-1) | 0.35 g/m$^2$ |
| Surface Active Agent (3)* | 0.05 g/m$^2$ |

-continued

| | |
|---|---|
| Electron Transmitting Agent (X-2) | 0.04 g/m$^2$ |
| Hardening Agent (1)* | 0.01 g/m$^2$ |
| Water-Soluble Polymer (3)* | 0.03 g/m$^2$ |
| Water-Soluble Polymer (2)* | 0.02 g/m$^2$ |
| Layer 6 Protective Layer | |
| Gelatin | 0.91 g/m$^2$ |
| Matting Agent (silica) | 0.03 g/m$^2$ |
| Water-Soluble Polymer (1)* | 0.23 g/m$^2$ |
| Surface Active Agent (1)* | 0.06 g/m$^2$ |

-continued

| | |
|---|---|
| Surface Active Agent (2)* | 0.13 g/m$^2$ |
| Hardening Agent (1)* | 0.01 g/m$^2$ |
| Zinc Hydroxide $7H_2O$ | 0.06 g/m$^2$ |
| Back Layer | |
| Carbon Black | 0.44 g/m$^2$ |
| Polyester | 0.30 g/m$^2$ |
| Polyvinyl Chloride | 0.30 g/m$^2$ |

The compound used for preparing the aforesaid sample were as follows.

Water-soluble polymer (1)*: Sumika Get L-5(H) (trade name, made by Sumitomo Chemical Company, Limited)

Water-soluble polymer (2)*:

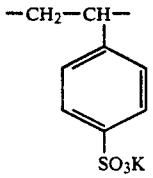

Water-soluble polymer (3)*:

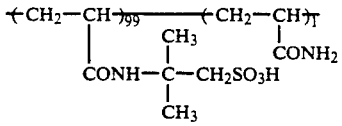

Surface active agent (1)*: Aerosol OT (trade name, made by WAKO PURE CHEMICAL INDUSTRIES)

Surface active agent (2)*:

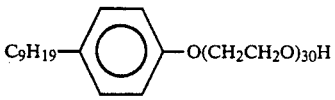

Surface active agent (3)*

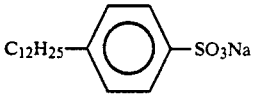

Surface active agent (4)*

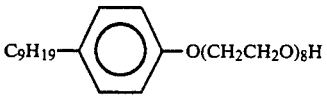

Hardening agent (1)*: 1,2-Bis(vinylsulfonyl-acetamido)ethane

Reducing agent (1)*:

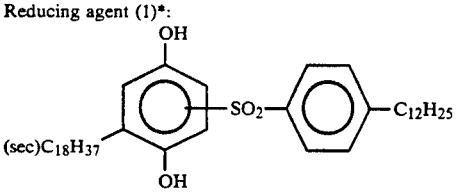

High-boiling organic solvent (1)*: Tricyclohexyl phosphate

Antifoggant (1)*:

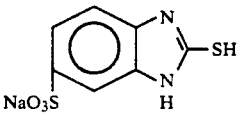

Sensitizing dye (1)*:

-continued

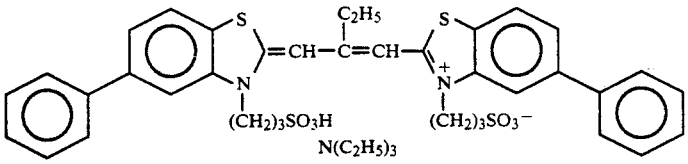

Also, by following the same procedure as above using the Compounds 14, 3, and 64 of formula (1) in place of the yellow dye-providing material Compound 2 for Layer 5, the magenta dye-providing material Compound 31 for Layer 3, and the cyan dye-providing material Compound 21 for Layer 1, respectively, a light-sensitive element 302 was prepared.

A dye-fixing material was prepared as follows.

In 1300 ml of water were dissolved 63 g of gelatin, 130 g of a mordant having the structure shown below, and 80 g of guanidine picolinate and the solution was coated on a polyethylene-coated paper support at a wet thickness of 45 μm and dried.

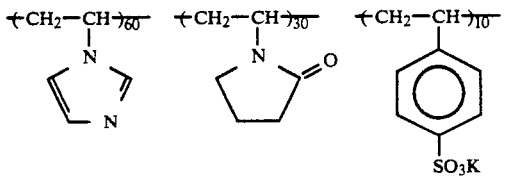

Furthermore, a solution of 35 g of gelatin and 1.05 g of a hardening agent, 1,2-bis(vinylsulfonylacetamido)ethane in 800 ml of water was coated on the aforesaid layer at a wet thickness of 17 μm and dried to provide a dye-fixing material.

Each of the aforesaid multilayer color photographic materials 301 and 302 was exposed for one second through a color decomposition filter of blue (B), green (G), red (R), and gray, each having continuously changing density using a tungsten lamp at 2,000 lux.

Onto the emulsion layer surface of the exposed color photographic material was supplied 15 ml/m$^2$ of water by a wire bar and thereafter, the color photographic material was superposed on the dye-fixing material such that the coated layers were in contact with each other.

The assembly was heated for 20 seconds using heat rollers the temperature of which was controlled such that the temperature of the heated layers became 85° C. Then, the dye-fixing material was peeled apart from the light-sensitive material to provide clear blue, green, red, and grey images corresponding to the color separation filter of blue, green, red and gray on the dye-fixing material.

The maximum density (Dmax) and the minimum density (Dmin) Of each image were measured and the results obtained are shown in Table 3.

TABLE 3

| Light-Sensitive Element | | $D_{max}$ | $D_{min}$ |
|---|---|---|---|
| 301 | B | 1.88 | 0.21 |
| | G | 1.91 | 0.22 |
| | R | 2.02 | 0.24 |
| 302 | B | 1.51 | 0.18 |
| | G | 1.44 | 0.20 |
| | R | 1.62 | 0.21 |

From the results in Table 3, it can be seen that good positive images having high maximum density and low minimum density are obtained.

EXAMPLE 4

A light-sensitive element 401 having the following layers on a transparent polyethylene terephthalate film support was prepared.

Layer (I)

A dye image-receiving layer containing;

a) Copoly[styrene-N-vinylbenzyl-N,N,N-trihexylammonium](4.0 g/m$^2$), and b) Gelatin (4.0 g/m2).

Layer (II)

A white-reflecting layer containing;

a) Titanium dioxide (22 9/m$^2$), and b) Gelatin (2.2 9/m$^2$).

Layer (III)

An opaque layer containing;

a) Carbon black (2.7 g/m$^2$), and b) Gelatin (2.7 9/m$^2$).

Layer (IV)

A cyan dye providinglayer containing;

a) Gelatin dispersion of 0.33 mmol/m$^2$ of the cyan dye providingcompound 65 in this invention and 0.4 mmol/m$^2$ of Compound SR-1*, and

SR-1*:

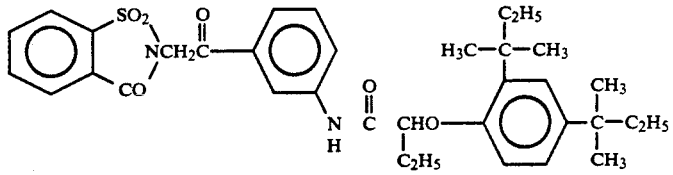

b) Gelatin (1.1 g/m$^2$) including the gelatin in the aforesaid gelatin dispersion.

Layer (V)

A red-sensitive emulsion layer containing;

a) Red-sensitive silver iodobromide emulsion (0.5 g/m$^2$ as Ag), and b) Gelatin (1.1 g/m$^2$) including the gelatin in the aforesaid emulsion a).

Layer (VI)

An interlayer containing;

a) 2, 5-Di(t-pentadecyl)hydroquinone (0.82 g/m$^2$), b) Vinyl acetate (0.8 g/m$^2$), and c) Gelatin (0.4 g/m$^2$).

Layer (VII)

A magenta dye-providing layer containing;

a) Gelatin dispersion of 0.3 mmol/m$^2$ of the magenta dye-providing compound 49 in this invention and 0.4 mmol/m$^2$ of the compound SR-1 (shown above), and (b) Gelatin (1.1 g/m$^2$) including the: gelatin in the aforesaid gelatin dispersion a).

Layer (VIII)

A green-sensitive emulsion layer containing;

a) Green-sensitive silver iodobromide emulsion (0.5 g/m$^2$ as Ag), and b) Gelatin (1.1 g/m$^2$) including the gelatin in the aforesaid emulsion a).

Layer (IX)

An interlayer having the same composition as Layer (VI).

Layer (X)

A yellow dye-providing layer containing;

a) Gelatin dispersion of 0.5 mmol/m$^2$ of the yellow dye-providing compound 63 in this invention and 0.6 mmol/m$^2$ of the compound SR-1 (shown above), and b) Gelatin (1.1 g/m$^2$) including the gelatin in the aforesaid gelatin dispersion a).

Layer (XI)

A blue-sensitive emulsion layer containing;

a) Blue-sensitive silver iodobromide emulsion (0.5 g/m$^2$ as Ag), and b) Gelatin (1.1 g/m$^2$) including the gelatin in the aforesaid emulsion a).

Layer (XII)

A protective layer containing;

a) Latex of polyethylene acrylate (0.9 g/m$^2$), b) Tinubin (produced by Ciba Geigy Corp.) (0.5 g/m$^2$), c) Triacryloyl perhydrotriazine, as hardening agent, (0.026 g/m$^2$), and d) Gelatin (1.3 g/m$^2$).

A cover sheet was prepared by successively coating the following layers on a transparent polyethylene terephthalate film support.

Layer (I)

An acid neutralizing layer containing;

a) Polyacrylic acid (17 g/m$^2$), b) N-Hydroxysuccinimidobenzenesulfonate (0.06 g/m$^2$), and c) Ethylene glycol (0.5 g/m$^2$).

Layer (II)

A timing layer formed by coating cellulose acetate (acetylation degree 54%) at a thickness of 2 μm.

Layer (III)

A timing layer formed by coating a copolymer latex of vinylidene chloride and acrylic acid at a thickness of 4 μm.

Also, a processing solution having the following composition was prepared.

| | |
|---|---|
| Potassium Hydroxide | 48 g |
| 4-Hydroxymethyl-4-methyl-1-p-tolyl-3-pyrazolidone | 10 g |
| 5-Methylbenzotriazole | 2.5 g |
| Sodium Nitrite | 1.5 g |
| Potassium Bromide | 1 g |
| Benzyl Alcohol | 1.5 ml |
| Carboxymethyl Cellulose | 6.1 g |
| Carbon Black | 150 g |
| Water to make | 1 liter |

After exposing the light-sensitive element 401 though a wedge, the aforesaid cover sheet was superposed thereon and the processing solution was uniformly spread therebetween at a thickness of 80 μm using a pair of juxtaposed rollers.

After one hour from processing, sensitometry was performed and the results thereof are shown in Table 4.

TABLE 4

| | B | G | R |
|---|---|---|---|
| Maximum Density | 2.05 | 1.98 | 2.00 |
| Minimum Density | 0.29 | 0.26 | 0.28 |

From the above results, it can be seen that good images having less turbidity at the background portions and high transferred dye density are obtained according to this invention.

EXAMPLE 5

A multilayer integrated type color diffusion transfer light-sensitive sheet and a cover sheet were prepared as follows.

Preparation of Light-Sensitive Sheet

Each of the light-sensitive sheets 501 to 506 was prepared by successively forming the following layers on a transparent polyethylene terephthalate film support.

(1) An image-receiving layer containing 3.0 g/m$^2$ of copoly[styrene-N-vinylbenzyl-N-methylpiperidinium chloride] and 3.0 g/m$^2$ of gelatin.

(2) A white reflecting layer containing 20 g/m$^2$ of titanium dioxide and 2.0 g/m$^2$ of gelatin.

(3) A light-shading layer containing 2.0 g/m$^2$ of carbon black and 1.5 g/m$^2$ of gelatin.

(4) A layer containing 0.44 g/m$^2$ of the cyan dye-releasing redox compound shown below, 0.09 g/m$^2$ of tricyclohexyl phosphate, 0.008 g/m$^2$ of 2,5-di-t-pentadecylhydro-quinone, and 0.8 g/m$^2$ of gelatin.

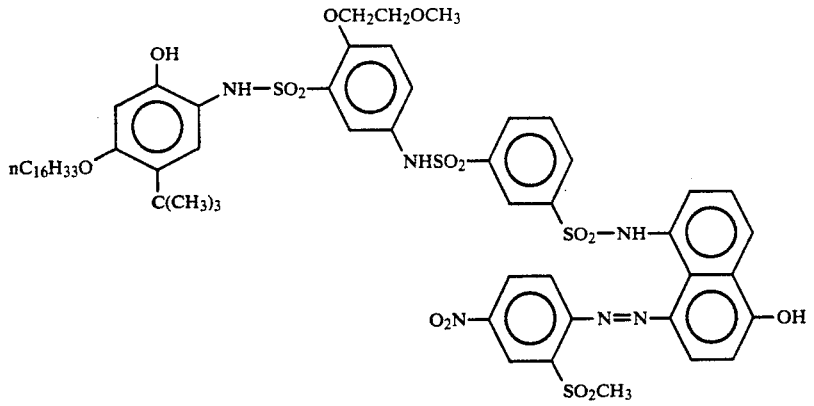

(5) A red-sensitive emulsion layer containing a red-sensitive internal latent image type direct positive silver bromide emulsion 1.03 g/m$^2$ as silver), 1.2 g/m$^2$ of gelatin, 0.04 mg/m$^2$ of a nucleating agent shown below, and 0.13 g/m$^2$ of 2-sulfo-5-n-pentadceylhydroquinone sodium salt.

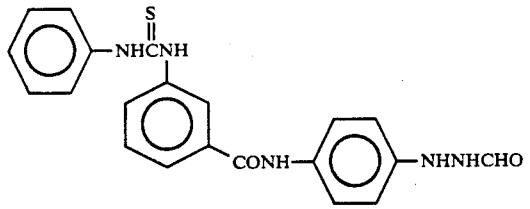

(6) A layer containing 0.43 g/m$^2$ of 2,5-di-t-pentadecylhydroquinone, 0.1 g/m$^2$ of trihexyl phosphate, and 0.4 g/m$^2$ of gelatin.

(7) A layer containing 0.3 g/m$^2$ of a magenta dye-releasing redox compound shown below, 0.08 g/m$^2$ of tricyclohexyl phosphate, 0.009 g/m$^2$ of 2,5-di-tert-pentadecyl-hydroquinone, and 0.5 g/m$^2$ of gelatin.

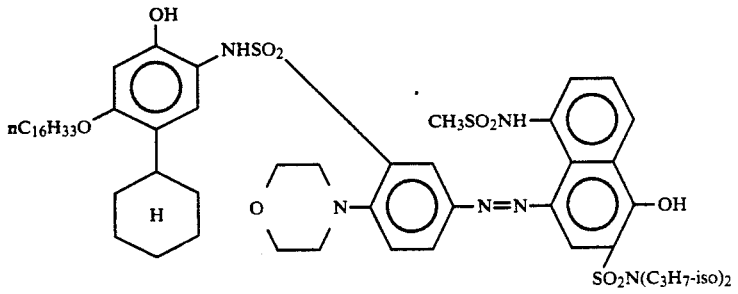

(8) A green-sensitive emulsion layer containing a green-sensitive internal latent image type direct positive silver bromide emulsion (0.82 g/m$^2$ as silver), 0.03 mg/m$^2$ of the nucleating agent as used for Layer (5) above, and 0.08 g/m$^2$ of 2-sulfo-5-n-pentadecylhydroquinone-sodium salt.

(9) A layer having the same composition as Layer (6).

(10) A layer containing 0.53 g/m$^2$ of a yellow dye-releasing redox compound shown below, 0.13 g/m$^2$ of tricyclohexyl phosphate, 0.014 g/m$^2$ of 2,5-di-t-pentadecylhydroquinone, and 0.7 g/m$^2$ of gelatin.

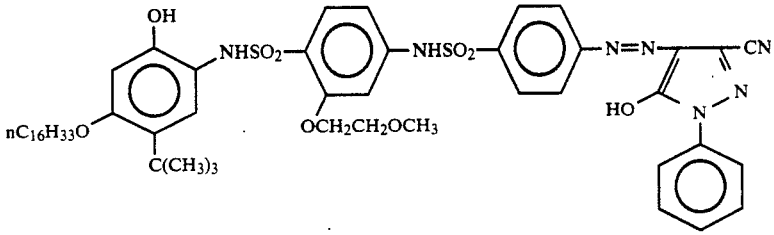

(11) A blue-sensitive emulsion layer containing a blue-sensitive internal latent image type direct positive silver bromide emulsion (1.09 g/m$^2$ as silver), 1.1 g/m$^2$ of gelatin, 0.04 g/m$^2$ of a nucleating agent as used for Layer (5), 0.07 g/m$^2$ of 2-sulfo-5-n-pentadecylhdyroquinone, and the compound shown in Table 5 below in the amount also shown in the same table.

(12) An ultraviolet absorption layer containing 4×10 mol/m$^2$ of each of the ultraviolet absorbents shown below and 0.30 g/m$^2$ of gelatin.

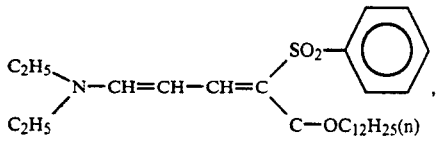

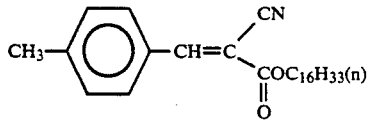

(13) A protective layer containing 0.10 g/m$^2$ of polymethyl methacrylate latex (mean particle size of 4 μm), 0.8 g/m$^2$ of gelatin, and 0.02 g/m$^2$ of triacryloyltriazine as a hardening agent.

Construction of Cover Sheet A

A cover sheet was prepared by successively forming the following layers (1') to (4') on a transparent polyethylene terephthalate film support.

(1') A neutralizing layer containing 10 g/m$^2$ of a copolymer of acrylic acid and butyl acrylate (8:2 by weight ratio) having an average molecular weight of 50,000 and 0.2 g/m$^2$ of 1,4-bis(2,3-epoxypropoxy)-butane.

(2') A 2nd timing layer containing 7.5 g/m$^2$ of cellulose acetate (acetylation degree 51.0%) and a methyl vinyl ether-maletic acid monomethyl ester alternating copolymer at 95:5 by weight ratio.

(3') An auxiliary neutralizing layer containing 1.05 g/m$^2$ of a methyl vinyl ether-maleic anhydride alternating copolymer and 0.98 mmol/m$^2$ of 5-(2-cyano-1-methylthio)-1-phenyltetrazole.

(4') A 1st timing layer formed by coating thereon a copolymer latex of styrene, n-butyl acrylate, acrylic. acid, and N-methylolacrylamide (49.7:42.3:3:5 by weight ratio) and a copolymer latex of methyl methacrylate, acrylic acid, and N-methylolacrylamide (93:4:3 by weight at a thickness of 2 μm such that the solid component ratio of the former latex to the latter latex became 6:4.

| Composition of Processing Solution A | |
|---|---|
| 1-p-Tolyl-4-hydroxymethyl-4-methyl-3-pyrazolidone | 14 g |
| Methylhydroquinone | 0.3 g |
| 5-Methylbenzotriazole | 3.5 g |
| Sodium Sulfite (anhydrous) | 0.2 g |
| Carboxymethyl Cellulose Sodium Salt | 58 g |
| Potassium Hydroxide (28% aq. soln.) | 200 ml |
| Benzyl Alcohol | 1.5 ml |
| Carbon Black | 150 g |
| Water | 685 ml |

After exposing each of the light-sensitive sheets 501 to 506 through a continuous wedge, the light-sensitive sheet was combined with the processing solution and the cover sheet, and the processing solution was uniformly spread between the two sheets by a pair of juxtaposed pressure rollers. After one hour, the blue (B) density of each color image was measured by a color densitometer and $D_{max}$ and $D_{min}$ obtained are shown in Table 5 below.

TABLE 5

| Sample No. | Compound of formula (I) | Amount (mol/m$^2$) | $D_{max}$ (B) | $D_{min}$ (B) | Transfer Rate T50% (sec) | Remarks |
|---|---|---|---|---|---|---|
| 501 | None | 0 | 1.88 | 0.37 | 107 | Comparison |
| 502 | Comparison compound A | $5.0 \times 10^{-5}$ | 1.70 | 0.27 | 145 | Comparison |
| 503 | Compound 6 | $1.4 \times 10^{-4}$ | 1.88 | 0.26 | 108 | Invention |
| 504 | Compound 54 | $1.4 \times 10^{-4}$ | 1.86 | 0.24 | 110 | Invention |
| 505 | Compound 66 | $1.4 \times 10^{-4}$ | 1.88 | 0.27 | 108 | Invention |
| 506 | Compound 67 | $1.4 \times 10^{-4}$ | 1.87 | 0.27 | 107 | Invention |

Comparison compound A

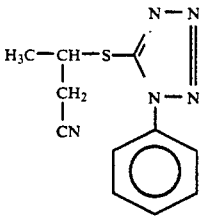

Also, immediately after spreading the processing solution, the change of $D_{max}$ was measured every 5 seconds and the time required for reaching ½ of the density ($D_{max}$) after 60 minutes was shown in the table as the transfer rate (T50%). The faster, the better.

The results obtained are shown in Table 5.

As is clear from the results shown in Table 5, it can be seen that the photographic elements using the light-sensitive sheets of this invention show very low $D_{min}$ without reducing $D_{max}$ and further, without delaying the transfer rate.

In addition, it has been also clarified by other analytical experiments that the difference in transfer rate corresponds to the difference in silver developing rate. In other words, the delay in the transfer rate is based on the delay in the silver developing rate.

EXAMPLE 6

Preparation of Silver Halide Emulsion

According to an ordinary ammonium method, a silver iodobromide emulsion (AgI: 2 mol%) having a mean grain size of 1.0 μm was prepared by adding an aqueous silver nitrate solution and an aqueous solution of alkali halides to an aqueous gelatin solution and after desalting the emulsion by an ordinary flocculation method and applying gold- and sulfur-sensitization using chloroauric acid and sodium thiosulfate, 4-hydroxy-6-methyl-1,3,3a,7-tetraazaindene was added thereto as a stabilizer to provide a light sensitive silver iodobromide emulsion. To the emulsion thus prepared was added each of the comparison compound and the compounds in this invention shown in Table 6 below and then each emulsion was coated and dried to provide Samples 601 to 605.

Each of the samples was stepwise exposed through an optical wedge using sensitometry, processed by an automatic processor RU (made by Fuji Photo Film Co., Ltd.) using the following developer A and fix solution A for 90 seconds at a processing temperature of 35° C. or 37° C., and the photographic performance was measured. The results obtained are shown in Table 6 below.

| | |
|---|---|
| Developer A | |
| Ethylenediaminetetraacetic Acid | 1.2 g |
| Sodium Sulfite (anhydrous) | 50 g |
| Potassium Hydroxide | 20.0 g |
| Hydroquinone | 25.0 g |
| 1-phenyl-3-pyrazolidone | 1.5 g |
| Boric Acid | 10.0 g |
| Triethylene Glycol | 25.0 g |
| Glutaraldehyde | 5.0 g |
| Potassium Bromide | 6.0 g |
| Glacial Acetic Acid | 3.0 g |
| Sodium Hydrogensulfite (anhydrous) | 4.5 g |
| 5-Nitroindazole | 0.15 g |
| 5-Methylbenzotriazole | 0.03 g |
| Water to make | 1.0 liter |
| The pH value was adjusted to about 10.30 at 25° C. | |
| Fixing Solution A | |
| Ammonium Thiosulfate | 200.0 g |
| Sodium Sulfite (anhydrous) | 20.0 g |
| Boric Acid | 8.0 g |
| Ethylenediaminetetraacetic Acid | 0.1 g |
| Aluminum Sulfate | 15.0 g |
| Sulfuric Acid | 2.0 g |
| Glacial Acetic Acid | 22.0 g |
| Water to make | 1.0 liter |
| The pH value was adjusted to about 4.10 at 25° C. | |

TABLE 6

| Sample No. | Compound of formula (I) | Amount (mol/mol-Ag) | Fog 35° C. | Fog 37° C. | Relative Sensitivity 35° C. | Relative Sensitivity 37° C. |
|---|---|---|---|---|---|---|
| 601 | — | — | 0.17 | 0.20 | 100 | 149 |
| 602 | PMT* (Comparison) | $3.70 \times 10^{-4}$ | 0.13 | 0.13 | 75 | 108 |
| 603 | 6 | $3.70 \times 10^{-4}$ | 0.14 | 0.15 | 98 | 140 |
| 604 | 54 | $3.70 \times 10^{-4}$ | 0.13 | 0.14 | 92 | 139 |
| 605 | 66 | $3.70 \times 10^{-4}$ | 0.15 | 0.18 | 99 | 146 |

*PMT: 1-Phenyl-5-mercaptotetrazole

The sensitivity in Table 6 above is a reciprocal of the exposure amount required for obtaining a density of fog +1.0 and is shown by the relative value with that of Sample 601 at the development temperature of 35° C. being defined as 100.

Also, the fog value in Table 6 is a value including the base density.

As is clear from the results shown in the table, it can be seen that Samples 603 to 605 using the compounds of formula (I) of this invention effectively inhibit the formation of fog without lowering the sensitivity as compared to Sample 602 using the comparison compound.

Thus, it is shown that the compound of formula (I) of this invention always provides a stable and high-quality photographic performance by restraining the formation of fog without reducing the sensitivity.

EXAMPLE 7

A multilayer color photographic material (Sample 701) having the layers of the following compositions on a cellulose triacetate film support having gelatin subbing layer was prepared.

The coating amount was shown as a g/m$^2$ unit as silver for silver halide, silver halide emulsion, and colloidal silver, a g/m$^2$ unit for coupler, additives, and gelatin, and mol number per mol of silver halide in the same layer for sensitizing dyes.

| | |
|---|---|
| Layer 1 Antihalation layer | |
| Black Colloidal Silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| Layer 2 Interlayer | |
| Fine Grain Silver Bromide (mean grain size 0.07 μm) | 0.10 |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |
| Layer 3 1st Red-Sensitive Emulsion Layer | |
| Silver Iodobromide Emulsion (AgI 2 mol %, internal high AgI content type sphere-corresponding diameter 0.3 μm, coeff. of variation of sphere-corresponding diameter 29%, normal crystal, grains, twin mixed aspect ratio 2.5) | 0.4 |
| Gelatin | 0.6 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.06 |
| ExC-4 | 0.06 |
| ExC-7 | 0.04 |
| ExC-2 | 0.03 |
| Solv-1 | 0.03 |
| Solv-3 | 0.012 |
| Layer 4 2nd Red-Sensitive Emulsion Layer | |
| Silver Iodobromide Emulsion (AgI 5 mol %, internal high AgI content type, sphere-corresponding diameter 0.7 μm, coeff. of variation of sphere-corresponding diam. 25%, normal crystal, twin mixed grains, aspect ratio 4) | 0.7 |
| Gelatin | 0.5 |
| ExS-1 | $1 \times 10^{-4}$ |
| ExS-2 | $3 \times 10^{-4}$ |
| ExS-3 | $1 \times 10^{-3}$ |
| ExC-3 | 0.24 |

-continued

| | |
|---|---|
| ExC-4 | 0.24 |
| ExC-7 | 0.04 |
| ExC-2 | 0.04 |
| Solv-1 | 0.15 |
| Solv-3 | 0.02 |
| Layer 5 3rd Red-Sensitive Emulsion Layer | |
| Silver Iodobromide Emulsion (AgI 10 mol %, internal high AgI content type, sphere-corresponding diam. 0.8 μm, coeff. of variation of sphere-corresponding diam. 16%, normal crystal, twin mixed grains, aspect ratio 1.3) | 1.0 |
| Gelatin | 1.0 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-6 | 0.1 |
| Solv-1 | 0.01 |
| Solv-2 | 0.05 |
| Layer 6 Interlayer | |
| Gelatin | 1.0 |
| Cpd-1 | 0.03 |
| Solv-1 | 0.05 |
| Layer 7 1st Green-Sensitive Emulsion Layer | |
| Silver Iodobromide Emulsion (AgI 2 mol %, internal high AgI content type, sphere-corresponding diam. 0.3 μm, coeff. of variation of sphere-corresponding diam. 28%, normal crystal, twin mixed grains, aspect ratio 2.5) | 0.30 |
| ExS-4 | $5 \times 10^{-4}$ |
| ExS-6 | $0.3 \times 10^{-4}$ |
| ExS-5 | $2 \times 10^{-4}$ |
| Gelatin | 1.0 |
| ExM-9 | 0.2 |
| ExY-14 | 0.03 |
| ExM-8 | 0.03 |
| Solv-1 | 0.5 |
| Layer 8 2nd Green-Sensitive Emulsion Layer | |
| Silver Iodobromide Emulsion (AgI 4 mol %, internal high AgI content type, sphere-corresponding diam. 0.6 μm, coeff. of variation of sphere-corresponding diam. 38%, normal crystal, twin mixed grains, aspect ratio 4) | 0.4 |
| Gelatin | 0.5 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |
| Layer 9 3rd Green-Sensitive Emulsion Layer | |
| Silver Iodobromide Emulsion (AgI 6 mol %, internal high AgI content type, sphere-corresponding diam. 1.0 μm, coeff. of variation 80%, normal crystal, twin mixed grains, aspect ratio 1.2) | 0.85 |
| Gelatin | 1.0 |
| ExS-7 | $3.5 \times 10^{-4}$ |

-continued

| | |
|---|---|
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |
| Layer 10 Yellow Filter Layer | |
| Gelatin | 1.2 |
| Yellow Colloidal Silver | 0.08 |
| Cpd-2 | 0.1 |
| Solv-1 | 0.3 |
| Layer 11 1st Blue-Sensitive Emulsion Layer | |
| Silver Iodobromide Emulsion (AgI 4 mol %, internal high AgI content type, sphere-corresponding diam. 0.5 μm, coeff. of variation of sphere-corresponding diam. 15%, octahedral grains) | 0.4 |
| Gelatin | 1.0 |
| ExS-9 | $2 \times 10^{-4}$ |
| ExY-16 | 0.9 |
| ExY-14 | 0.07 |
| Solv-1 | 0.2 |
| Layer 12 2nd Blue-Sensitive Emulsion Layer | |
| Silver Iodobromide Emulsion (AgI 10 mol %, internal high AgI content type, sphere-corresponding diam. 1.3 μm, coeff. of variation of sphere-corresponding diam. 25%, normal crystal, twin mixed grains, aspect ratio 4.5) | 0.5 |
| Gelatin | 0.6 |
| ExS-9 | $1 \times 10^{-4}$ |
| ExY-16 | 0.25 |
| Solv-1 | 0.07 |
| Layer 13 1st Protective Layer | |
| Gelatin | 0.8 |
| UV-1 | 0.1 |
| UV-2 | 0.2 |
| Solv-1 | 0.01 |
| Solv-2 | 0.01 |
| Layer 14 2nd Protective Layer | |
| Fine Grain Silver Bromide (mean grain size 0.07 μm) | 0.5 |
| Gelatin | 0.45 |
| Polymethyl Methacrylate Particles (diameter 1.5 μm) | 0.2 |
| H-1 | 0.4 |
| Cpd-3 | 0.5 |
| Cpd-4 | 0.5 |

Each layer further contained a surface active agent represented by the following structural formula as a coating aid. Thus, Sample 701 was prepared.

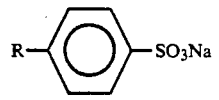

The compounds used for the sample were as follows.

UV-1

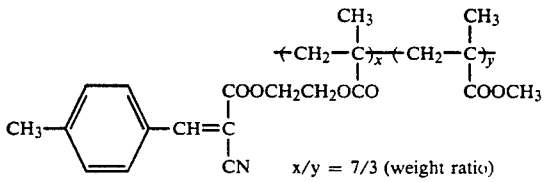

x/y = 7/3 (weight ratio)

UV-2

-continued
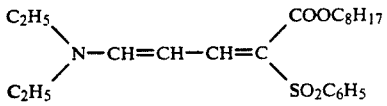
Solv-1: Tricresyl phosphate
Solv-2: Dibutyl phthalate
Solv-3: Bis(2-ethylhexyl) phthalate
ExM-8
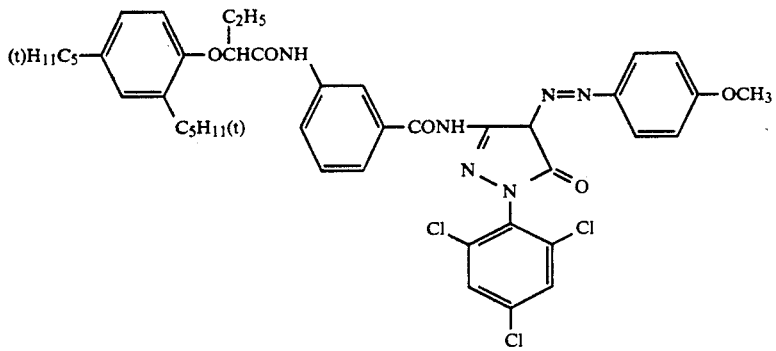
ExF-1
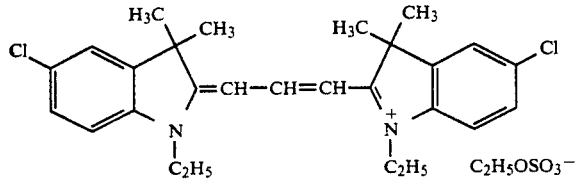
ExC-2
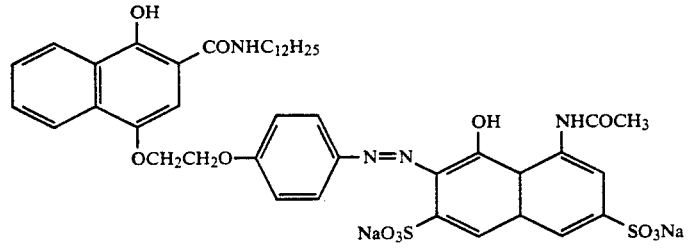
ExC-3
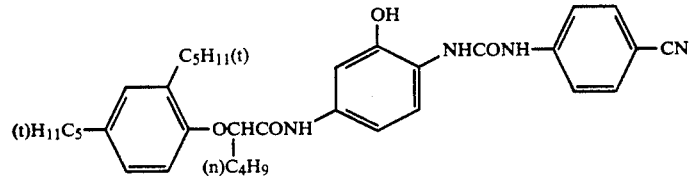
ExC-4
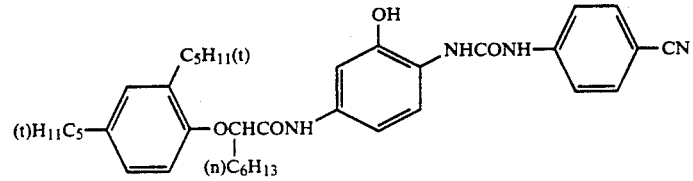
ExY-14

-continued
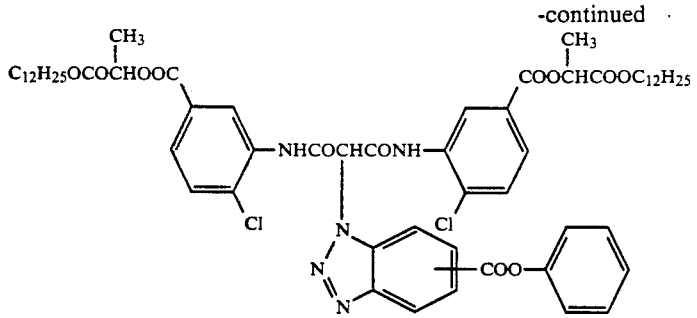
ExY-15
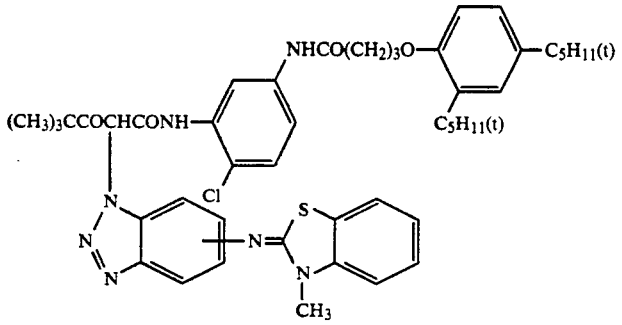
ExC-5
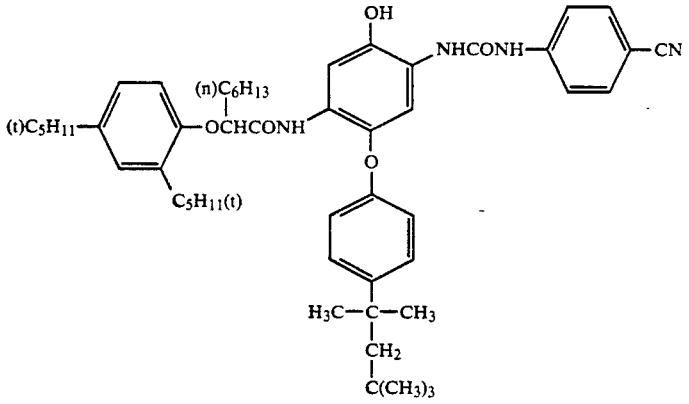
ExC-6
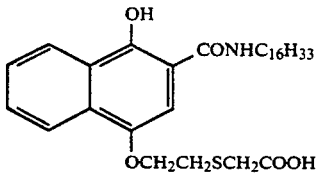
ExC-7
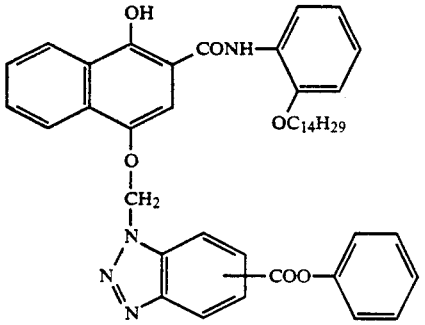
ExM-9

-continued
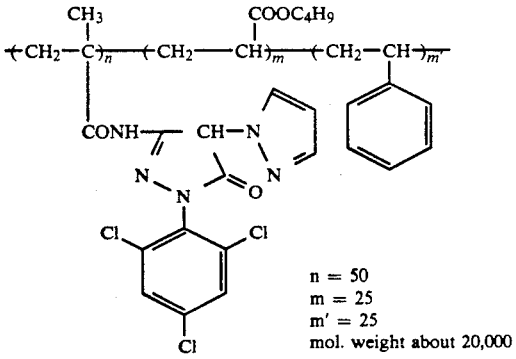
ExM-10
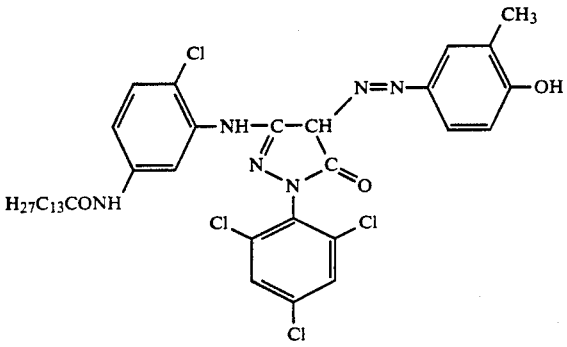
ExM-11
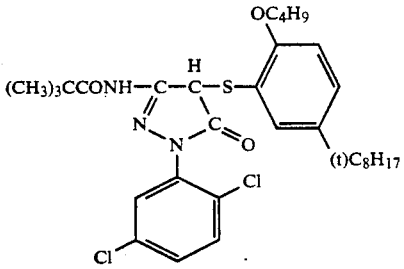
ExM-12
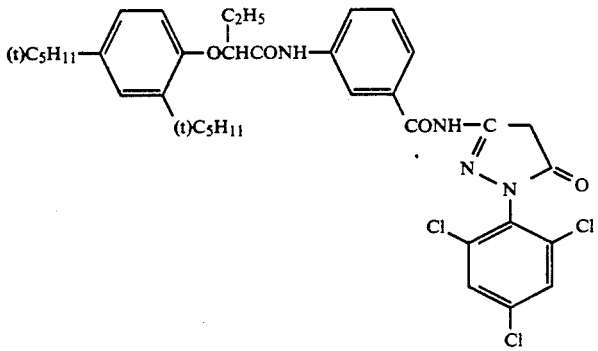
ExM-13

-continued
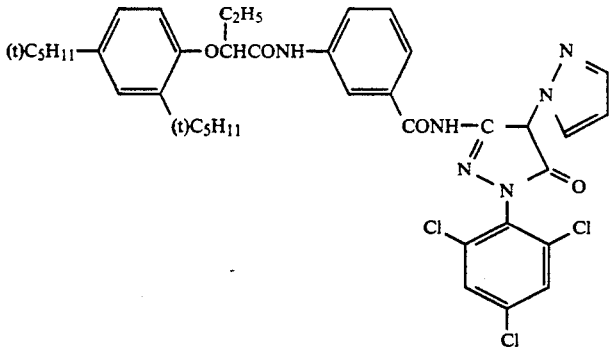
ExY-16
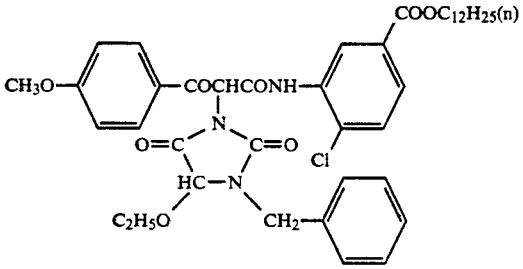
Cpd-1
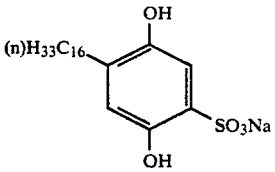
Cpd-2
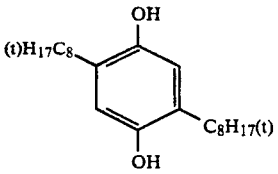
ExS-1
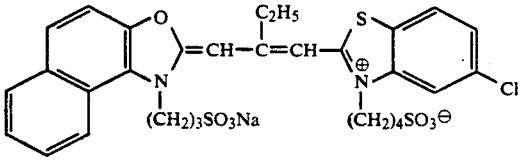
ExS-2
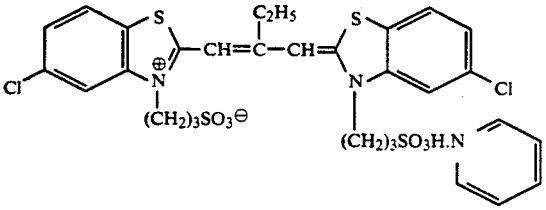
ExS-3

-continued
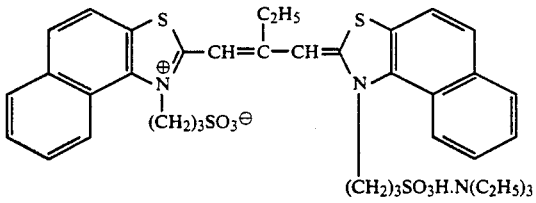
ExS-4
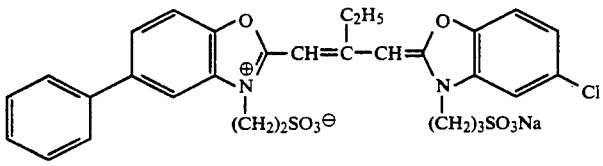
ExS-5
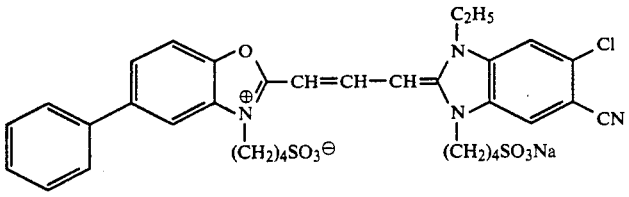
ExS-6
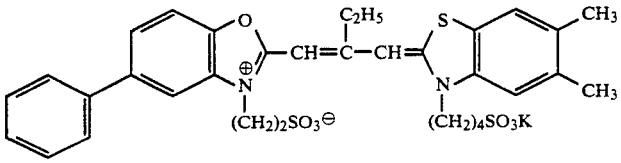
ExS-7
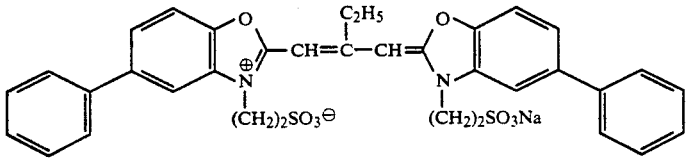
ExS-8
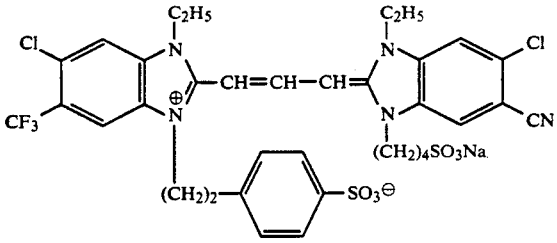
ExS-9
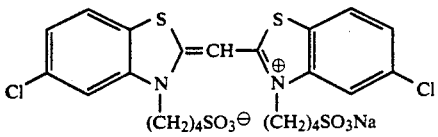
H-1
$CH_2{=}CH{-}SO_2{-}CH_2{-}CONH{-}CH_2$
$CH_2{=}CH{-}SO_2{-}CH_2{-}CONH{-}CH_2$
Cpd-3

-continued

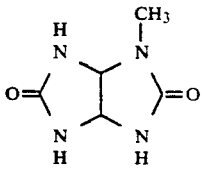

Cpd-4

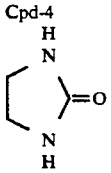

Preparation of Samples 702 to 704

By following the same procedure as the case of preparing Sample 701 except that each of the comparison compound, the compound of formula (I) in this invention, and ED-2 shown in Table 7 below was added to Layer 5 of Sample 701 in an amount shown in the same table, Samples 702 to 704 were prepared.

Each of the samples was imagewise exposed at a color temperature of 4800° K. controlled using a filter so that the maximum exposure amount became 10 CMS and the processed by the following steps.

| Processing Step | Processing time | Temperature |
|---|---|---|
| Color Development | 3 min. 15 sec. | 38° C. |
| Bleach | 6 min. 30 sec. | 38° C. |
| Wash | 2 min. 10 sec. | 24° C. |
| Fix | 4 min. 20 sec. | 38° C. |
| Wash (1) | 1 min. 05 sec. | 24° C. |
| Wash (2) | 2 min. 10 sec. | 24° C. |
| Stabilization | 1 min. 05 sec. | 38° C. |
| Drying | 4 min. 20 sec. | 55° C. |

The processing solutions used in the aforesaid steps are shown below.

| | |
|---|---|
| Color Developer | |
| Diethylenetriaminepentaacetic Acid | 1.0 g |
| 1-Hydroxyethlidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| pH | 10.05 |
| Bleach Solution | |
| Ethylenediaminetetraacetic Acid Ferric Sodium Tri-hydrate | 100.0 g |
| Ethylenediaminetetraacetic Acid Di-sodium Salt | 10.0 g |
| Ammonium Bromide | 140.0 g |
| Ammonium Nitrate | 30.0 g |
| Aqueous Ammonia (27%) | 6.5 ml |
| Water to make | 10 liter |
| pH | 6.0 |
| Fix Solution | |
| Ethylenediaminetetraacetic Acid Di-sodium Salt | 0.5 g |
| Sodium Sulfite | 7.0 g |
| Sodium Hydrogensulfite | 5.0 g |
| Aqueous solution of Ammonium Thiosulfate (70%) | 170.0 ml |
| Water to make | 1.0 liter |

-continued

| | |
|---|---|
| pH | 6.7 |
| Stabilizer | |
| Formalin (37%) | 2.0 ml |
| Polyoxyethylene-p-monononylphenyl Ether (mean degree of polymerization 10) | 0.3 g |
| Ethylenediaminetetraacetic Acid Di-sodium Salt | 0.05 g |
| Water to make | 1.0 liter |
| pH | 5.0 to 8.0 |

The results obtained are shown in Table 7 below. In Table 7:

| | |
|---|---|
| $\Delta S_{0.2}$: | The changed amount of the logarithmic amount of the exposure amount E giving a density of the fog of cyan density +0.2 to Sample 701. |
| $\Delta D_{min}$: | Changed amount of the cyan minimum density to Sample 701 |
| PMT: | 1-Phenyl-5-mercaptotetrazole |
| ED-2: | 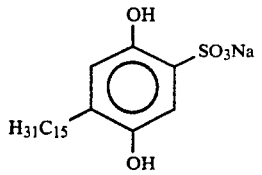 |

TABLE 7

| Sample No. | Compound of formula (I) | Addition Amount (mol/mol Ag) | ED-2**** Addition Amount (mol/mol Ag) | * $\Delta S_{0.2}$ | ** $\Delta D_{min}$ |
|---|---|---|---|---|---|
| 701 | None | 0 | 0 | ±0 | ±0 |
| 702 | PMT*** | $1.6 \times 10^{-4}$ | 0 | −0.32 | −0.05 |
| 703 | 6 | $8.0 \times 10^{-4}$ | $8.0 \times 10^{-4}$ | −0.03 | −0.04 |
| 704 | 54 | 8.0 × 10−4 | 8.0 × 10−4 | −0.05 | −0.05 |

As is clear from the results shown in Table 7 above, it can be seen that Samples 703 and 704 using the antifoggant-releasing compound in this invention and a suitable reducing agent reduce the formation of fog without reducing sensitivity.

EXAMPLE 8

A multilayer color photographic paper (Sample 801) were prepared having the following layers on a paper support, both surfaces of which were coated with polyethylene. In addition, the coating solutions were prepared as follows.

Preparation of the Coating Solution for Layer 1

In 27.2 ml of ethyl acetate and 7.7 ml (8.0g) of a high-boiling solvent (Solv-1) were dissolved 10.2 g and 9.1 g of yellow couplers (ExY-1) and (ExY-2), respectively, and 4.4 g of a color image stabilizer (Cpd-2) and the solution was dispersed by emulsification in 185 ml of an aqueous 10% gelatin solution containing 8 ml of an aqueous solution of 10% sodium dodecylbenzenesulfonate. The emulsified dispersion was mixed with Emulsion EM1 and Emulsion EM2 and then the gelatin concentration was controlled as shown below to provide a coating composition for Layer 1.

The coating solutions for Layer 2 to Layer 7 were also prepared in a similar manner to the aforesaid method.

For each layer was used 1-oxy-3,5-dichloro-s-triazine as a gelatin hardening agent. Also, (Cpd-1) was used as a thickener.

In the following compositions, the numerals are the coating amounts (g/m$^2$), wherein the coating amount for a silver halide emulsion was shown as the calculated amount of silver.

Also, the support was a polyethylene-coated paper containing a white pigment ($TiO_2$) in the polyethylene coating at the emulsion side.

| | |
|---|---|
| Layer 1 Blue-Sensitive Emulsion Layer | |
| Monodispersed Silver Chlorobromide Emulsion (EM1) spectrally sensitized by Sensitizing Dye (ExS-1) | 0.13 |
| Monodispersed Silver Chlorobromide Emulsion (EM2) spectrally sensitized by Sensitizing Dye (ExS-1) | 0.13 |
| Gelatin | 1.86 |
| Yellow Coupler (ExY-1) | 0.44 |
| Yellow Coupler (ExY-2) | 0.39 |
| Color Image Stabilizer (Cpd-2) | 0.19 |
| Solvent (Solv-1) | 0.35 |
| Dispersion Polymer (Cpd-12) | 0.21 |
| Color Image Stabilizer (Cpd-19) | 0.01 |
| Layer 2 Color Mixing Preventing Layer | |
| Gelatin | 0.99 |
| Color Mixing Preventing Agent (Cpd-3) | 0.08 |
| Layer 3 Green-Sensitive Emulsion Layer | |
| Monodispersed Silver Chlorobromide Emulsion (EM3) spectrally sensitized by Sensitizing Dyes (ExS-2, and ExS-3) | 0.05 |
| Monodispersed Silver Chlorobromide Emulsion (EM4) spectrally sensitized by Sensitizing Dyes (ExS-2 and ExS-3) | 0.11 |
| Gelatin | 1.80 |
| Magenta Coupler (ExM-1) | 0.39 |
| Color Image Stabilizer (Cpd-4) | 0.20 |
| Color Image Stabilizer (Cpd-5) | 0.02 |
| Color Image Stabilizer (Cpd-6) | 0.03 |
| Solvent (Solv-2) | 0.12 |
| Solvent (Solv-3) | 0.25 |
| Layer 4 Ultraviolet Absorption Layer | |
| Gelatin | 1.60 |
| Ultraviolet Absorbents (Cpd-7/Cpd-9/Cpd-17 = 3/2/6 by weight ratio) | 0.70 |
| Color Mixing Preventing Agent (Cpd-11) | 0.05 |
| Solvent (Solv-4) | 0.27 |
| Layer 5 Red-Sensitive Emulsion Layer | |
| Monodispersed Silver Chlorobromide Emulsion (EM5) spectrally sensitized by Sensitizing Dyes (ExS-4 and ExS-5) | 0.07 |
| Monodispersed Silver Chlorobromide Emulsion (EM6) spectrally sensitized by Sensitizing Dyes (ExS-4 and ExS-5) | 0.16 |
| Gelatin | 0.92 |
| Cyan Coupler (ExC-1) | 0.16 |
| Cyan Coupler (ExC-2) | 0.16 |
| Color Image Stabilizers (Cpd-8/Cpd-9/Cpd-10 = 3/4/2 by weight ratio) | 0.17 |
| Dispersion Polymer (Cpd-12) | 0.28 |
| Solvent (Solv-2) | 0.15 |
| Solvent (Solv-5) | 0.10 |
| Color Image Stabilizer (Cpd-19) | 0.02 |
| Layer 6 Ultraviolet Absorption Layer | |
| Gelatin | 0.54 |
| Ultraviolet Absorbents (Cpd-7/Cpd-8/Cpd-9 = 1/5/3 by weight ratio) | 0.21 |
| Solv (Solv-5) | 0.08 |
| Layer 7 Protective Layer | |
| Acid-Treated Gelatin | 1.33 |
| Acryl-Modified Copolymer of Polyvinyl Alcohol (modification degree 17%) | 0.17 |
| Fluid Paraffin | 0.03 |

Also, in this case, Cpd-13 and Cpd-14 were used in each emulsion layer as irradiation preventing dyes.

Furthermore, for each layer were used Alkanol XC (trade name, made by Du Pont), sodium alkylbenzenesulfonate, succinic acid ester, and Magefacx F-120 (trade name, made by Dainippon Ink and Chemicals, Inc.) as emulsion-dispersing agents and coating aids. Also, Cpd-15, Cpd-16 and Cpd-18 were used in each emulsion layer as stabilizers for silver halide.

The compounds used for preparing the aforesaid sample were as follows.

ExS-1

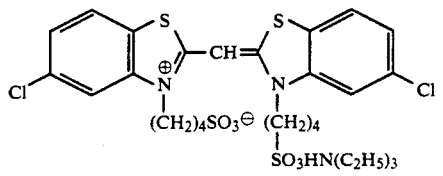

ExS-2

-continued
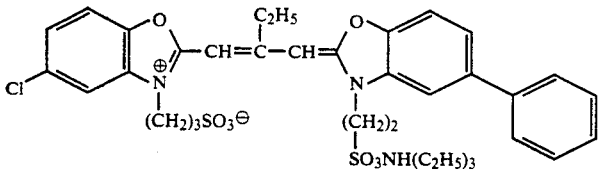
ExS-3
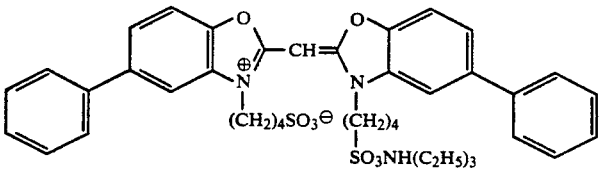
ExS-4
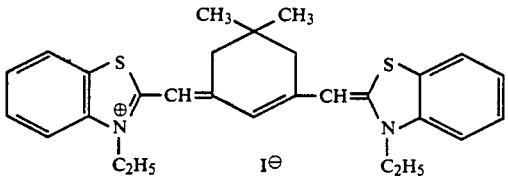
ExS-5
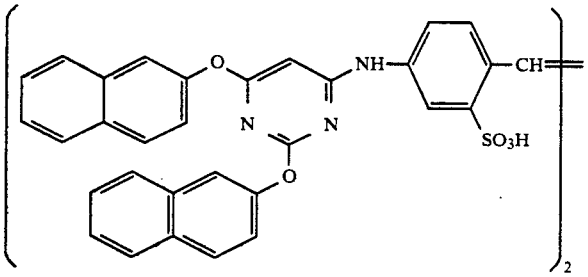
ExY-1
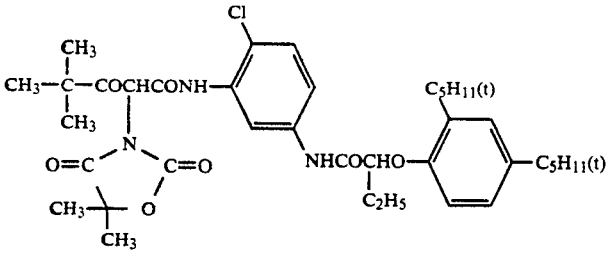
ExY-2
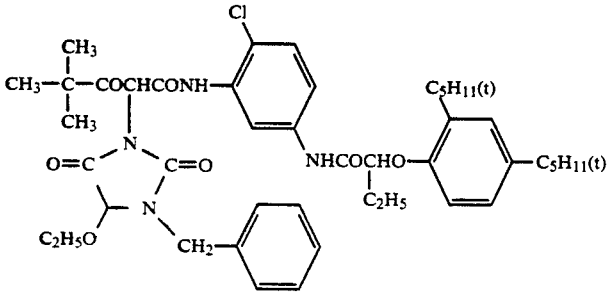
ExM-1

-continued
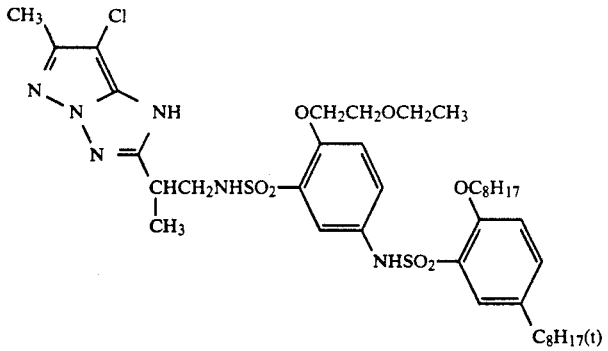
ExC-1
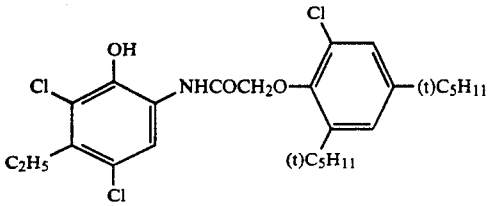
ExC-2
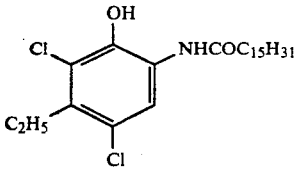
Cpd-1
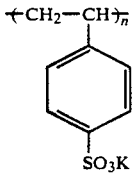
Cpd-2
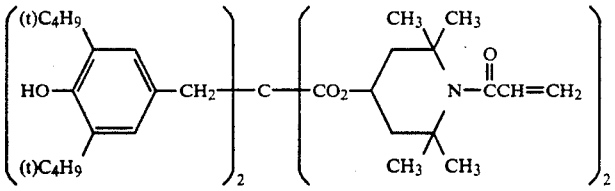
Cpd-3
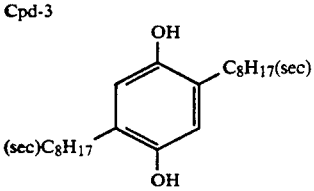
Cpd-4
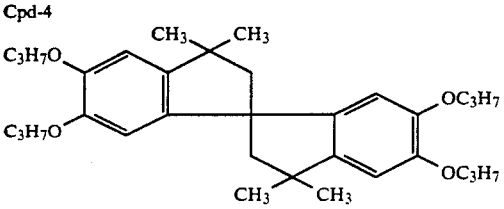
Cpd-5

-continued
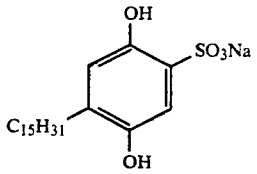
Cpd-6
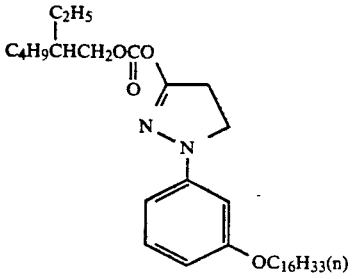
Cpd-7
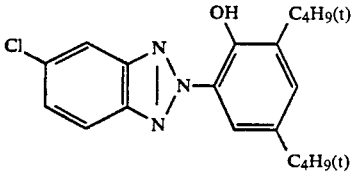
Cpd-8
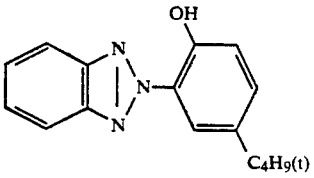
Cpd-9
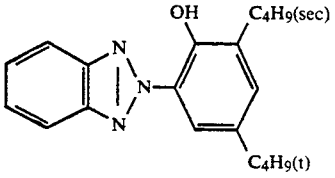
Cpd-10
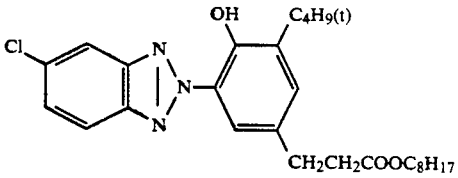
Cpd-11
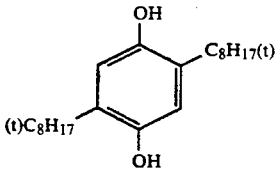
Cpd-12
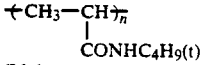
(Molecular weight: about 60,000)
Cpd-13

-continued
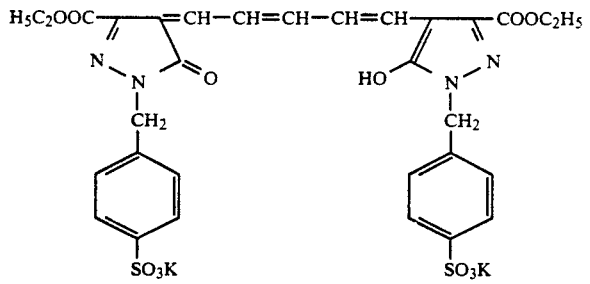
Cpd-14
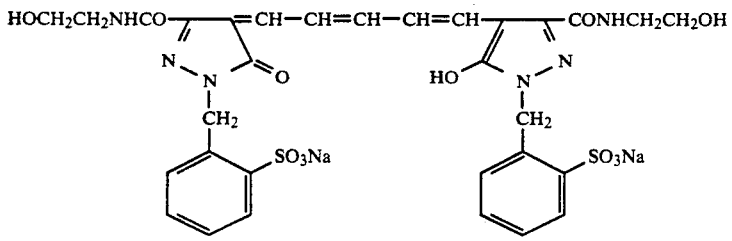
Cpd-15
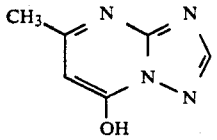
Cpd-16
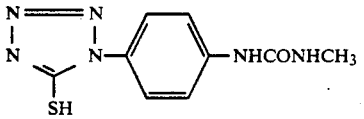
Cpd-17
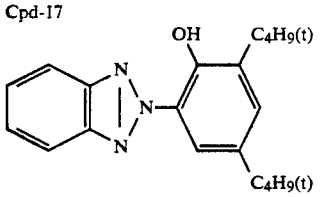
Cpd-18
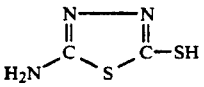
Cpd-19
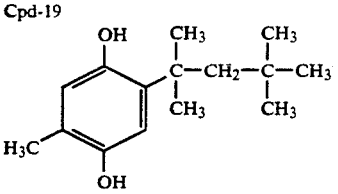
Solv-1: Dibutyl Phthalate
Solv-2: Tricresyl Phosphate
Solv-3: Trioctyl Phosphate
Solv-4: Trinonyl Phosphate
Solv-5: Dioctyl Sebacate
The properties of the silver halide emulsions used above were shown below.

| | | | | |
|---|---|---|---|---|
| EM1 | Cubic | 1.0 | 80 | 0.08 |
| EM2 | Cubic | 0.75 | 80 | 0.07 |
| EM3 | Cubic | 0.5 | 83 | 0.09 |
| EM4 | Cubic | 0.4 | 83 | 0.10 |
| EM5 | Cubic | 0.5 | 73 | 0.09 |
| EM6 | Cubic | 0.4 | 73 | 0.10 |

*[1]The side length is shown by a mean value based on the projected area.
*[2]Shown by the ratio (S/r̄) of the statistic standard deviation (S) to mean grain size (r̄).

Preparation of Samples 802 to 805

By following the same procedure as the case of preparing Sample 801 above except that each of the comparison compounds and the compounds of formula (I) of this invention (they were all metal complex fading preventing agents) shown in Table 8 below was used in place of the color image stabilizer (Cpd-4) for Layer 3 of Sample 801, in an amount corresponding to 1/5 mol of that amount of Cpd-4, Samples 802 to 805 were prepared, respectively.

Each of the samples thus prepared was imagewise exposed to white light, processed as shown below, and then the light fastness was tested.

The light fastness is determined by the percentage of the density reached after the light fastness test by the density 2.0 before the test. Also, the colored density of the background portion (background stain) is also shown in Table 8.

The light fastness test was conducted under the irradiation conditions of 85,000 lux in luminance for 200 hours using a xenon tester with ultraviolet absorbing filter of cutting light having wavelengths of shorter than 400 nm (made by Fuji Photo Film Co.) The measurement was made using a Macbeth Densitometer, RD-514 type (Status AA filter). The results are shown in Table 8.

The processing steps were as follows.

| Processing Step | Temperature | Time |
|---|---|---|
| Color Development | 33° C. | 3 min. 30 sec. |
| Blix | 33° C. | 1 min. 30 sec. |
| Wash | 24–34° C. | 3 min. |
| Drying | 70–80° C. | 1 min. |

The compositions of the processing solutions used were as follows.

| | |
|---|---|
| Color Developer | |
| Water | 800 ml |
| Diethylenetriaminepentaacetic Acid | 1.0 g |
| Nitrilotriacetic Acid | 1.5 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.0 g |
| Hydroxylamine Sulfate | 4.0 g |
| Optical Whitening Agent, WHITEX 4 (trade name, made by Sumitomo Chemical Company, Limited) | 1.0 g |
| Water to make | 1.0 liter |
| pH (25°) | 10.20 |
| Blix Solution | |
| Water | 400 ml |
| Ammonium Thiosulfate (70%) | 150 ml |
| Ethylenediaminetetraacetic Acid Iron(III) Ammonium | 55 g |
| Sodium Sulfite | 18 g |
| Ethylenediaminetetraacetic Acid Di-sodium | 5 g |
| Water to make | 1.0 liter |
| pH (25°) | 6.70 |

TABLE 8

| Sample No. | Compound | Magent Density | Background Stain |
|---|---|---|---|
| 801 | Cpd - 4 (Comparison) | 87% | 0.18 |
| 802 | Comparison Compound - C | 96% | 0.27 |
| 803 | Comparison Compound - D | 95% | 0.31 |
| 804 | Compound 59 (Invention) | 94% | 0.20 |
| 805 | Compound 60 (Invention) | 95% | 0.18 |

The compounds for the aforesaid Comparison samples were as follows.

Comparison Compound - C

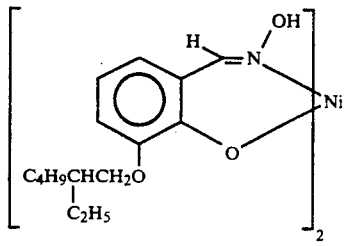

Comparison Compound - D

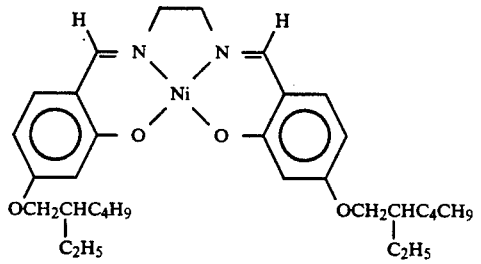

As is clear from the results shown in Table 8, it can be seen that in Samples 802 to 805, the color images are stabilized as compared with Sample 801 but in Comparison Samples 802 and 803, the background portion is stained caused by remaining of the color of the metal complex color image stabilizer itself.

On the other hand, it can be seen that in Samples 804 and 805 of this invention, the stain at the background portion is very low since the unnecessary color image stabilizer is dissolved off from the system during processing.

Also, each of the aforesaid samples 801 to 805 was processed by the following steps and subjected to the same light fastness test. The results were almost same as those shown in Table 8 above.

| Processing Step | Temperature | Time |
|---|---|---|
| Color Development | 38° C. | 1 min. 40 sec. |
| Blix | 30 to 34° C. | 1 min. 00 sec. |
| Rinse (1) | 30 to 34° C. | 20 sec. |
| Rinse (2) | 30 to 34° C. | 20 sec. |
| Rinse (3) | 30 to 34° C. | 20 sec. |

-continued

| Processing Step | Temperature | Time |
|---|---|---|
| Drying | 70 to 80° C. | 50 sec. |

In addition the rinse was performed by a three tank countercurrent system of Rinse (3)→Rinse (1).

The compositions of the processing solutions were as follows.

| | |
|---|---|
| Color Developer | |
| Water | 800 ml |
| Diethylenetriaminepentaacetic Acid | 1.0 g |
| 1-Hydroxyethilidene-1,1-diphosphonic Acid (60%) | 2.0 g |
| Nitrilotriacetic Acid | 2.0 g |
| Triethylenediamine(1,4-diazabicyclo-[2,2,2]octane) | 5.0 g |
| Potassium Bromide | 0.5 g |
| Potassium Carbonate | 30 g |
| Diethylhydroxylamine | 4.0 g |
| N-Ethyl-N-(β-methanesulfonamidoethyl)-3-methyl-4-aminoaniline Sulfate | 5.5 g |
| Optical Whitening agent, UVITEX-CK (trade name, made by Ciba-Geigy Corp.) | 1.5 g |
| Water to make | 1.0 liter |
| pH (25° C.) | 10.25 |
| Blix Solution | |
| Water | 400 ml |
| Ammonium Thiosulfate (70%) | 200 ml |
| Sodium Sulfite | 20 g |
| Ethylenediaminetetraacetic Acid Iron(III) Ammonium | 60 g |

-continued

| | |
|---|---|
| Ethylenediaminetetraacetic Acid Di-sodium | 10 g |
| Water to make | 1.0 liter |
| pH (25° C.) | 7.00 |
| Rinse Solution | |
| Ion-Exchanged Water (contents of Ca and Mg each being less than 3 ppm) | |

EXAMPLE 9

Preparation of Emulsion A

An aqueous silver nitrate solution and an aqueous sodium chloride solution containing $0.5\times10^{-4}$ mol of ammonium hexachlororhodate (III) were mixed in an aqueous gelatin solution at 35° C. by a double jet method while controlling the pH to 6.5 to provide a mono-dispersed silver chloride emulsion having a mean grain size of 0.07 μm.

After the formation of the grains, soluble salts were removed by a flocculation method well known in the field of the art and then 4-hydroxy-6-methyl-1,3,3a,7-tetraazaindene and 1-phenyl-5-mercaptotetrazole were added thereto as stabilizers. The contents of gelatin and silver in 1 kg of the emulsion were 55 g and 105 g, respectively. (Emulsion A).

Preparation of Light-Sensitive Material

To Emulsion A were added the nucleating agents, the nucleating accelerators, and the dye increasing the safelight stability (safelight dye) described below.

Nucleating Agents:

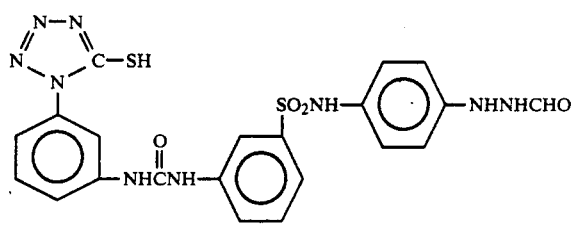

11.8 mg/m²

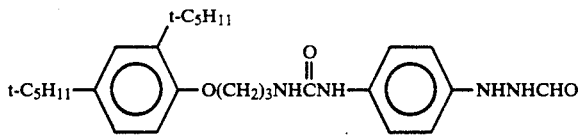

9.3 mg/m²

Nucleation Accelerators:

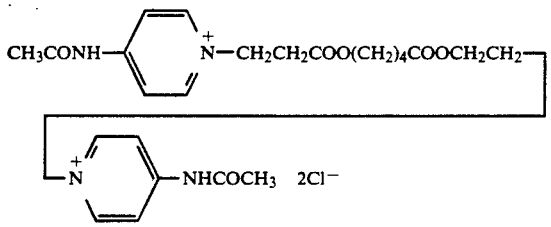

28.0 mg/m²

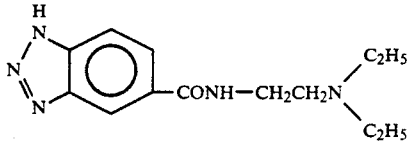

60.0 mg/m²

Safelight Dye:

-continued

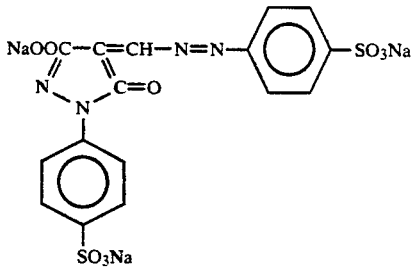

50.0 mg/m²

Then, 14 mg/m² of polyethyl acrylate latex and a hardening agent, 2,4-dichloro-6-hydroxy-1,3,5-triazine sodium salt, were added to the emulsion and the emulsion was coated on a transparent polyethylene terephthalate film support at a silver coverage of 3.5 g/m² to form a silver halide emulsion layer. Furthermore, a protective layer containing 1.3 g/m² of gelatin, 0.1 g/m² of Compound 12 of this invention and the following three kinds of surface active agents, stabilizer, and matting agent shown below was formed thereon followed by drying to provide Sample 901.

| | |
|---|---|
| Surface Active Agents: | |
| 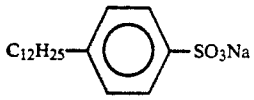 | 37 mg/m² |
| $CH_2COOC_6H_{13}$ / $CHCOOC_6H_{13}$ / $SO_3Na$ | 27 mg/m² |
| $C_8F_{17}SO_2N(C_3H_7)CH_2COOK$ | 2.5 mg/m² |
| Stabilizer: | |
| Thioctic Acid | 6 mg/m² |
| Matting Agent: | |
| Polymethyl Methacrylate (mean particle size 2.5 μm) | 9.0 mg/m² |

In addition, the compound 12 of formula (I) of this invention was used as a dispersion prepared in the following manner.

| | |
|---|---|
| Solution I: | |
| Compound 12 | 0.8 g |
| Dimethylformamide | 3.0 ml |
| Citric Acid | 0.05 g |
| Water | 22 ml |
| Solution II: | |
| Gelatin | 2.2 g |
| Water | 20 ml |

While stirring Solution II at 40° C., Solution I was gradually added thereto. The pH of the finished solution was 5.4.

Also, by following the same procedure as above while using each of the compounds 34, 50 and 68 of formula (I) in a same molar amount in place of compound 12, Samples 902, 903, and 904 were prepared, respectively.

Preparation of Comparison Samples

1) By following the same procedure as the case of preparing Sample 901 except that the compound 12 was omitted, Comparison Sample A was prepared.

2) By following the same procedure as the case of preparing Sample 901 except that the following water-soluble ultraviolet absorbing dye (0.05 g/m²) was used in place of the compound 12 in the sample, Comparison Sample B was prepared.

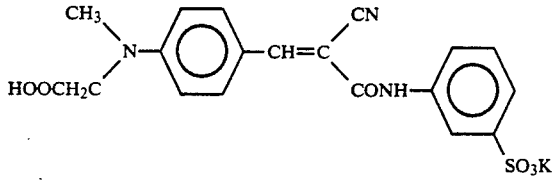

Evaluation of Performance (1) Each of the aforesaid six samples was exposed through an optical wedge using a Safelight Printer P-607 (made by Dainippon Screen Mfg. Co., Ltd.), developed by the following developer for 20 seconds at 38° C., fixed by an ordinary method, washed and dried. In Sample B and Samples 901 to 904, the UV optical density at the high-light portion was low as in Sample A, which showed complete decoloring.

| Basic Composition of Developer | |
|---|---|
| Hydroquinone | 35.0 g |
| N-Methyl-p-aminophenol ½Sulfate | 0.8 g |
| Sodium Hydroxide | 13.0 g |
| Potassium Tertiary Phosphate | 74.0 g |
| Potassium Sulfite | 90.0 g |
| Ethylenediaminetetraacetic Acid Tetra-sodium Salt | 1.0 g |
| Potassium Bromide | 4.0 g |
| 5-Methylbenzotriazole | 0.6 g |
| 3-Diethylamino-1,2-propanediol | 15.0 g |
| Water to make | 1 liter |
| pH | 11.5 |

The sensitivity could be reduced by 0.40.in logE value in the comparison sample B and 0.43, 0.42, 0.43 and 0.46 in the samples 901 to 904 of this invention, with respect to the comparison sample A. The sensitivities of the sample B and the samples 901 to 904 were in the practical appropriate range.

(2) Safelight Safety Test

Each of the aforesaid six samples were subjected to a safety time test under 400 lux by a UV cut fluorescent lamp (FLR-40SW-DLX-NU/M, made by Toshiba Corporation). The results showed that the safety of the comparison sample A was 11 minutes while the safety of the comparison sample was 21 minutes and that of the samples 901 to 904 of this invention was 24 minutes, 23 minutes, 20 minutes, and 27 minutes, respectively, which showed higher safety than the comparison sample B.

From the results of the aforesaid tests (1) and (2) it can be seen that the compounds 12, 34, 50 and 68 of this invention effectively reduce the sensitivity to the appropriate range to increase the safelight safety.

(3) Tone Variability Test

Each of the aforesaid six samples was exposed through a dot screen using the aforesaid printer and then developed as in test (1) above. After defining an exposure time capable to duplicating the dot image at 1:1 for each sample, each sample was exposed for a time of two times or 4 times the exposure time and the enlarged extent of the dot image was measured. The larger enlargement shows that the sample is excellent in the tone variability. The results obtained are shown in Table 9.

TABLE 9

| Tone Variability (shown by the increase of dot image) | | |
|---|---|---|
| Sample | 2 Times Exposure | 4 Times Exposure |
| Comparison Sample A | +5% | +10% |
| Comparison Sample B | +2% | +5% |
| Sample 901 of this Invention | +5% | +9% |

As is clear from the above results, the comparison sample B greatly reduces the tone variability, while the sample 901 of this invention shows a high tone variability. This is because of the water solubility and diffusibility of the dye used for the comparison sample B, the dye uniformly diffuses into the light-sensitive emulsion layer from the layer containing it during the storage of the sample, enlarging of the dot image is restrained by the irradiation preventing effect of the dye even when the exposure time is increased. On the other hand, since the compound 12 of this invention is fixed in the layer to which the compound was incorporated, the sample of this invention shows a high tone variability.

(4) Evaluation of stain by reducer

A strip of the sample 901 of this invention obtained by processing in aforesaid (3) was dipped in a Farmer's reducer shown below for 60 seconds at 20° C., washed with water, and dried. The result showed that the portion of the dot image of 50% was reduced to 33% and the formation of stain was not observed.

| Farmer's Reducer | |
|---|---|
| Solution 1: | |
| Water | 200 ml |
| Sodium Thiosulfate | 20 g |
| Solution 2: | |
| Water | 100 ml |
| Potassium Ferricyanide | 10 g |

At use, solution 1, solution 2, and water were mixed at 100:50:100.

EXAMPLE 10

The solid dispersion method for a dye-providing material is explained.

After mixing 200 ml of an aqueous 1% gelatin solution with 10 g of each of the dye-providing compounds 2, 31, and 21 of formula (I), 7.2 g of the electron donating material (ED-1), and 1.5 g of the surface active agent(s) shown below and the mixture was ground by a dyno ® mill using 100 g of glass beads having a mean particle size of about 0.6 mm for 20 minutes. Then, the glass beads were separated by filtration to provide an aqueous dispersion (mean particle size 0.6 μm).

Surface Active Agent (a):

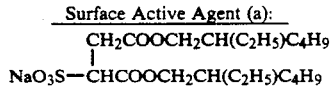

By following the same procedure as Example 3 except that the aforesaid solid dispersion of the dye-providing material was used in place of the gelatin dispersion of the dye-providing material in Example 3, light-sensitive material 1001 was prepared.

After storing the light-sensitive materials 301 (from Example 3) and 1001 for one week at 45° C. and 60% in relative humidity, each sample was processed as in Example 3. The results showed that the light-sensitive material 1001 showed less increase of $D_{min}$ after storage as compared with the light-sensitive material 301, that is, the storage stability was improved by the solid dispersion method.

EXAMPLE 11

After exposing the light-sensitive material 301 in Example 3, 15 ml/m$^2$ of water was supplied to the emulsion layer surface of the light-sensitive material, the light-sensitive material was superposed on the dye-fixing material in Example 3 such that the coated layers faced each other and the elements closely contacted each other for 20 seconds at room temperature. Then, the assembly was heated to 85° C. for 20 seconds and the dye-fixing material was peeled apart (Process B).

Apart from this, the same procedure as Process B was followed except that the assembly was press-heated for 10 seconds using a heat block heat controlled so that the temperature of the water-absorbed layers became 50° C. in place of closely contacting them for 20 seconds at room temperature (Process C).

In each process, color images of blue, green, red, and gray were obtained on the dye-fixing material and the discrimination of good images having low $D_{min}$ could be obtained as compared to the process in Example 3.

EXAMPLE 12

By following the same procedure as the preparation method of the gelatin dispersion of the dye-providing material in Example 3 except that each of the oils (a-2), (a-5), and (a-6) shown by formula (a) in a same amount were employed in place of tricyclohexyl phosphate, light-sensitive materials 1201, 1202, and 1203 were prepared.

After storing the light-sensitive materials 301 (from Example 3), 1201, 1202, and 1203 for one week at 45° C. and 60% in relative humidity, the samples were processed as in Example 3. The results showed that the light-sensitive materials 1201 to 1203 gave less increase of $D_{min}$ after storage.

EXAMPLE 13

By following the same procedure as the case of preparing the light-sensitive material 301 in Example 3 except that the following compound (the oxidation product of ED 1) was used in place of the electron donating material ED-1, a light-sensitive material 1301 was prepared.

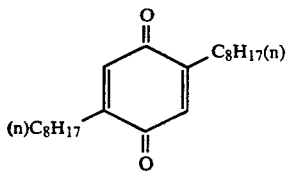

After storing the light-sensitive materials 301 and 1301 for one week at 45° C. and 60% in relative humidity, the samples were processed as in Example 3. The results showed that the increase of $D_{min}$ after storage was far less in the light-sensitive material 1301.

| | |
|---|---|
| Layer 1 | |
| Layer 1-O: | High-speed red-sensitive emulsion layer |
| Layer 1-U: | Low-speed red-sensitive emulsion layer |
| Layer 2 | Interlayer |
| Layer 3 | |
| Layer 3-O: | High-speed green-sensitive emulsion layer |
| Layer 3-U: | Low-speed green-sensitive emulsion layer |
| Layer 4 | Interlayer |
| Layer 5 | |
| Layer 5-O: | High-speed blue-sensitive emulsion layer |
| Layer 5-U: | Low-speed blue-sensitive emulsion layer |
| Layer 6 | Protective layer |

Also, a back layer was formed.

The additions amounts of additives in each O and U layers of Layers 1, 3, and 5 are shown in Table 10 below.

TABLE 10

| Additive | Amount ($g/m^2$) | | | | | |
|---|---|---|---|---|---|---|
| | Layer 5-O | Layer 5-U | Layer 3-O | Layer 3-U | Layer 1-O | Layer 1-U |
| Emulsion (as Ag amount) | 0.23 | 0.35 | 0.16 | 0.25 | 0.14 | 0.22 |
| Gelatin | 0.27 | 0.41 | 0.20 | 0.27 | 0.2 | 0.27 |
| Antifoggant (I) | $5.4 \times 10^{-4}$ | $8.2 \times 10^{-4}$ | $5.0 \times 10^{-4}$ | $7.5 \times 10^{-4}$ | $5.0 \times 10^{-4}$ | $7.5 \times 10^{-4}$ |
| Yellow dye-providing material Compound 2 | 0.13 | 0.37 | — | — | — | — |
| Magenta dye-providing material Compound 31 | — | — | 0.09 | 0.28 | — | — |
| Cyan dye-providing material Compound 21 | — | — | — | — | 0.09 | 0.28 |
| High-boiling point organic solvent (1) | 0.06 | 0.19 | 0.05 | 0.14 | 0.05 | 0.13 |
| Electron donating compound (ED-1) | 0.06 | 0.19 | 0.04 | 0.10 | 0.04 | 0.10 |
| Surface active agent (3) | 0.01 | 0.04 | 0.01 | 0.02 | 0.01 | 0.02 |
| Electron transmitting agent (X-2) | 0.01 | 0.02 | 0.01 | 0.02 | 0.01 | 0.02 |
| Hardening agent | 0.004 | 0.006 | 0.004 | 0.006 | 0.004 | 0.006 |
| Water-soluble polymer (2) | 0.01 | 0.01 | 0.01 | 0.01 | 0.01 | 0.01 |

EXAMPLE 14

By following the same procedure as the case of preparing the light-sensitive material 301 in Example 3 except that 1 g of the development inhibitor-releasing compound 6 of formula (I) of this invention was further added to 10 g of each of the dye-providing materials Compounds 2, 31, and 21 of formula (I) in this invention at the time of preparing the gelatin dispersion of the dye-providing material, a light-sensitive material 1401 was prepared.

When the light-sensitive material 1401 was processed as in Example 3, the effect of reducing $D_{min}$ and improving the descrimination of images was confirmed.

EXAMPLE 15

By following the same procedure as the case of preparing the light-sensitive material 301 in Example 3 except that each of Layers 1, 3, and 5 were changed as shown below, a light-sensitive material was prepared.

The silver halide emulsions used for the aforesaid emulsion layers in Table 10 shown above were shown in Table 11.

TABLE 11

| Sample No. | Layer 5-O | Layer 5-U | Layer 3-O | Layer 3-U | Layer 1-O | Layer 1-U |
|---|---|---|---|---|---|---|
| 1501 | 6 a | 5 a | 2 a | 3 a | 4 a | 1 a |
| 1502 | 6 b | 5 b | 2 b | 3 b | 4 b | 1 b |

The aforesaid emulsions were prepared as follows.

Emulsion (1 a)

To an aqueous gelatin solution (a solution of 25 g of gelatin, 4 g of sodium chloride, and 0.02 g of 1,3-dimethylimidazolidine-2-thione dissolved in 700 ml of water kept at 65° C.) was added Solution I shown below over a period of 30 minutes. Also, after 10 seconds from the initiation of the addition of Solution I, Solution II shown below was added over a period of 30 minutes. Then, after 10 minutes from the end of the addition of Solution I, Solution III and Solution IV each shown below were simultaneously added thereto at equi-flow amount over a period of 30 minutes. Furthermore, after one minute from the end of the addition of Solutions III and IV, a solution of 0.2 g of a sensitizing dye A shown below dissolved in a mixture of 100 ml of methanol and 100 ml of water was added thereto.

After washing with water and desalting, 20 g of gelatin was added to the emulsion and after adjusting pH and pAg to 6.1 and 7.2, respectively, the emulsion was subjected to an optimum chemical sensitization using tri-ethylthiourea, 4-hydroxy-6-methyl-1,3,3a,7-tetraazaindene, and chloroauric acid to provide 600 g of a mono-dispersed cubic emulsion (1 a) having a mean grain size of 0.7 μm.

| | Soln. I | Soln. II | Soln. III | Soln. IV |
|---|---|---|---|---|
| $AgNO_3$ | 50 g | — | 50 g | |
| KBr | — | 28 g | — | 21 g |
| NaCl | — | 3.5 g | — | 6.8 g |
| Total volume (water added) | 300 ml | 260 ml | 270 ml | 280 ml |

Sensitizing Dye A:

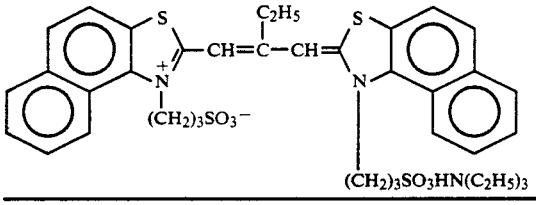

Emulsion (1 b)

By following the same procedure as emulsion (1 a) except that after 5 minutes from the end of the addition of Solution I, 3.4 ml of an aqueous solution of 0.001% potassium hexachloroiridate(III) was added to the aqueous gelatin solution, 600 g of a mono-dispersed emulsion (1 b) having a mean grain size of 0.7 μm was obtained.

Emulsion (2 a)

To an aqueous gelatin solution (a solution of 20 g of gelatin, 10 g of sodium chloride, 0.3 g of potassium bromide, and 0.03 g of 1,3-dimethylimidazolidine-2-thione dissolved in 800 ml of water kept at 60° C.) was added Solution I shown below over a period of 60 minutes. Also, after 5 seconds from the initiation of the addition of the Solution I, Solution II shown below was added over a period of 60 minutes. Furthermore, after 15 minutes from the end of the addition of the Solution I, a solution of 0. 18 g of a sensitizing dye B shown below dissolved in 150 ml of methanol was added thereto. After washing with water and desalting, 20 g of gelatin was added to the emulsion and after adjusting pH and pAg to 6.4 and 7.3, respectively, the emulsion was subjected to an optimum chemical sensitization at 57° C. with the addition of triethylthiourea and 4-hydroxy-6-methyl-1,3,3a,7-tetraazaindene. Thus, 640 g of a mono-dispersed cubic emulsion (2 a) having a mean grain size of 0.65 μm was obtained.

| | Soln. I (water to make 600 ml) | Soln. II (water to make 600 ml) |
|---|---|---|
| $AgNO_3$ | 100 g | — |
| KBr | — | 45.5 g |
| NaCl | — | 11.7 g |
| KI | — | 0.97 g |

Sensitizing Dye B:

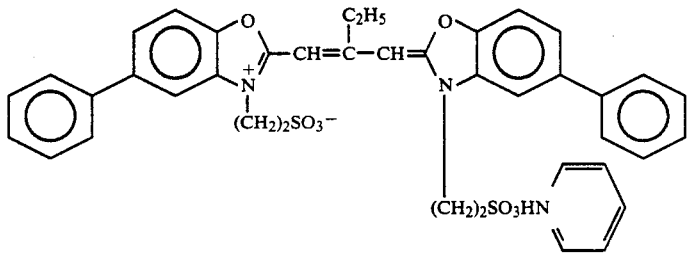

Emulsion (2 b)

By following the same procedure as above except that 0.6 ml of an aqueous solution of 0.0015% ammonium hexachloroiridate(IV) was added to the solution of the sensitizing dye, 645 g of a mono-dispersed cubic emulsion having a mean grain size of 0.65 μm was obtained.

Emulsion (3 a)

To an aqueous gelatin solution (a solution of 1050 g of limed ossein gelatin and 70 g of sodium chloride in 52 liter of water kept at 75° C.) were simultaneously added Solution I and Solution II shown below over a period of 8 minutes. Then, after 5 minutes from the initiation of the addition of the Solutions I and II, a solution of 2.6 g of the sensitizing dye B shown above and a sensitizing dye C shown below dissolved in 5.2 liters of methanol was added thereto over a period of 45 minutes. Thereafter, Solution III and Solution IV shown below were simultaneously added thereto over a period of 40 minutes. After washing with water and desalting, 400 g of gelatin was added to the emulsion and after adjusting pH and pAg to 6.0 and 8.0, respectively, the emulsion was subjected to an optimum chemical sensitization using triethylthiourea, 4-hydroxy-6-methyl-1,3,3a,7-tetraazaindene, and a nucleic acid decomposition product. Thus, 16.4 kg of a cubic emulsion (3 a) having a mean grain size of 0.6 μm was obtained.

| | Soln. I | Soln. II | Soln. III | Soln. IV |
|---|---|---|---|---|
| $AgNO_3$ | 260 g | — | 2,340 g | |
| KBr | — | 110 g | — | 1,310 g |
| NaCl | — | 35.8 g | — | 162 g |
| Total volume (water to make) | 1,900 ml | 2.100 ml | 17,080 ml | 15,000 ml |

Sensitizing Dye C:

-continued

| Soln. I | Soln. II | Soln. III | Soln. IV |
|---|---|---|---|

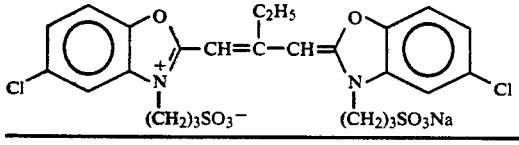

Emulsion (3 b)

By following the same procedure as the case of preparing emulsion (3 a) except that an aqueous solution of 0.001% potassium hexachloroiridate(III) solution was added to Solution II in 26 ml and to Solution IV in 16 ml, 16.4 kg of a cubic emulsion (3 b) having a mean grain size of 0.6 μm was obtained.

Emulsion (4 a)

To an aqueous gelatin solution (a solution of 20 g of gelatin, 6 g of sodium chloride, 0.1 g of potassium bromide, 4 ml of 1N sulfuric acid, and 0.03 g of 1,3-dimethylimidazolidine-2-thione dissolved in 800 ml of water kept at 72° C.) were simultaneously added Solution I and Solution II shown below over a period of 30 minutes. Then Solution V shown below was added thereto over a period of 2 minutes and further Solution III and Solution IV shown below were added over a period of 20 minutes. Then, directly after finishing the addition of the Solutions III and IV, a solution of 0.15 g of a sensitizing dye D shown below dissolved in 150 ml of methanol was added to the emulsion. After washing with water and desalting, 20 g of gelatin was added to the emulsion and after adjusting pH and pAg thereof to 6.1 to 8.2, respectively, the emulsion was subjected to an optimum sensitization at 62° C. using sodium thiosulfate, 4-hydroxy-6 methyl-1,3,3a,7-tetraazaindene, and 30 g of a fine grain emulsion A shown below. Thus, 640 g of a mono dispersed tetradecahedral emulsion (4 a) having a mean grain size of 0.85 μm was obtained.

| | Soln. I | Soln. II | Soln. III | Soln. IV | Soln. V |
|---|---|---|---|---|---|
| $AgNO_3$ | 50 g | — | 50 g | — | — |
| KBr | — | 31.5 g | — | 31.5 g | — |
| NaCl | — | 1.73 g | — | 3.4 g | — |
| KI | — | — | — | — | 0.93 g |
| Total volume (water to make) | 300 ml | 250 ml | 260 ml | 300 ml | 160 ml |

Sensitizing Dye D:

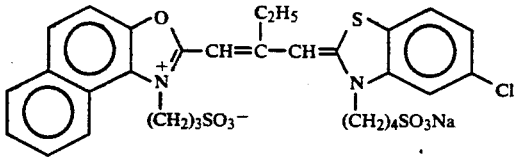

Preparation of Fine Grain Emulsion A

To an aqueous gelatin solution (a solution of 30 g of limed ossein gelatin, 12 g of potassium bromide, and 8 g of sodium chloride dissolved in 800 ml of water kept at 35° C.) were simultaneously added Solution I and Solution II shown below over a period of 20 minutes. After washing with water and desalting, 18 g of limed ossein gelatin was added to the emulsion and then pH and pAg thereof were adjusted to 6.4 and 7.5, respectively to provide 640 g of a fine grain emulsion A having a mean grain size of 0.9 μm.

| | Solution I | Solution II |
|---|---|---|
| $AgNO_3$ | 100 g | — |
| KBr | — | 72 g |
| Total volume (water to make) | 500 ml | 460 ml |

Emulsion (4 b)

By following the same procedure as the case of preparing Emulsion (4 a) except that 30 ml of an aqueous solution of 0.001% ammonium hexachloroiridiate(IV) was added to the Solution (II) of the fine grain emulsion A, 640 g of a mono-dispersed tetradecahedral emulsion (4 b) having a mean grain size of 0.85 μm was obtained.

Emulsion (5 a)

To an aqueous gelatin solution (a solution of 20 g of limed ossein gelatin, 12 g of potassium bromide, and 0.03 g of the following compound dissolved in 670 ml of water kept at 70° C.) were simultaneously added Solution I and Solution II shown below over a period of 60 minutes.

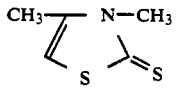

After washing with water and desalting, 7 g of limed ossein gelatin was added to the emulsion and after adjusting pH and pAg to 6.7 and 8.2, respectively, the emulsion was subjected to an optimum chemical sensitization using sodium thiosulfate and chloroauric acid at 60° C. over a period of 70 minutes. Also, after 71 minutes from the addition of sodium thiosulfate, a gelatin dispersion containing 0.13 g of a sensitizing dye shown below was added. Thus, 690 g of a mono-dispersed octahedral emulsion (5 a) having a mean grain size of 1.0 μm was obtained.

| | Solution I (water to make 600 ml) | Solution II (water to make 580 ml) |
|---|---|---|
| $AgNO_3$ | 100 g | — |
| KBr | — | 68.6 g |
| KI | — | 1.95 g |

Sensitizing Dye E:

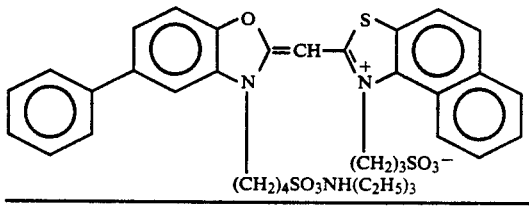

Emulsion (5 b)

By following the same procedure as the case of preparing the emulsion (5 a) except that 1.2 ml of an aqueous solution of 0.001% potassium hexachloroiridate(III) was added to the Solution II, 690 g of a mono-dispersed emulsion having a mean grain size of 1.0 μm was obtained.

Emulsion (6 a)

To an aqueous gelatin solution (a solution of 20 g of limed deionized gelatin, 1 g of potassium bromide, and 7 ml of 25% ammonia dissolved in 800 ml of water kept at 50° C.) were simultaneously added Solution I and Solution II shown below at constant pAg over a period of 50 minutes. Then a solution of 0.15 g of the sensitizing dye E shown above dissolved in 100 ml of methanol was added thereto.

After washing with water and desalting, 28 g of gelatin was added to the emulsion and after adjusting pH and pAg thereof to 6.5 and 8.5, respectively, the emulsion was subjected to an optimum chemical sensitization using sodium thiosulfate and 4-hydroxy-6-methyl-1,3,3a,7-tetraazaindene. Thus, 640 g of a mono-dispersed octahedral emulsion (6 a) having a mean grain size of 1.2 μm was obtained.

| | Solution I | Solution II |
|---|---|---|
| $AgNO_3$ | 100 g | — |
| KBr | — | 70 g |
| Total volume (water to make) | 600 ml | 600 ml |

Emulsion (6 a)

By following the same procedure as above except that after 10 minutes from the initiation of the addition of the Solutions I and II to the emulsion, 0.8 ml of an aqueous solution of 0.001% potassium hexachloroiridate(III) was added to the emulsion, a mono-dispersed octahedral emulsion having a mean grain size of 1.2 μm was obtained. The amount thereof was 640 g.

Each of the light-sensitive materials 1501 and 1502 thus prepared was exposed through a filter having continuously changing density for 1/10 second at 5,000 lux using a tungsten lamp.

While sending the exposed light-sensitive materials at a line speed of 20 mm/sec., 15 ml/m² of water was supplied on the emulsion layer surface by a wire bar and then the light-sensitive material was immediately superposed on the image-receiving material such that the coated surfaces faced each other.

Then, the assembly was heated for 20 seconds using a heat roller the temperature of which had been controlled so that the temperature of the water-absorbed layers became 85° C. and then the image-receiving material was peeled away from the light-sensitive material to provide clear positive images on the image-receiving material in both cases. In this case, each color of yellow, magenta, and cyan showed higher $D_{max}$ in the light sensitive material 1502.

Also, it has also been confirmed that the sensitivity difference between the sample exposed for 1/10 seconds at 5,000 lux and the sample exposed for 10 seconds at 50 lux is less in the light-sensitive material 1502, which shows the improved reciprocity law characteristics.

EXAMPLE 16

A light-sensitive material 1601 was prepared by successively forming the following layers on a transparent polyethylene terephthalate support.

| Layer I | |
|---|---|
| a) Light-Sensitive Silver Iodobromide Emulsion | 0.36 g/m² as Ag |
| b) Benzotriazole Silver Emulsion | 0.18 g/m² as Ag |
| c) Gelatin dispersion of 0.27 mmol/m² of Compound 69 in this invention and 0.3 g/m² of tricresyl phosphate. | |
| d) Gelatin dispersion of 0.27 mmol of 1-phenyl-4-methyl-4-stearoyloxymethyl-3-pyrazolidone and 0.1 g/m² of tricresylphosphate. | |
| e) Base Precursor having the following structure | 0.22 g/m² |
| 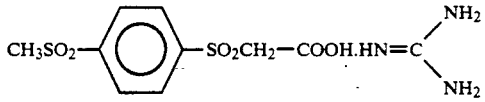 | |
| f) Compound of the following structure | 0.1 g/m² |
| 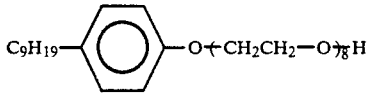 | |

Layer I was a light-sensitive layer containing aforesaid components a) to f) and 1.2 g/m² of gelatin including the gelatin in the aforesaid components a) to d).

Layer II

A protective layer containing 0.35 g/m² of the aforesaid base precursor and 1 g/m² of gelatin.

Also, by following the same procedure as above except that compound 70 in this invention was used in a same molar amount in place of the compound 69, a light-sensitive material 1602 was prepared.

Each of the light-sensitive materials was exposed for one second at 2,000 lux using a tungsten lamp and after heating it on a heat plate heated to 160° C. for 45 seconds, the emulsion layer was mechanically peeled off to provide positive images on the polyethylene terephthalate film.

The image densities measured are shown in Table 12.

TABLE 12

| Light-Sensitive Material | Compound of formula (I) | Color | Maximum Density | Minimum Density |
|---|---|---|---|---|
| 1601 | 69 | Yellow | 0.85 | 0.05 |
| 1602 | 70 | Magenta | 0.95 | 0.05 |

When the films having positive images thus formed were stored for one week under the conditions of 40° C. and 80% in relative humidity, no increase of blurring, ooze, and stain of the images was observed and it has been confirmed that the invention provide very stable images.

Example 17

Preparation of Silver Halide Emulsion

To an aqueous gelatin solution (a solution of 20 g of gelatin and 3 g of sodium chloride dissolved in 1,000 ml of water kept at 60° C.) were simultaneously added 600 ml of an aqueous solution of sodium chloride and potassium bromide and an aqueous silver nitrate solution (a solution of 0.59 mol of silver nitrate dissolved in 600 ml of water) at an equi-flow amount over a period of 40 minutes. Thus, a mono-dispersed cubic silver chlorobromide emulsion (Br 80 mol%) having a mean grain size of 0.20 μm was prepared.

After washing with water and desalting, the emulsion was subjected to a chemical sensitization at 60° C. with the addition of 5 mg of sodium thiosulfate and 20 mg of 4-hydroxy-6-methyl-1,3,3a,7-tetraazaindene. The amount of the emulsion obtained was 600 g.

Preparation of Light-Sensitive Composition

In 100 g of tricresyl phosphate were dissolved 0.40 g of the copolymer shown below and 2.5 g of the reducing agent ED-1. To the solution was added 40 g of the silver halide emulsion described above and the mixture was stirred for 5 minutes by means of a homogenizer to provide a light-sensitive composition.

Copolymer:

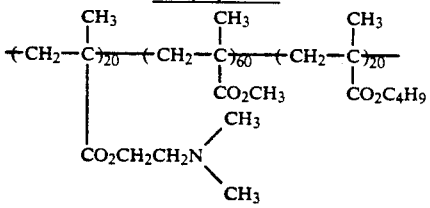

Preparation of Microcapsule Liquid

To the aforesaid light-sensitive composition was dissolved 50 g of an addition product of xylylene diisocyanate and trimethylolpropane (Takenate D110N, trade name, made by Takeda Chemical Industries, Ltd.) and the composition was added to 250 g of an aqueous solution of 4.0% methyl cellulose (made by Shin-Etsu Chemical Co., Ltd.) followed by stirring for one minute at 5,000 r.p.m. using a homogenizer. The emulsion was stirred for 2 hours at 60° C. at 1,000 r.p.m. to provide polyurea resin microcapsules (mean particle size: 10 μm).

Preparation of Gelatin Dispersion of Dye-Providing Material

In 8 ml of cyclohexanone were dissolved 3.3 g of a cyan dye-providing compound 21 of formula (I) and 1.7 g of tricresyl phosphate at about 60° C. to provide a homogeneous solution. The solution was mixed with 20 g of an aqueous solution of 10% limed gelatin, 0.3 g of sodium dodecylbenzenesulfonate and 12 ml of water, and the mixture was dispersed for 10 minutes at 10,000 r.p.m. by means of a homogenizer to provide a dispersion of cyan dye-providing material.

Preparation of Light-Sensitive Material

A mixture of 6.5 g of the aforesaid gelatin dispersion of the cyan dye-providing compound 21 and 6 g of water was heated to 40° C. and after adding thereto 88 g of the aforesaid microcapsule liquid, the mixture was coated on a polyethylene terephthalate film support 100 μm thick at a wet thickness of 70 μm and dried.

Furthermore, the composition shown below was coated thereon at a wet thickness of 30 μm as a protective layer and dried to provide a light-sensitive material.

| | | |
|---|---|---|
| a) | Gelatin (10% aqueous soln.) | 30 g |
| b) | Zinc Oxide (10% aqueous dispersion, mean particle size 0.2 μm) | 9 g |
| c) | Aqueous solution of 2% 1,2-bis(vinylsulfonylacetamido)ethane | 5 ml |
| d) | Water | 60 ml |

Preparation of Dye-Fixing Material

In 1,300 ml of water were dissolved 63 g of gelatin, 130 g of the mordant shown below, and 40 g of guanidine picolinate and the solution was coated on a paper support coated with polyethylene at a wet thickness of 45 μm and dried.

Mordant:

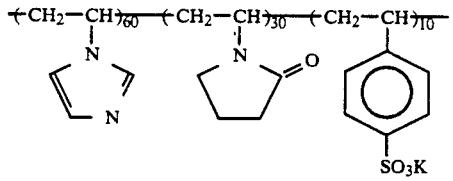

Furthermore, a solution of 35 g of gelatin and 1.05 g of 1,2-bis(vinylsulfonylacetamido)ethane dissolved in 800 ml of water was coated thereon at a wet thickness of 17 μm and dried to provide a dye-fixing material.

After imagewise exposing the light-sensitive material, 10 ml/m$^2$ of water was supplied on the emulsion layer by means of a wire bar and then the light-sensitive material was superposed on the dye-fixing material such that the coated layers faced each other.

The assembly was heated for 20 seconds using a heat roller heat-controlled such that the temperature of the water-absorbed layers became 90° C. and then the dye-fixing material was peeled apart from the light-sensitive material to provide clear positive images having a maximum density ($D_{max}$) of 1.88 and a minimum density ($D_{min}$) of 0.27 on the dye-fixing material.

Furthermore, after storing the light-sensitive material for one week at 40° C. and 80% in relative humidity, the same procedure as above was followed but $D_{max}$ and $D_{min}$ of the images were almost same as above.

EXAMPLE 18

A light-sensitive material 1801 having the following layers on a polyethylene terephthalate film of 160 μm thick and having a back layer as the light-sensitive material 301 in Example 3.

The coating amounts below are shown by g/m², and in the case of silver halide emulsions as the calculated amount of silver.

| | |
|---|---|
| Layer 1 Cyan Dye-Providing Layer | |
| Cyan Dye-Providing Compound 21 | 0.37 |
| High-Boiling Organic Solvent (2)* | 0.18 |
| Surface Active Agent (3)* | 0.05 |
| Gelatin | 0.35 |
| Water-Soluble Polymer (2)* | 0.02 |
| Layer 2 Red-Sensitive Emulsion Layer | |
| Emulsion I | 0.36 |
| Gelatin | 0.40 |
| Electron Donating Material (ED-1) | 0.30 |
| Surface Active Agent (2)* | 0.06 |
| Antifoggant (1)* | $1.10 \times 10^{-3}$ |
| Water-Soluble Polymer (2)* | 0.02 |
| Layer 3 Interlayer | |
| Gelatin | 0.75 |
| $Zn(OH)_2$ | 0.45 |
| Reducing Agent (1)* | 0.20 |
| Electron Transmitting Agent (X-2) | 0.09 |
| Surface Active Agent (1)* | 0.20 |
| Water-Soluble Polymer (2)* | 0.02 |
| Layer 4 Magenta Dye-Providing Layer | |
| Gelatin | 0.35 |
| Water-Soluble Polymer (2)* | 0.02 |
| Magenta Dye-Providing Compound 31 | 0.37 |
| High-Boiling Organic Solvent (2)* | 0.18 |
| Surface Active Agent (3)* | 0.05 |
| Layer 5 Green-Sensitive Emulsion Layer | |
| Emulsion II | 0.41 |
| Gelatin | 0.40 |
| Electron Donating Material (ED-1) | 0.36 |
| Surface Active Agent (2)* | 0.05 |
| Antifoggant (1)* | $1.10 \times 10^{-3}$ |
| Water-Soluble Polymer (2)* | 0.02 |
| Layer 6 Interlayer | |
| Gelatin | 0.75 |
| $Zn(OH)_2$ | 0.45 |
| Reducing Agent (1)* | 0.20 |
| Electron Transmitting Agent (X-2) | 0.09 |
| Surface Active agent (1)* | 0.20 |
| Water-Soluble Polymer (2)* | 0.02 |
| Layer 7 Yellow Dye-Providing Layer | |
| Yellow Dye-Providing Compound 2 | 0.50 |
| High-Boiling Organic Solvent (2)* | 0.25 |
| Surface Active Agent (3)* | 0.05 |
| Gelatin | 0.35 |
| Water-Soluble Polymer (2)* | 0.02 |
| Layer 8 Blue-Sensitive Emulsion Layer | |
| Emulsion III | 0.58 |
| Gelatin | 0.40 |
| Electron Donating Material (ED-1) | 0.36 |
| Surface Active Agent (2)* | 0.06 |
| Antifoggant (1)* | $1.30 \times 10^{-3}$ |
| Water-Soluble Polymer (2)* | 0.02 |
| Layer 9 Protective Layer | |
| Gelatin | 0.80 |
| Matting Agent (silica) | 0.08 |
| Water-Soluble Polymer (1)* | 0.25 |
| Surface Active Agent (1)* | 0.30 |
| Hardening Agent (1)* | 0.15 |

For the aforesaid layers; High Boiling Organic Solvent (2)* is trinonyl phosphate and other compounds shown by (*) are same as in Example 3.

When the light-sensitive material 1801 was processed as in Example 3 using the image-receiving material shown in Example 3, color images having no unevenness were obtained.

EXAMPLE 19

A multicolor photographic material having the following layers on a cellulose triacetate film support having a gelatin subbing layer was prepared (Sample 1901).

The coating amounts below are shown by a g/m² unit, and those of colloidal silver and silver halide emulsion were shown as the calculated amount of silver.

| | |
|---|---|
| Layer 1 Antihalation Layer | |
| Black Colloidal silver | 0.30 |
| Gelatin | 2.50 |
| UV-1 | 0.05 |
| UV-2 | 0.10 |
| UV-3 | 0.10 |
| Solv-1 | 0.10 |
| Layer 2 Interlayer | |
| Gelatin | 0.50 |
| Layer 3 Low-Speed Red-Sensitive Emulsion Layer | |
| Mono-dispersed Silver Iodobromide Emulsion (AgI 4 mol %, cubic, mean grain size 0.3 μm, S/r (coefficient of variation) 0.15) | 0.50 |
| Ex-1 | $1.40 \times 10^{-3}$ |
| Ex-2 | $6.00 \times 10^{-5}$ |
| Gelatin | 0.80 |
| ExC-1 | 0.20 |
| ExC-2 | 0.10 |
| Solv-2 | 0.10 |
| Layer 4 Middle-Speed Red-Sensitive Emulsion Layer | |
| Mono-Dispersed Silver Iodobromide Emuslion (AgI 2.5 mol %, tetradecahedral, mean grain size 0.45 μm, S/r 0.15) | 0.50 |
| ExS-1 | $1.60 \times 10^{-3}$ |
| ExS-2 | $6.00 \times 10^{-5}$ |
| Gelatin | 1.00 |
| ExC-1 | 0.30 |
| ExC-2 | 0.15 |
| Solv-2 | 0.20 |
| Layer 5 High-Speed Red-Sensitive Emulsion Layer | |
| Mono-dispersed Silver Iodobromide Emulsion (AgI 2.5 mol %, tetradecahedral, mean grain size 0.60 μm, S/r 0.15) | 0.30 |
| ExS-1 | $1.60 \times 10^{-3}$ |
| ExS-2 | $6.00 \times 10^{-5}$ |
| Gelatin | 0.70 |
| ExC-1 | 0.20 |
| ExC-2 | 0.10 |
| Solv-2 | 0.12 |
| Layer 6 Interlayer | |
| Gelatin | 1.00 |
| Cpd-1 | 0.1 |
| Solv-1 | 0.03 |
| Solv-2 | 0.08 |
| Solv-3 | 0.12 |
| Cpd-2 | 0.25 |
| Layer 7 Low-Speed Green-Sensitive Emulsion Layer | |
| Silver Iodobromide Emulsion (AgI 3.0 mol %, normal crystal, twin mixture, mean grain size 0.3 μm) | 0.65 |
| ExS-3 | $3.30 \times 10^{-3}$ |
| ExS-4 | $1.50 \times 10^{-3}$ |
| Gelatin | 1.50 |
| ExM-1 | 0.10 |
| ExM-2 | 0.25 |
| Solv-2 | 0.30 |
| Layer 8 High-Speed Green-Sensitive Emulsion Layer | |
| Tabular Silver Iodobromide Emulsion (AgI 2.5 mol %, grains of aspect ratio of at least 5: 50% of the projected area of total grains, mean thickness of grains 0.15 μm) | 0.70 |
| ExS-3 | $1.30 \times 10^{-3}$ |
| ExS-4 | $5.00 \times 10^{-4}$ |
| Gelatin | 1.00 |

-continued

| | |
|---|---|
| ExM-3 | 0.25 |
| Cpd-3 | 0.10 |
| Cpd-4 | 0.05 |
| Solv-2 | 0.05 |
| Layer 9 Interlayer | |
| Gelatin | 0.50 |
| Layer 10 Yellow Filter Layer | |
| Yellow Colloidal Silver | 0.10 |
| Gelatin | 1.00 |
| Cpd-1 | 0.05 |
| Solv-1 | 0.03 |
| Solv-2 | 0.07 |
| Cpd-2 | 0.10 |
| Layer 11 Low-Speed Blue-Sensitive Emulsion Layer | |
| Silver Iodobromide Emulsion (AgI 2.5 mol %, normal crystal, twin mixture, mean grain size 0.7 μm) | 0.55 |
| ExS-5 | $1.00 \times 10^{-3}$ |
| Gelatin | 0.90 |
| ExY-1 | 0.50 |
| Solv-2 | 0.10 |
| Layer 12 High-Speed Blue-Sensitive Emulsion Layer | |
| Tabular Silver Iodobromide Emulsion (AgI 2.5 mol %, grains having aspect ratio of at least 5: 50% of the projected area of total grains, mean grain thickness 0.13 μm) | 1.00 |
| ExS-5 | $1.70 \times 10^{-3}$ |
| Gelatin | 2.00 |
| ExY-1 | 1.00 |
| Solv-2 | 0.20 |
| Layer 13 Ultraviolet Absorption Layer | |
| Gelatin | 1.50 |
| UV-1 | 0.02 |
| UV-2 | 0.04 |
| UV-3 | 0.04 |
| Cpd-5 | 0.30 |
| Solv-1 | 0.30 |
| Cpd-6 | 0.10 |
| Layer 14 Protective Layer | |
| Fine Grain Silver Iodobromide (AgI 1 mol %, mean grain size of 0.05 μm) | 0.10 |
| Gelatin | 2.00 |
| H-1 | 0.30 |

The Compounds used above are as follows.

ExS-1

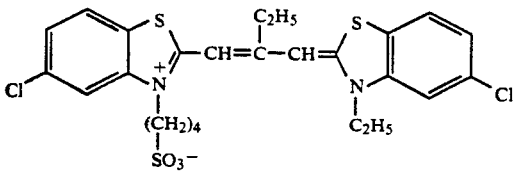

ExS-2

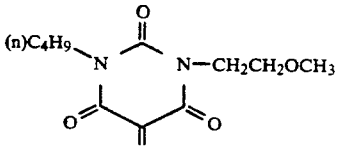

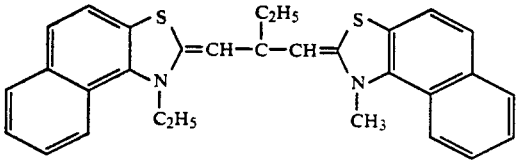

ExS-3

-continued

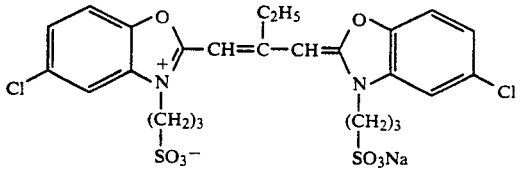

ExS-4

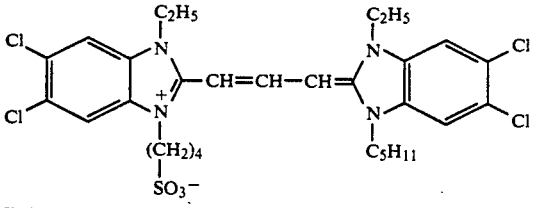

ExS-5

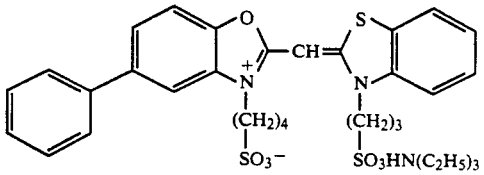

UV-1

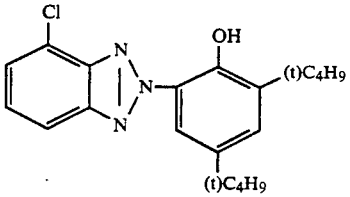

UV-2

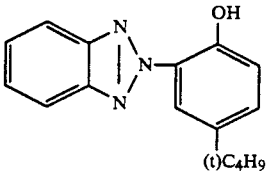

UV-3

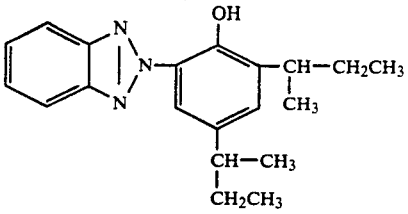

Cpd-1

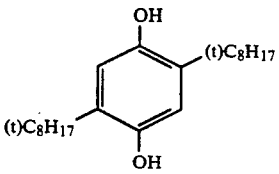

Cpd-2

Polyethyl Acrylate

Cpd-3

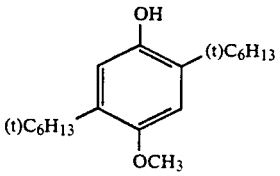

Cpd-4

-continued

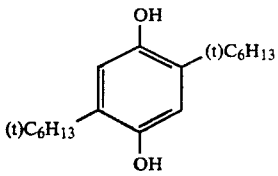

Cpd-5

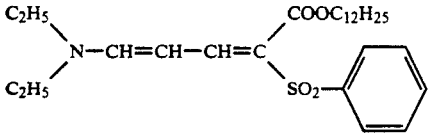

Cpd-6

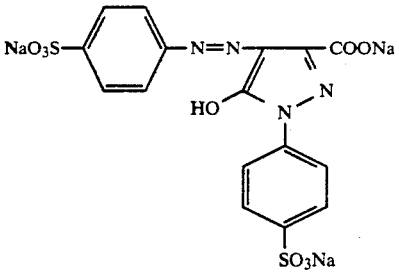

ExC-1

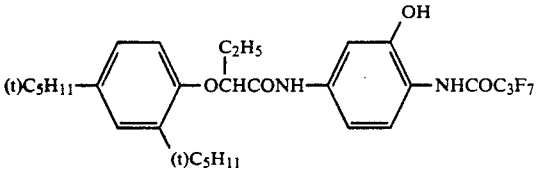

ExC-2

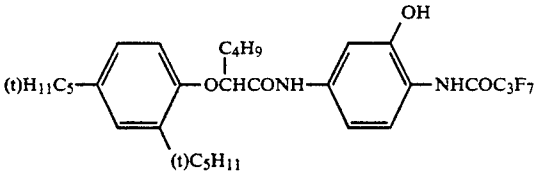

ExM-1

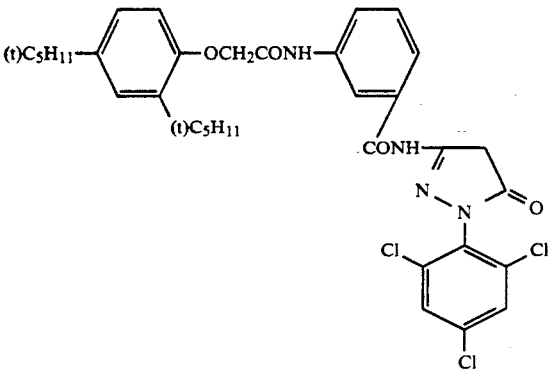

ExM-2

-continued

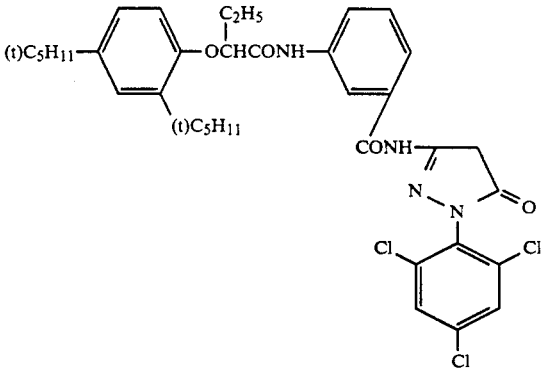

ExM-3

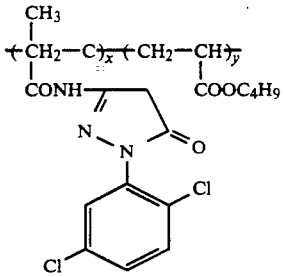

x:y = 45:55 (weight ratio)
Mean molecular weight: about 20,000

ExY-1

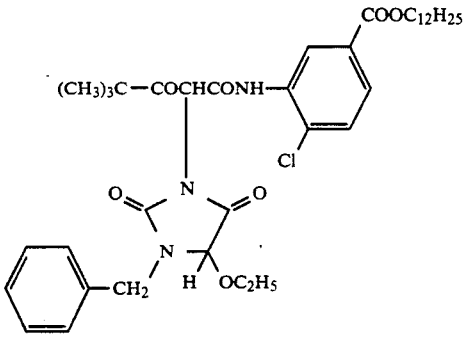

Solv-1: Dibutyl Phthalate
Solv-2: Tricresyl Phosphate
Solv-3: Trinonyl Phosphate
H-1: 1,2-Bis(vinylsulfonylacetamido)ethane

Preparation of Sample 1902

By following the same procedure as above sample except that 0.2 g of Compound A shown below was used as a comparison compound in place of yellow colloidal silver for Layer 10, Sample 1902 was prepared.

Compound A: (The yellow dye described in JP-A-61-20534)

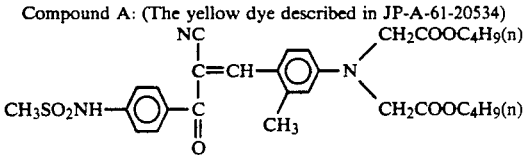

Preparation of Sample 1903

By following the same procedure as Sample 1902 except that the compound 2 of formula (I) of this invention was used in place of the compound A for Layer 10 and 0.30 g of a reducing agent ED-7 was used with Cpd-1, Sample 1903 was prepared.

Each of the samples 1901 to 1903 was wedge exposed to white light and processed as follows.

| Processing Step | Time | Temperature |
|---|---|---|
| 1st Development | 6 min. | 38° C. |
| Wash | 2 min. | 38° C. |
| Reversal | 2 min. | 38° C. |
| Color Development | 6 min. | 38° C. |
| Control | 2 min. | 38° C. |
| Bleach | 6 min. | 38° C. |
| Fix | 4 min. | 38° C. |
| Wash | 4 min. | 38° C. |
| Stabilization | 1 min. | 25° C. |

The compositions of the processing solutions were as follows.

| | |
|---|---|
| 1st Developer | |
| Nitrilo-N,N,N-trimethylene-phosphonic Acid Penta-Sodium Salt | 2.0 g |
| Sodium Sulfite | 30 g |
| Hydroquinone.Potassium monosulfonate | 20 g |
| Potassium Carbonate | 33 g |
| 1-Phenyl-4-methyl-4-hydroxymethyl-3-pyrazolidone | 2.0 g |
| Potassium Bromide | 2.5 g |
| Potassium Thiocyanate | 1.2 g |
| Potassium Iodide | 2.0 mg |
| Water to make | 1.0 liter |
| pH adjusted to 9.60 with hydrochloric acid or potassium hydroxide. | |
| Reversal Solution | |
| Nitrilo-N,N,N-trimethylenephosphonic Acid.Penta-Sodium Salt | 3.0 g |
| Stannous Chloride.Di-Hydrate | 1.0 g |
| p-Aminophenol | 0.1 g |
| Sodium Hydroxide | 8 g |
| Glacial Acetic Acid | 15 ml |
| Water to make | 1.0 liter |
| pH was adjusted to 6.00 with hydrochloric acid or sodium hydroxide. | |
| Color Developer | |
| Nitrilo-N,N,N-trimethylenephosphonic Acid.Penta-Sodium Salt | 2.0 g |
| Sodium Sulfite | 7.0 g |
| Tri-Sodium Phosphate.12$H_2O$ | 36 g |
| Potassium Bromide | 1.0 g |
| Potassium Iodide | 90 mg |
| Sodium Hydroxide | 3.0 g |
| Citrazinic Acid | 1.5 g |
| N-Ethyl-N-(β-methanesulfonamido-ethyl)-3-methyl-4-aminoaniline Sulfate | 11 g |
| 3,6-Dithiaoctane-1,8-diol | 1.0 g |
| Water to make | 1.0 liter |
| pH adjusted to 11.80 with hydrochloric acid or potassium hydroxide. | |
| Control Solution | |
| Ethylenediaminetetraacetic acid.Di-Sodium Salt.Di-Hydrate | 8.0 g |
| Sodium Sulfite | 12 g |
| 1-Thioglycerol | 0.4 ml |
| Water to make | 1.0 liter |
| pH adusted to 6.20 with hydrochloric acid or sodium hydroxide. | |
| Bleach Solution | |
| Ethylenediaminetetraacetic Acid.Di-Sodium Salt.Di-Hydrate | 2.0 g |
| Ethylenediaminetetraacetic Acid.Fe(III).Ammonium. Di-Hydrate | 120 g |
| Potassium Bromide | 100 g |
| Ammonium Nitrate | 10 g |
| Water to make | 1.0 liter |
| pH adjusted to 5.70 with hydrochloric acid or sodium hydroxide. | |
| Fix Solution | |
| Ammonium Thiosulfate | 80 g |
| Sodium Sulfite | 5.0 g |
| Sodium Hydrogensulfite | 5.0 g |
| Water to make | 1.0 liter |
| pH adjusted to 6.60 with hydrochloric acid or aqueous ammonia. | |
| Stabilization Solution | |
| Formalin (37%) | 5.0 ml |
| Polyoxyethylene-p-mono-nonyl-phenyl Ether (mean degree of polymerization 10) | 0.5 ml |
| Water to make | 1.0 liter |
| pH not adjusted. | |

The yellow and magenta densities of the samples thus processed were measured. The sample 1903 of this invention showed high sensitivity of the green-sensitive emulsion layers and low $D_{min}$ of the yellow dyes as compared with the comparison samples 1901 and 1902. This is considered to be that the compound for use in this invention shows good cutting of the absorption of a long wavelength side and gives less residual color owing to the excellent discoloring property in processing as compared with the Compound A.

While the invention has been described in detail and with reference to specific embodiments thereof, it will be apparent to one skilled in the art that various changes and modifications can be made therein without departing from the spirit and scope thereof.

What is claimed is:

1. A silver halide photographic material containing a compound having a structure represented by formula (II) or (IV):

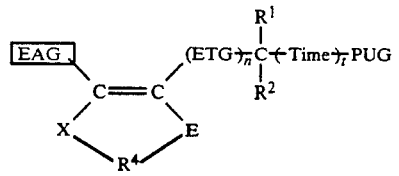

(II)

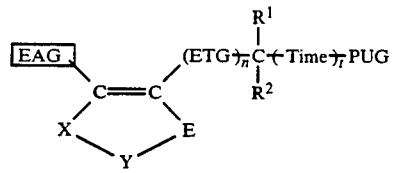

(IV)

wherein

EAG represents a group capable of accepting an electron from a reducing material;

ETG represents an electron-transmitting group;

n represents 0 or 1;

$R^1$ and $R^2$, which may be the same or different, each represents a hydrogen atom, a hydrocarbon group, a heterocyclic group, or a single bond for forming a ring with EAG;

Time represents a group releasing PUG upon cleavage of the bond between the carbon atom carrying $R^1$ and $R^2$ and Time;

t represents 0 or 1; and

PUG represents a photographically useful group;

the ring formed by

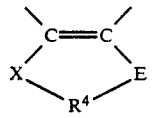

in formula (II) is selected from the group consisting of

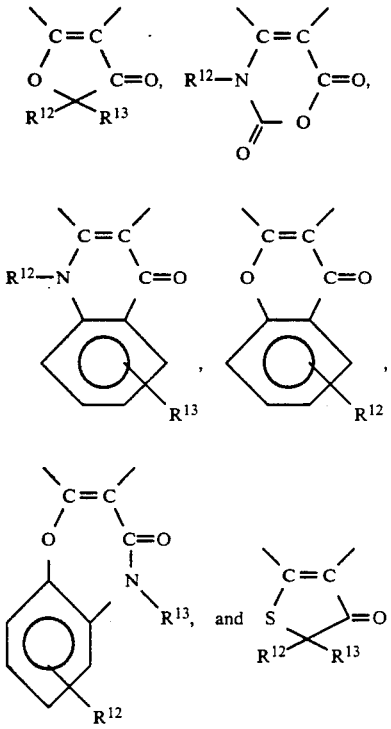

wherein $R_{12}$ and $R_{13}$ each represents a hydrogen atom or a substituent group; —X—Y— in formula (IV) represents —O—S—,

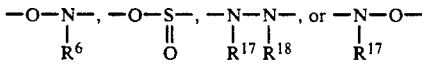

wherein $R^6$ represents a hydrogen atom, a hydrocarbon group or a substituted hydrocarbon group wherein the sum of Hammett's substituent constant op values for the substituents is less than +0.90, and $R^{17}$ and $R^{18}$ each represents a hydrogen atom or a substituent; and E in formula (II) represents an electron-attracting group.

2. A silver halide photographic material as in claim 1, wherein EAG is a group represented by formula (A):

(A)

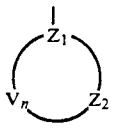

wherein $Z_1$ represents

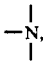

wherein Sub is a single bond, a hydrogen atom, or a substituent so that the sum of the Hammett's substituent constant op values is at least +0.50, or

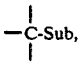

and

V represents an atomic group forming a 3- to 8-membered aromatic ring with $Z_1$ and $Z_2$.

3. A silver halide photographic material as in claim 1, wherein ETG is selected from the group consisting of groups of formulae (E-1) to (E-4):

(E-1)

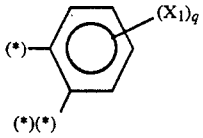

(E-2)

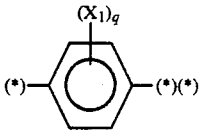

(E-3)

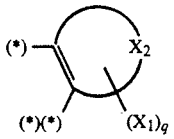

(E-4)

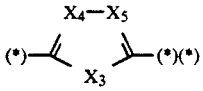

wherein (*) and (*)(*) each represents a moiety bonding to the olefin carbon atom carrying E and the carbon atom carrying $R^1$ and $R^2$, respectively, in formula (II);

$X_1$ represents a hydrogen atom, a substituted or unsubstituted aliphatic group, a substituted or unsubstituted aromatic group, a substituted or unsubstituted heterocyclic group,

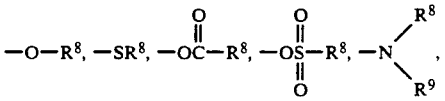

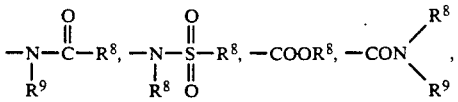

-continued

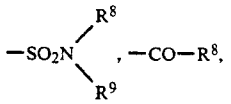

—$SO_2$—$R^8$, a cyano group, a halogen atom, or a nitro group and; wherein $R^8$ and $R^9$, which may be the same or different, each represents a hydrogen atom, a substituted or unsubstituted aliphatic group, a substituted or unsubstituted aromatic group, or a substituted or unsubstituted heterocyclic group;

q represents an integer of from 1 to 4; when q is 2 or more, the $X_1$'s may be the same or different and when q is 2 or more, the $X_1$'s may combine with each other to form a ring, $X_2$ and $X_3$ each represents an atomic group which contains at least one of carbon, nitrogen, oxygen, and sulfur and is necessary for forming a 5-membered to 7-membered heterocyclic ring, and $X_4$ and $X_5$ each represents

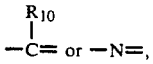

wherein $R_{10}$ represents a hydrogen atom, a substituted or unsubstituted aliphatic group, or a substituted or unsubstituted aromatic group.

4. A silver halide photographic material as in claim 1, wherein $R^1$ and $R^2$ each represents a substituted or unsubstituted alkyl group, a substituted or unsubstituted aryl group, a substituted or unsubstituted heterocylic group, or a single bond forming a ring with EAG.

5. A silver halide photographic material as in claim 1, wherein said material contains a reducing material.

6. A silver halide photographic material as in claim 5, wherein said reducing material is an organic reducing agent.

7. A silver halide photographic material as in claim 1, wherein PUG is a diffusible dye group.

8. A silver halide photographic material as in claim 1, wherein PUG is a development inhibitor group.

* * * * *